US012765635B2

(12) United States Patent
Ni et al.

(10) Patent No.: US 12,765,635 B2
(45) **Date of Patent: *Oct. 20, 2026**

(54) ARTICLES OF FOOTWEAR WITH SUPPORT STRUCTURES

(71) Applicant: PUMA SE, Herzogenaurach (DE)

(72) Inventors: Jerry C Ni, Marlborough, MA (US); Robert S Michalski, Milton, MA (US); Thomas Le, Somerville, MA (US)

(73) Assignee: PUMA SE, Herzogenaurach (DE)

( * ) Notice: Subject to any disclaimer, the term of this patent is extended or adjusted under 35 U.S.C. 154(b) by 0 days.

This patent is subject to a terminal disclaimer.

(21) Appl. No.: 19/214,905

(22) Filed: May 21, 2025

(65) Prior Publication Data

US 2025/0280921 A1 Sep. 11, 2025

Related U.S. Application Data

(63) Continuation of application No. 18/772,823, filed on Jul. 15, 2024, now Pat. No. 12,324,477, which is a (Continued)

(51) Int. Cl.
*A43B 13/12* (2006.01)
*A43B 13/18* (2006.01)

(52) U.S. Cl.
CPC ..... *A43B 13/127* (2013.01); *A43B 13/18* (2013.01)

(58) Field of Classification Search
CPC ..... A43B 13/127; A43B 13/18; A43B 13/12; A43B 13/026; A43B 13/125; A43B 3/0052; A43B 7/142
(Continued)

(56) References Cited

U.S. PATENT DOCUMENTS 2,498,624 A 2/1950 Skinner
4,463,505 A 8/1984 Duclos
(Continued)

FOREIGN PATENT DOCUMENTS

EP 1021965 A3 3/2001
EP 1033924 B1 9/2003
(Continued)

OTHER PUBLICATIONS

International Search Report and Written Opinion of the International Searching Authority for corresponding PCT Application No. PCT/IB2021/059947 dated Jan. 28, 2022, 11 pages.
(Continued)

*Primary Examiner* — Jameson D Collier
(74) *Attorney, Agent, or Firm* — Quarles & Brady, LLP

(57) ABSTRACT

An article of footwear includes an upper coupled with a sole structure that defines a forefoot region, a midfoot region, and a heel region. The sole structure includes an upper midsole cushioning member, a lower midsole cushioning member, an outsole coupled to a bottom surface of the lower midsole cushioning member, and a plate positioned between the upper midsole cushioning member and the lower midsole cushioning member. The plate includes a toe segment that extends through the forefoot region, the toe segment defining a first concave curved portion that extends downward from a distal end to a first inflection point disposed within the midfoot region. The plate further includes a middle segment defining a second concave curved portion that extends upward from the first inflection point and toward the heel region before transitioning to a convex curved portion at a second inflection point in the midfoot or heel region.

20 Claims, 30 Drawing Sheets

Related U.S. Application Data continuation of application No. 17/082,327, filed on Oct. 28, 2020, now Pat. No. 12,064,003.

(58) Field of Classification Search
USPC ..... 36/76 R
See application file for complete search history.

(56) References Cited

U.S. PATENT DOCUMENTS

| | | | |
|---|---|---|---|
| 4,510,700 | A | 4/1985 | Brown |
| 4,676,010 | A | 6/1987 | Cheskin |
| 4,854,057 | A | 8/1989 | Misevich |
| 4,942,679 | A | 7/1990 | Brandon et al. |
| 4,944,099 | A | 7/1990 | Davis |
| 5,179,791 | A | 1/1993 | Lain |
| 5,669,162 | A | 9/1997 | Dyer |
| 5,720,117 | A | 2/1998 | Toschi |
| 6,000,148 | A | 12/1999 | Cretinon |
| 6,449,878 | B1 | 9/2002 | Lyden |
| 6,502,330 | B1 | 1/2003 | David et al. |
| 6,601,042 | B1 | 7/2003 | Lyden |
| 6,775,930 | B2 | 8/2004 | Fuerst |
| 6,857,205 | B1 | 2/2005 | Fusco et al. |
| 6,883,252 | B2 | 4/2005 | Cagner |
| 6,925,732 | B1 | 8/2005 | Clarke |
| 6,951,066 | B2 | 10/2005 | Snow |
| 7,016,867 | B2 | 3/2006 | Lyden |
| 7,096,605 | B1 | 8/2006 | Kozo et al. |
| 7,100,308 | B2 | 9/2006 | Aveni |
| 7,107,235 | B2 | 9/2006 | Lyden |
| 7,401,422 | B1 | 7/2008 | Scholz et al. |
| 7,434,337 | B2 | 10/2008 | Gibert et al. |
| 7,685,741 | B2 | 3/2010 | Friedman |
| 7,752,775 | B2 | 7/2010 | Lyden |
| 7,770,306 | B2 | 8/2010 | Lyden |
| 7,832,117 | B2 | 11/2010 | Auger et al. |
| 8,122,614 | B2 | 2/2012 | Sussmann |
| 8,186,081 | B2 | 5/2012 | Wilson, III et al. |
| 8,209,883 | B2 | 7/2012 | Lyden |
| 8,341,856 | B2 | 1/2013 | Smith et al. |
| 8,567,094 | B2 | 10/2013 | Lubart |
| 8,613,149 | B2 | 12/2013 | Schwirian |
| 8,615,901 | B2 | 12/2013 | Caine et al. |
| 8,745,892 | B2 | 6/2014 | Polegato Moretti |
| 8,850,718 | B2 | 10/2014 | Lubart |
| 8,959,797 | B2 | 2/2015 | Lyden |
| 8,984,775 | B2 | 3/2015 | Dombrow |
| 9,144,265 | B2 | 9/2015 | Lubart |
| 9,179,733 | B2 | 11/2015 | Peyton et al. |
| 9,241,536 | B2 | 1/2016 | Smaldone et al. |
| 9,259,050 | B2 | 2/2016 | Smith et al. |
| 9,326,562 | B2 | 5/2016 | Weidl et al. |
| 9,357,813 | B2 | 6/2016 | Lyden |
| 9,486,036 | B1 | 11/2016 | Douglas |
| 9,491,983 | B2 | 11/2016 | Rushbrook |
| 9,510,640 | B2 | 12/2016 | Bier et al. |
| 9,549,589 | B2 | 1/2017 | Auger et al. |
| 9,585,435 | B2 | 3/2017 | Bier et al. |
| 9,615,625 | B1 | 4/2017 | Huard et al. |
| 9,629,413 | B2 | 4/2017 | Stien |
| 9,775,404 | B2 | 10/2017 | Lyden |
| 9,781,974 | B2 | 10/2017 | Reinhardt et al. |
| 9,795,186 | B2 | 10/2017 | Reinhardt et al. |
| 9,820,528 | B2 | 11/2017 | Reinhardt et al. |
| 9,820,529 | B2 | 11/2017 | Droege et al. |
| 9,894,958 | B2 | 2/2018 | Cheney et al. |
| 9,930,934 | B2 | 4/2018 | Cook et al. |
| 9,968,157 | B2 | 5/2018 | Wardlaw et al. |
| 10,010,135 | B2 | 7/2018 | Lovell et al. |
| 10,016,919 | B2 | 7/2018 | Cook et al. |
| 10,111,491 | B2 | 10/2018 | Tanabe et al. |
| 10,159,303 | B2 | 12/2018 | Wang et al. |
| 10,165,821 | B2 | 1/2019 | Truelsen |
| 10,165,824 | B2 | 1/2019 | Auger et al. |
| 10,231,517 | B2 | 3/2019 | Baucom et al. |
| 10,271,614 | B2 | 4/2019 | Huard et al. |
| 10,349,700 | B2 | 7/2019 | Amis et al. |
| 12,064,003 | B2 | 8/2024 | Ni |
| 12,324,477 | B2 * | 6/2025 | Ni ..... A43B 13/18 |
| 2003/0097767 | A1 | 5/2003 | Perkinson |
| 2003/0172548 | A1 | 9/2003 | Fuerst |
| 2003/0233770 | A1 | 12/2003 | Foscaro |
| 2004/0016144 | A1 | 1/2004 | Gallegos |
| 2004/0080070 | A1 | 4/2004 | Liu |
| 2005/0246922 | A1 | 11/2005 | Gibert |
| 2009/0183393 | A1 | 7/2009 | Lee |
| 2009/0320330 | A1 | 12/2009 | Borel |
| 2010/0122472 | A1 | 5/2010 | Wilson |
| 2010/0307025 | A1 | 12/2010 | Truelsen |
| 2010/0307028 | A1 | 12/2010 | Teteriatnikov |
| 2012/0030971 | A9 | 2/2012 | Truelsen |
| 2012/0159814 | A1 | 6/2012 | Smith |
| 2012/0233877 | A1 | 9/2012 | Swigart |
| 2013/0111781 | A1 | 5/2013 | Jaeger |
| 2014/0075778 | A1 | 3/2014 | Bruce |
| 2015/0272269 | A1 | 10/2015 | Niskanen |
| 2015/0327624 | A1 | 11/2015 | Grott |
| 2016/0015123 | A1 | 1/2016 | Peyton et al. |
| 2016/0051012 | A1 * | 2/2016 | Avar ..... A43B 13/223 36/103 |
| 2016/0353836 | A1 | 12/2016 | Luedecke |
| 2016/0353838 | A1 | 12/2016 | Takeshita et al. |
| 2017/0055626 | A1 | 3/2017 | Rushbrook |
| 2017/0071289 | A1 | 3/2017 | Auyang et al. |
| 2017/0079373 | A1 | 3/2017 | Huard |
| 2017/0095033 | A1 | 4/2017 | Farina et al. |
| 2017/0095034 | A1 | 4/2017 | Dupre et al. |
| 2017/0150780 | A1 | 6/2017 | Walker et al. |
| 2017/0258180 | A1 | 9/2017 | Cross et al. |
| 2018/0168281 | A1 | 6/2018 | Case et al. |
| 2018/0199675 | A1 | 7/2018 | Cook et al. |
| 2018/0235310 | A1 | 8/2018 | Wardlaw et al. |
| 2018/0271212 | A1 | 9/2018 | Lovell et al. |
| 2018/0295932 | A1 | 10/2018 | Wong |
| 2018/0368526 | A1 | 12/2018 | Bock |
| 2019/0110548 | A1 | 4/2019 | Auger et al. |
| 2019/0200700 | A1 | 7/2019 | Hale |
| 2019/0246745 | A1 | 8/2019 | Bock |
| 2019/0320759 | A1 | 10/2019 | Conrad et al. |
| 2019/0365030 | A1 | 12/2019 | Chambers et al. |
| 2022/0125158 | A1 | 4/2022 | Ni |
| 2024/0306764 | A1 | 9/2024 | Diard |

FOREIGN PATENT DOCUMENTS

| | | | |
|---|---|---|---|
| EP | 2724635 | B1 | 3/2015 |
| WO | 2015145329 | A1 | 1/2015 |
| WO | 2017097315 | A1 | 6/2017 |
| WO | 2018192262 | A1 | 10/2018 |

OTHER PUBLICATIONS

Office Action dated Jul. 15, 2025 issued in Japanese Patent Application No. 2023-526144, 5 pages.

European Patent Office, Examiner Report, Application No. 21805644.8, Feb. 6, 2024, 6 pages.

European Patent Office, Examiner Report, Application No. 21805644.8, Aug. 20, 2024, 5 pages.

* cited by examiner

ARTICLES OF FOOTWEAR WITH SUPPORT STRUCTURES

CROSS REFERENCE TO RELATED APPLICATIONS

This application is a continuation of U.S. application Ser. No. 18/772,823, filed on Jul. 15, 2024, which is a continuation of U.S. application Ser. No. 17/082,327, filed on Oct. 28, 2020, each of which is incorporated by reference herein in its entirety.

REFERENCE REGARDING FEDERALLY SPONSORED RESEARCH OR DEVELOPMENT

Not applicable

SEQUENCE LISTING

Not applicable

BACKGROUND

1. Field of the Disclosure

The present disclosure relates generally to an article of footwear that includes a sole structure having plates or support structures therein.

2. Description of the Background

Many conventional shoes or other articles of footwear generally comprise an upper and a sole attached to a lower end of the upper. Conventional shoes further include an internal space, i.e., a void or cavity, which is created by interior surfaces of the upper and sole, that receives a foot of a user before securing the shoe to the foot. The sole is attached to a lower surface or boundary of the upper and is positioned between the upper and the ground. As a result, the sole typically provides stability and cushioning to the user when the shoe is being worn. In some instances, the sole may include multiple components, such as an outsole, a midsole, and an insole. The outsole may provide traction to a bottom surface of the sole, and the midsole may be attached to an inner surface of the outsole, and may provide cushioning or added stability to the sole. For example, a sole may include a particular foam material that may increase stability at one or more desired locations along the sole, or a foam material that may reduce stress or impact energy on the foot or leg when a user is running, walking, or engaged in another activity. The sole may also include additional components, such as plates, embedded with the sole to increase the overall stiffness of the sole and reduce energy loss during use.

The upper generally extends upward from the sole and defines an interior cavity that completely or partially encases a foot. In most cases, the upper extends over the instep and toe regions of the foot, and across medial and lateral sides thereof. Many articles of footwear may also include a tongue that extends across the instep region to bridge a gap between edges of medial and lateral sides of the upper, which define an opening into the cavity. The tongue may also be disposed below a lacing system and between medial and lateral sides of the upper, to allow for adjustment of shoe tightness. The tongue may further be manipulable by a user to permit entry or exit of a foot from the internal space or cavity. In addition, the lacing system may allow a user to adjust certain dimensions of the upper or the sole, thereby allowing the upper to accommodate a wide variety of foot types having varying sizes and shapes.

The upper may comprise a wide variety of materials, which may be chosen based on one or more intended uses of the shoe. The upper may also include portions comprising varying materials specific to a particular area of the upper. For example, added stability may be desirable at a front of the upper or adjacent a heel region so as to provide a higher degree of resistance or rigidity. In contrast, other portions of a shoe may include a soft woven textile to provide an area with stretch-resistance, flexibility, air-permeability, or moisture-wicking properties.

However, while many currently-available shoes have varying features related to the above-noted properties, many shoes, and the sole structures thereof, may be further optimized to provide targeted support to a user's foot to aid in stability while running, walking, or engaging in strenuous athletic activities. Additionally, many shoes, and their sole structures, may be further optimized to provide targeted support to a user's foot to reduce energy dissipation and thereby increase the efficiency of a user during physical activity, such as running.

Therefore, articles of footwear having features providing such effects across areas of the foot are desired. These and other deficiencies with the prior art are outlined in the following disclosure.

SUMMARY

An article of footwear, as described herein, may have various configurations. The article of footwear may have an upper and a sole structure. The sole structure may define a forefoot region, a midfoot region, and a heel region. Further, the sole structure may include an upper midsole cushioning member, a lower midsole cushioning member, and an outsole coupled to a bottom surface of the lower midsole cushioning member. The sole structure may further include a plate positioned between the upper midsole cushioning member and the lower cushioning member.

In some embodiments, the plate may include a curved portion and a flat portion. In these embodiments, the curved portion may include an anterior curved portion that extends through at least the forefoot region of the article of footwear and a posterior curved portion that extends through the midfoot region of the article of footwear and at least a portion of the heel region of the article of footwear. In further embodiments, the plate may be constructed from carbon fiber. In addition, the anterior curved portion may include a first segment portion and a second segment portion with a split therebetween.

In further embodiments, the sole structure may also include a heel support structure in the heel region of the article of footwear and the heel support structure may be constructed from thermoplastic polyurethane. In some embodiments, the upper midsole cushioning member and the lower cushioning member are each a foam material. For example, in particular embodiments, the foam material is formed from a material selected from the group consisting of ethylene-vinyl acetate, thermoplastic polyurethane, thermoplastic elastomer, and mixtures thereof. In even further embodiments, the foam material is formed during a supercritical foaming process or physical foaming process, which may comprise nitrogen, carbon dioxide, supercritical nitrogen, or supercritical carbon dioxide.

In particular embodiments, the anterior curved portion is angled at an angle between about 5-degrees and about 45-degrees relative to a reference plane, the posterior curved portion is angled at an angle between about 3-degrees and about 45-degrees relative to the reference plane, and the flat portion is angled at an angle between about 0-degrees and about 5-degrees relative to the reference plane.

In another embodiment of the present disclosure, an article of footwear including an upper and a sole structure is provided. In this embodiment, the sole structure may define a forefoot region, a midfoot region, and a heel region, and the sole structure may include a midsole cushioning member, an outsole coupled with a bottom surface of the midsole cushioning member, and a plate. The plate may also include a toe portion, an arched portion, and a rear segment. Further, in these embodiments, the toe portion and the arched portion are positioned between the midsole cushioning member and the outsole, and the rear segment is positioned above the midsole cushioning member.

In some embodiments, the midsole cushioning member includes an aperture, and a portion of the plate between the rear segment and the arched portion extends between the aperture of the midsole cushioning member. The sole structure may further include a heel cushioning member and a heel support collar. In further embodiments, the plate may include an anterior curved portion, a medial curved portion, a posterior curved portion, and a flat portion. The anterior curved portion, the medial curved portion, the posterior curved portion, and the flat portion may be each angled relative to a reference plane.

In yet another embodiment, the present disclosure provides an article of footwear having an upper and a sole structure coupled to the upper. The sole structure, in this embodiment, may also define a forefoot region, a midfoot region, and a heel region. The sole structure may further include an upper midsole cushioning member, a lower midsole cushioning member, an outsole coupled between a bottom surface of the lower midsole cushioning member, and a plate positioned between the upper midsole cushioning member and the lower midsole cushioning member. In these embodiments, the upper midsole cushioning member and the lower midsole cushioning member are foam materials formed using a supercritical gas, and the plate comprises carbon fiber.

In still another embodiment, an article of footwear including an upper and a sole structure is provided. The sole structure is coupled with the upper and defines a forefoot region, a midfoot region, and a heel region. The sole structure includes an upper midsole cushioning member, a lower midsole cushioning member, an outsole coupled to a bottom surface of the lower midsole cushioning member, and a plate positioned between the upper midsole cushioning member and the lower midsole cushioning member. The plate includes a toe segment that extends through at least the forefoot region, the toe segment defining a first concave curved portion that extends downward from a distal end to a first inflection point disposed within the midfoot region. The plate further includes a middle segment defining a second concave curved portion that extends upward from the first inflection point and toward the heel region before transitioning to a convex curved portion at a second inflection point disposed within the midfoot region or the heel region.

In some embodiments, the toe segment of the plate includes a first split that separates the toe segment of the plate into a first toe portion and a second toe portion. In some embodiments, the first toe portion is disposed on a lateral side of the plate and the second toe portion is disposed on a medial side of the plate. In some embodiments, the plate includes a rear segment having a second split that separates the rear segment of the plate into a first rear portion and a second rear portion. In some embodiments, the first rear portion is disposed on the lateral side of the plate and the second rear portion is disposed on the medial side of the plate. In some embodiments, the plate includes a rear segment that extends through the heel region of the article of footwear from the convex curved portion defined by the middle segment of the plate. In some embodiments, a minimum width of the toe segment is larger than a minimum width of the rear segment. In some embodiments, the rear segment is disposed at a first angle of between about 3-degrees and about 45-degrees relative to a reference plane that is parallel with respect to a resting surface when the article of footwear is disposed on the resting surface. In some embodiments, the toe segment is disposed at a second angle of between about 5-degrees and about 45-degrees relative to the reference plane. In some embodiments, the middle segment is disposed at a third angle of between about 3-degrees and about 45-degrees relative to the reference plane.

In another embodiment, an article of footwear including an upper and a sole structure is provided. The sole structure is coupled with the upper and defines a forefoot region, a midfoot region, and a heel region. The sole structure includes an upper midsole cushioning member, a lower midsole cushioning member, an outsole coupled to a bottom surface of the lower midsole cushioning member, and a plate coupled to the upper midsole cushioning member and the lower midsole cushioning member. The plate includes a first split that separates a toe segment of the plate into a first toe portion and a second toe portion and a second split that separates a rear segment of the plate into a first rear portion and a second rear portion.

In some embodiments, the toe segment defines a first concave curved portion that extends downward from a distal end to a first inflection point defined in the midfoot region of the sole structure. In some embodiments, the plate includes a middle segment defining a second concave curved portion that extends upward through the midfoot region from the first inflection point. In some embodiments, the lower midsole cushioning member includes a supporting surface that projects upwardly from a top surface of the lower midsole cushioning member. In some embodiments, the supporting surface engages a lower surface of the plate.

In yet another embodiment, an article of footwear including an upper and a sole structure is provided. The sole structure is coupled with the upper, the sole structure defining a forefoot region, a midfoot region, and a heel region. The sole structure includes an upper midsole cushioning member, a lower midsole cushioning member, an outsole coupled to the lower midsole cushioning member, and a plate positioned between the upper midsole cushioning member and the lower midsole cushioning member. The plate includes a first split that separates a toe segment of the plate into a first toe portion on a lateral side of the plate and a second toe portion on a medial side of the plate. The first toe portion and the second toe portion concavely curve downward through the forefoot region from distal ends of the first toe portion and the second toe portion, respectively. The plate includes a middle segment defining a first convex curved portion that extends upward through the midfoot region toward the heel region.

In some embodiments, the plate includes a second split that separates a rear segment of the plate into a first rear portion on the lateral side of the plate and a second rear portion on the medial side of the plate. In some embodiments, the rear segment of the plate defines a second convex curved portion within the heel region. In some embodiments, the first rear portion and the second rear portion define a curved interior wall of the plate. In some embodiments, the curved interior wall concavely curves toward the forefoot region along the first rear portion to a forwardmost point of the second split before concavely curving away from the forefoot region along the second rear portion from the forwardmost point of the second split.

In still another embodiment of the present disclosure, an article of footwear including an upper and a sole structure coupled with the upper is provided. The sole structure defines a forefoot region, a midfoot region, a heel region, a toe end, and a heel end. The sole structure includes a midsole cushioning member defining a top surface, a surface that projects upwardly from the top surface of the midsole cushioning member, and a cavity. The sole structure further includes an outsole coupled to a bottom surface of the midsole cushioning member. The outsole includes a forward outsole portion positioned within the forefoot region of the sole structure, the midfoot region of the sole structure, or both. The outsole further includes a medial outsole portion positioned within the heel region of the sole structure. The outsole further includes a lateral outsole portion positioned within the heel region of the sole structure. The forward outsole portion, the medial outsole portion, and the lateral outsole portion are positioned about the cavity. The sole structure further includes a plate coupled to the top surface of the midsole cushioning member, the plate including a first surface and a second surface opposite the first surface, and a thickness between the first surface and the second surface of the plate is substantially uniform. The plate includes a toe segment that extends through at least the forefoot region, the toe segment defining a first concave curved portion that extends downward from a distal end to a first inflection point disposed within the midfoot region. The plate further includes a middle segment defining a second concave curved portion that extends upward from the first inflection point and toward the heel region before transitioning to a convex curved portion at a second inflection point disposed within the midfoot region or the heel region.

In some embodiments, the toe segment of the plate includes a first split that separates the toe segment of the plate into a first toe portion and a second toe portion. In some embodiments, the first toe portion is disposed on a lateral side of the plate. In some embodiments, the plate includes a rear segment having a second split that separates the rear segment of the plate into a first rear portion and a second rear portion. In some embodiments, the first rear portion is disposed on the lateral side of the plate and the second rear portion is disposed on a medial side of the plate. In some embodiments, the plate includes a rear segment that extends through the heel region of the sole structure from the convex curved portion defined by the middle segment of the plate. In some embodiments, a minimum width of the toe segment of the plate is larger than a minimum width of the rear segment of the plate. In some embodiments, the cavity of the midsole cushioning member is disposed within the midfoot region of the sole structure, the heel region of the sole structure, or both. In some embodiments, the toe segment of the plate is disposed at a first angle of between about 5-degrees and about 45-degrees relative to a reference plane that is parallel with respect to a resting surface when the article of footwear is disposed on the resting surface. In some embodiments, the middle segment of the plate is disposed at a second angle of between about 3-degrees and about 45-degrees relative to the reference plane.

In another embodiment of the present disclosure, an article of footwear including an upper and a sole structure coupled with the upper is provided. The sole structure defines a forefoot region, a midfoot region, a heel region, a toe end, and a heel end. The sole structure includes a midsole cushioning member defining a top surface, a surface that projects upwardly from the top surface of the midsole cushioning member, and a cavity. The sole structure further includes an outsole coupled to a bottom surface of the midsole cushioning member. The outsole includes a forward outsole portion positioned within the forefoot region of the sole structure, the midfoot region of the sole structure, or both. The outsole further includes a medial outsole portion positioned within the heel region of the sole structure. The outsole further includes a lateral outsole portion positioned within the heel region of the sole structure. The forward outsole portion, the medial outsole portion, and the lateral outsole portion are positioned about the cavity. The sole structure further includes a plate coupled to the top surface of the midsole cushioning member, the plate including a first surface and a second surface opposite the first surface, and a thickness between the first surface and the second surface of the plate is substantially uniform. The plate includes a first split that separates a toe segment of the plate into a first toe portion and a second toe portion, and a second split that separates a rear segment of the plate into a first rear portion and a second rear portion.

In some embodiments, the toe segment of the plate defines a first concave curved portion that extends downward from a distal end to a first inflection point defined in the midfoot region of the sole structure. In some embodiments, the plate includes a middle segment defining a second concave curved portion that extends upward through the midfoot region from the first inflection point. In some embodiments, a minimum width of the second split is greater than a minimum width of the first split. In some embodiments, the surface engages a lower surface of the plate.

In yet another embodiment of the present disclosure, an article of footwear including an upper and a sole structure coupled with the upper is provided. The sole structure defines a forefoot region, a midfoot region, a heel region, a toe end, and a heel end. The sole structure includes a midsole cushioning member having a top surface, a surface that projects upwardly from the top surface of the midsole cushioning member, and a cavity. The sole structure further includes an outsole coupled to the midsole cushioning member. The outsole includes a forward outsole portion positioned within the forefoot region of the sole structure, the midfoot region of the sole structure, or both. The outsole further includes a medial outsole portion positioned within the heel region of the sole structure. The outsole further includes a lateral outsole portion positioned within the heel region of the sole structure. The forward outsole portion, the medial outsole portion, and the lateral outsole portion are positioned about the cavity. The sole structure further includes a plate coupled to the top surface of the midsole cushioning member, the plate including a first surface and a second surface opposite the first surface, and a thickness between the first surface and the second surface of the plate is substantially uniform. The plate includes a first split that separates a toe segment of the plate into a first toe portion on a lateral side of the plate and a second toe portion, and the first toe portion and the second toe portion concavely curve downward through the forefoot region from distal ends of the first toe portion and the second toe portion, respectively. The plate further includes a middle segment defining a first convex curved portion that extends upward through the midfoot region toward the heel region.

In some embodiments, the plate includes a second split that separates a rear segment of the plate into a first rear portion on the lateral side of the plate and a second rear portion on a medial side of the plate. In some embodiments, the first rear portion and the second rear portion define a curved interior wall of the plate. In some embodiments, the curved interior wall concavely curves toward the forefoot region along the first rear portion to a forwardmost point of the second split before concavely curving away from the forefoot region along the second rear portion from the forwardmost point of the second split. In some embodiments, the sole structure further includes a heel support collar positioned within the heel region of the sole structure.

Other aspects of the articles of footwear described herein, including features and advantages thereof, will become apparent to one of ordinary skill in the art upon examination of the figures and detailed description herein. Therefore, all such aspects of the articles of footwear are intended to be included in the detailed description and this summary.

DETAILED DESCRIPTION OF THE DRAWINGS

Figure 1:
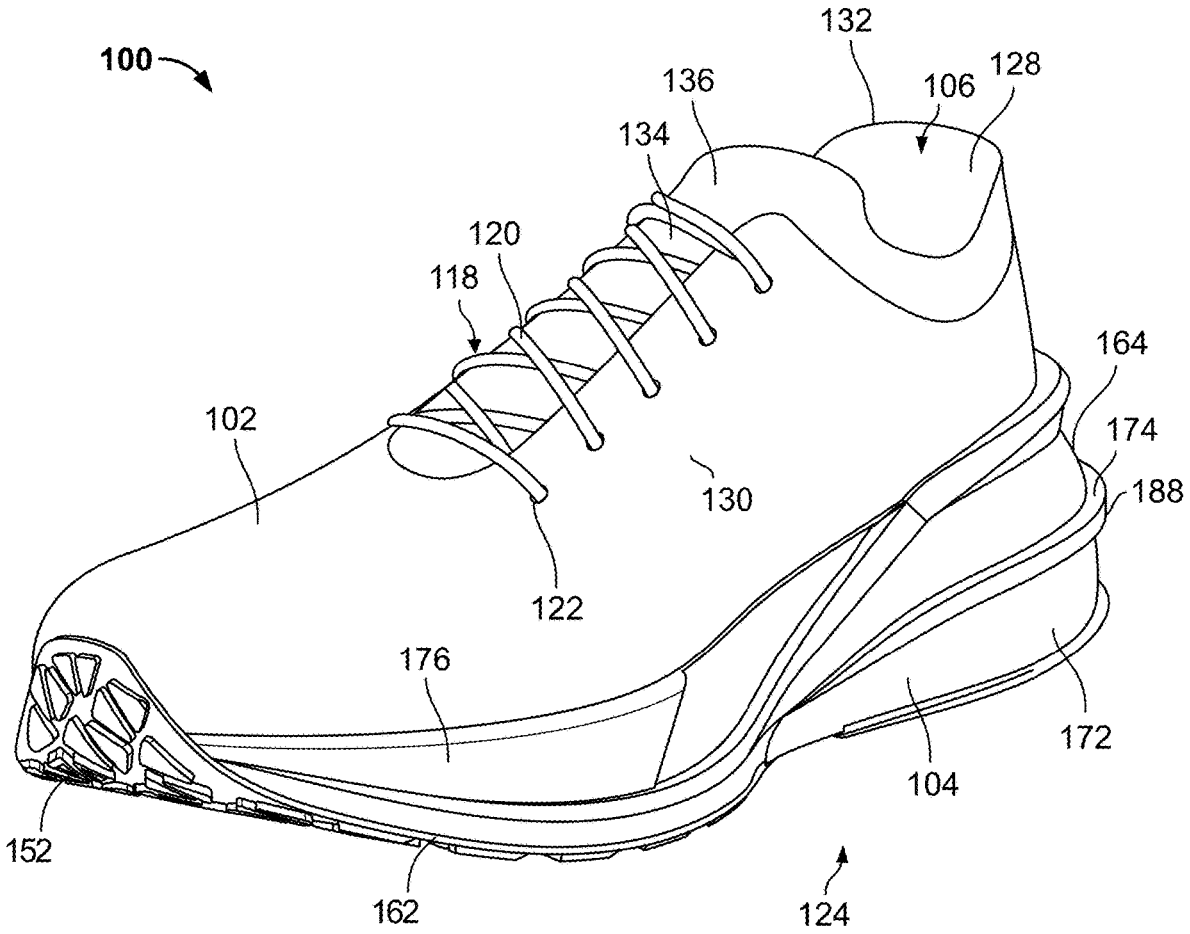
FIG. 1 is a perspective view of an article of footwear configured as a left shoe that includes an upper and a sole structure, which includes components that allow for enhanced stability and increased efficiency during physical activity, as discussed herein.

The following discussion and accompanying figures disclose various embodiments or configurations of a shoe having an upper and a sole structure. Although embodiments are disclosed with reference to a sports shoe, such as a running shoe, tennis shoe, basketball shoe, etc., concepts associated with embodiments of the shoe may be applied to a wide range of footwear and footwear styles, including basketball shoes, cross-training shoes, football shoes, golf shoes, hiking shoes, hiking boots, ski and snowboard boots, soccer shoes and cleats, walking shoes, and track cleats, for example. Concepts of the shoe may also be applied to articles of footwear that are considered non-athletic, including dress shoes, sandals, loafers, slippers, and heels.

The term "about," as used herein, refers to variations in the numerical quantity that may occur, for example, through typical measuring and manufacturing procedures used for articles of footwear or other articles of manufacture that may include embodiments of the disclosure herein; through inadvertent error in these procedures; through differences in the manufacture, source, or purity of the ingredients used to make the compositions or mixtures or carry out the methods; and the like. Throughout the disclosure, the terms "about" and "approximately" refer to a range of values ±5% of the numeric value that the term precedes.

The present disclosure is directed to an article of footwear or specific components of the article of footwear, such as an upper or a sole or a sole structure. The upper may comprise a knitted component, a woven textile, a non-woven textile, leather, mesh, suede, or a combination of one or more of the aforementioned materials. The knitted component may be made by knitting of yarn, the woven textile by weaving of yarn, and the non-woven textile by manufacture of a unitary non-woven web. Knitted textiles include textiles formed by way of warp knitting, weft knitting, flat knitting, circular knitting, or other suitable knitting operations. The knit textile may have a plain knit structure, a mesh knit structure, or a rib knit structure, for example. Woven textiles include, but are not limited to, textiles formed by way of any of the numerous weave forms, such as plain weave, twill weave, satin weave, dobbin weave, jacquard weave, double weaves, or double cloth weaves, for example. Non-woven textiles include textiles made by air-laid or spun-laid methods, for example. The upper may comprise a variety of materials, such as a first yarn, a second yarn, or a third yarn, which may have varying properties or varying visual characteristics.

FIGS. 1-7 depict an exemplary embodiment of an article of footwear configured as a shoe 100 including an upper 102 and a sole structure 104. As will be further discussed herein, the upper 102 is attached to the sole structure 104 and together with the sole structure 104 defines an interior cavity 106 (see FIGS. 1 and 4) into which a foot of a user may be inserted. For reference, the article of footwear 100 includes a forefoot region 108, a midfoot region 110, and a heel region 112 (see FIGS. 4 and 5). The forefoot region 108 generally corresponds with portions of the article of footwear 100 that encase portions of the foot that includes the toes, the ball of the foot, and joints connecting the metatarsals with the toes or phalanges. The midfoot region 110 is proximate and adjoining the forefoot region 108, and generally corresponds with portions of the article of footwear 100 that encase the arch of the foot, along with the bride of a foot. The heel region 112 is proximate and adjoining the midfoot region 110 and generally corresponds with portions of the article of footwear 100 that encase rear portions of the foot, including the heel or calcaneus bone, the ankle, or the Achilles tendon.

While only a single shoe 100 is depicted, i.e., a shoe that is worn on a left foot of a user, it should be appreciated that the concepts disclosed herein are applicable to a pair of shoes (not shown), which includes a left shoe and a right shoe that may be sized and shaped to receive a left foot and a right foot of a user, respectively. For ease of disclosure, however, a single shoe will be referenced to describe aspects of the disclosure, but the disclosure below with reference to the article of footwear 100 is applicable to both a left shoe and a right shoe. However, in some embodiments there may be differences between a left shoe and a right shoe other than the left/right configuration. Further, in some embodiments, a left shoe may include one or more additional elements that a right shoe does not include, or vice versa.

Still referring to FIGS. 1-7, the upper 102 is shown disposed above and coupled with the sole structure 104. The upper 102 could be formed conventionally from multiple elements, e.g., textiles, polymer foam, polymer sheets, leather, or synthetic leather, which are joined through bonding or stitching at a seam. In some embodiments, the upper 102 of the article of footwear 100 is formed from a knitted structure or knitted components. In various embodiments, a knitted component may incorporate various types of yarn that may provide different properties to an upper. For example, an upper mesh layer may be warp knit, while a mesh backing layer may comprise a circular knit.

In some embodiments, various layers of the upper 102 are heat pressed together so as to bond the various layers of the upper 102. For example, layers that comprise the upper 102 can be heat pressed together all at once and at a single temperature. The upper 102 may be further attached to a strobel board 114 (see FIG. 4) by strobel stitching (not shown). During manufacturing of the upper 102, locating pins (not shown) may be used to align with various holes (not shown) within the upper 102. In some embodiments, various layers of the upper 102 may be waterproof or semi-waterproof, and may include a plurality of layers of mesh or other materials. The materials that comprise the upper 102 may include an inner mesh layer, a thermoplastic polyurethane (TPU) film, and an outer mesh layer. In some embodiments, a TPU skin may be applied along the other surface of the upper.

With reference to the material, or materials, that comprise the upper 102, the specific properties that a particular type of yarn will impart to an area of a knitted component may at least partially depend upon the materials that form the various filaments and fibers of the yarn. For example, cotton may provide a soft effect, biodegradability, or a natural aesthetic to a knitted material. Elastane and stretch polyester may each provide a knitted component with a desired elasticity and recovery. Rayon may provide a high luster and moisture absorbent material, wool may provide a material with an increased moisture absorbance, nylon may be a durable material that is abrasion-resistant, and polyester may provide a hydrophobic, durable material.

Other aspects of a knitted component may also be varied to affect the properties of the knitted component and provide desired attributes. For example, a yarn forming a knitted component may include monofilament yarn or multifilament yarn, or the yarn may include filaments that are each formed of two or more different materials. In addition, a knitted component may be formed using a particular knitting process to impart an area of a knitted component with particular properties. Accordingly, both the materials forming the yarn and other aspects of the yarn may be selected to impart a variety of properties to particular areas of the upper 102.

In some embodiments, an elasticity of a knit structure may be measured based on comparing a width or length of the knit structure in a first, non-stretched state to a width or length of the knit structure in a second, stretched state after the knit structure has a force applied to the knit structure in a lateral direction.

In some embodiments, the upper 102 may include additional structural elements, or additional structural elements may surround or be coupled to the upper 102. For example, a heel cup may be provided at a heel end 116 within the heel region 112 of the shoe 100 to provide added support to a heel of a user. In some instances, other elements, e.g., plastic material, logos, trademarks, etc., may also be applied and fixed to an exterior surface using glue or a thermoforming process. In some embodiments, the properties associated with an upper, e.g., a stitch type, a yarn type, or characteristics associated with different stitch types or yarn types, such as elasticity, aesthetic appearance, thickness, air permeability, or scuff-resistance, may be varied.

Still referring to FIGS. 1-7, the article of footwear 100 also includes a tightening system 118 that includes a lace 120 and a plurality of eyelets 122. In this embodiment, the lace 120 extends through the plurality of eyelets 122. In some embodiments, the tightening system 118 may include elastic bands. The tightening system 118 may allow a user to modify dimensions of the upper 102, e.g., to tighten or loosen portions of the upper 102, around a foot as desired by the wearer. The tightening system 118 may also include a band (not shown) that runs along a center of the upper 118 and includes one or more loops through which the lace 120 may be guided. In other embodiments, the tightening system 118 may be a hook-and-loop fastening system, such as VELCRO®. For example, in some embodiments, the tightening system 118 may include one or more hook-and-loop fastening straps. In further embodiments, the tightening system 118 may be another laceless fastening system known in the art. In still further embodiments, the tightening system 118 may include a different manual lacing system, a rotary closure device, or an automatic lacing system, such as the lacing systems described in U.S. patent application Ser. No. 15/780,368, filed on May 31, 2018 and U.S. patent application Ser. No. 16/392,470, filed on Apr. 23, 2019, both of which are hereby incorporated by reference in their entirety.

Figure 2:
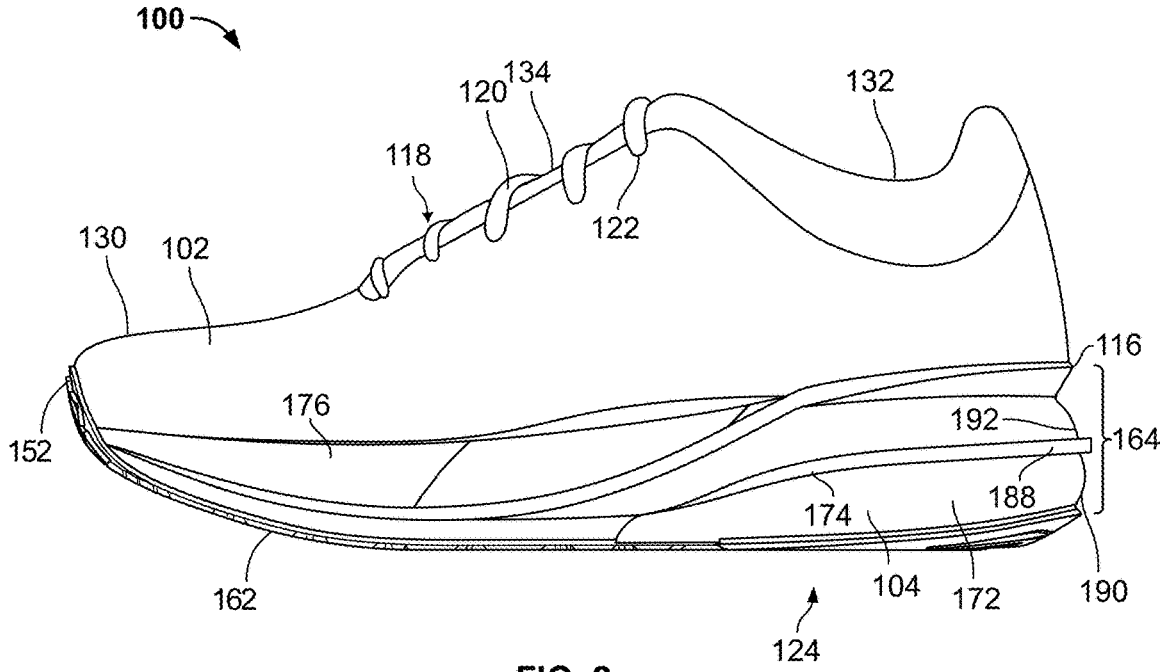
FIG. 2 is a lateral side view of the shoe of FIG. 1.
Figure 3:
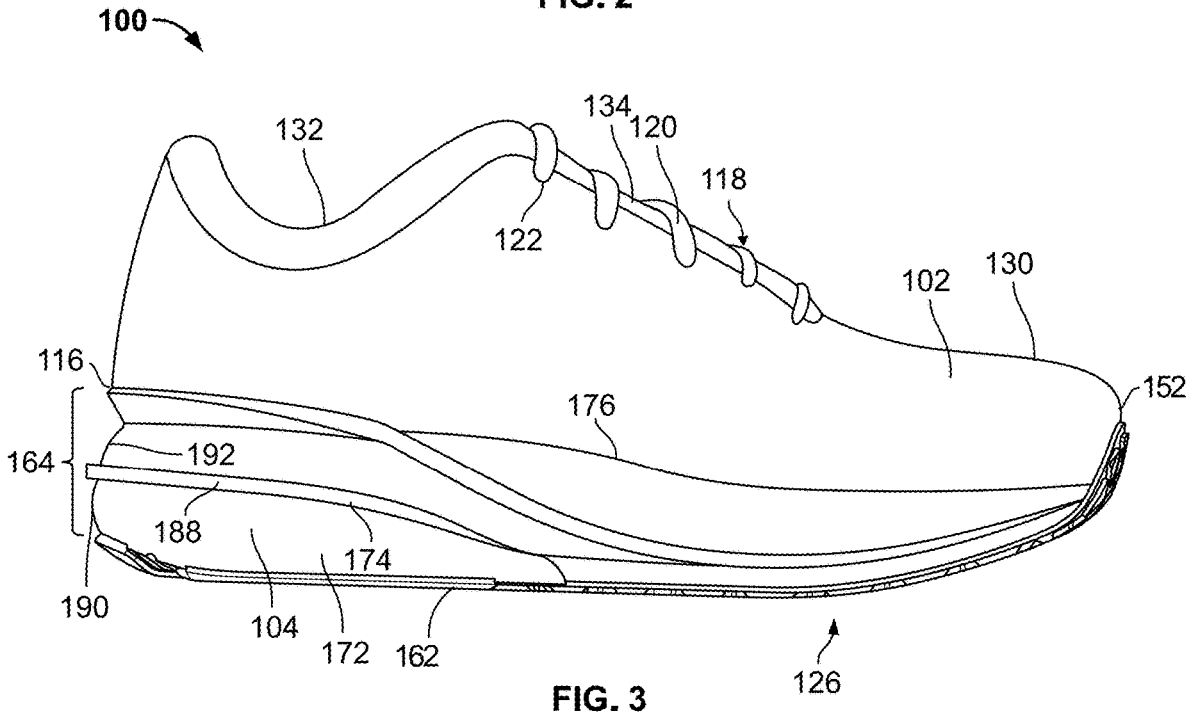
FIG. 3 is a medial side view of the shoe of FIG. 1.

Referring to FIGS. 2 and 3, the article of footwear 100 also defines a lateral side 124 and a medial side 126, the lateral side 124 being shown in FIG. 2 and the medial side 126 being shown in FIG. 3. The lace 120 extends from the lateral side 124 to the medial side 126. When a user is wearing the shoes, the lateral side 124 corresponds with an outside-facing portion of the article of footwear 100 while the medial side 126 corresponds with an inside-facing portion of the article of footwear 100. As such, a left shoe and a right shoe have opposing lateral sides and medial sides, such that the medial sides are closest to one another when a user is wearing the shoes, while the lateral sides are defined as the sides that are farthest from one another while the shoes are being worn. As will be discussed in greater detail below, the medial side 126 and the lateral side 124 adjoin one another at opposing, distal ends of the article of footwear 100.

Figure 4:
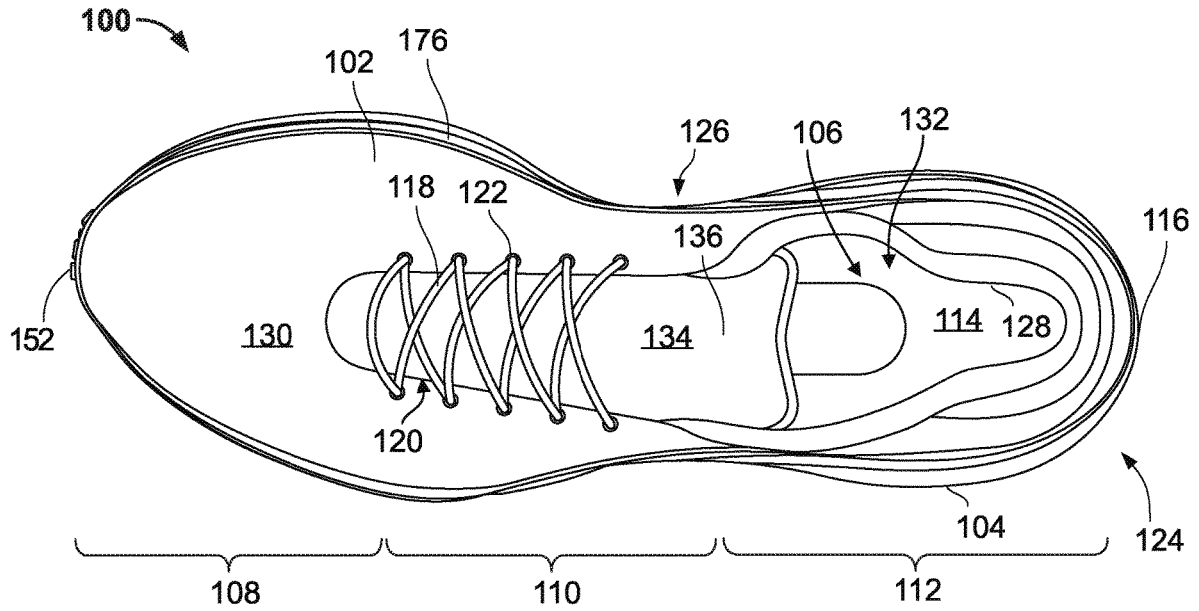
FIG. 4 is a top view of the shoe of FIG. 1.
Figure 5:
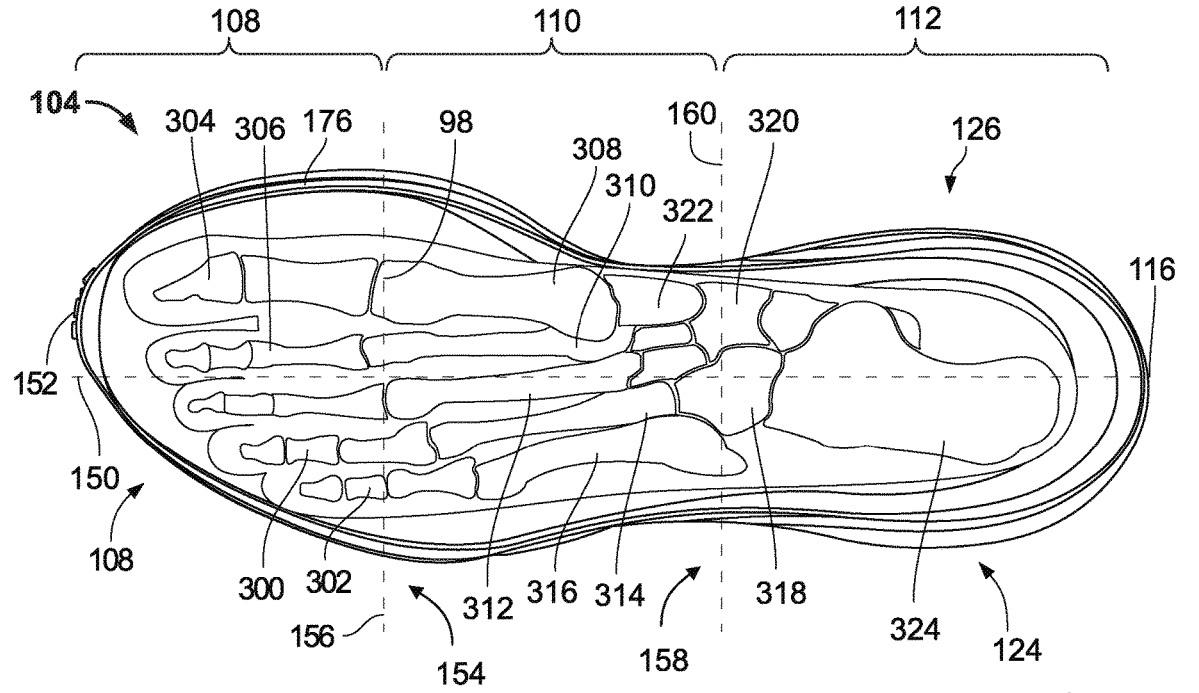
FIG. 5 is a top plan view of the shoe of FIG. 1, with the upper removed and a user's skeletal foot structure overlaid thereon.
Figure 6:
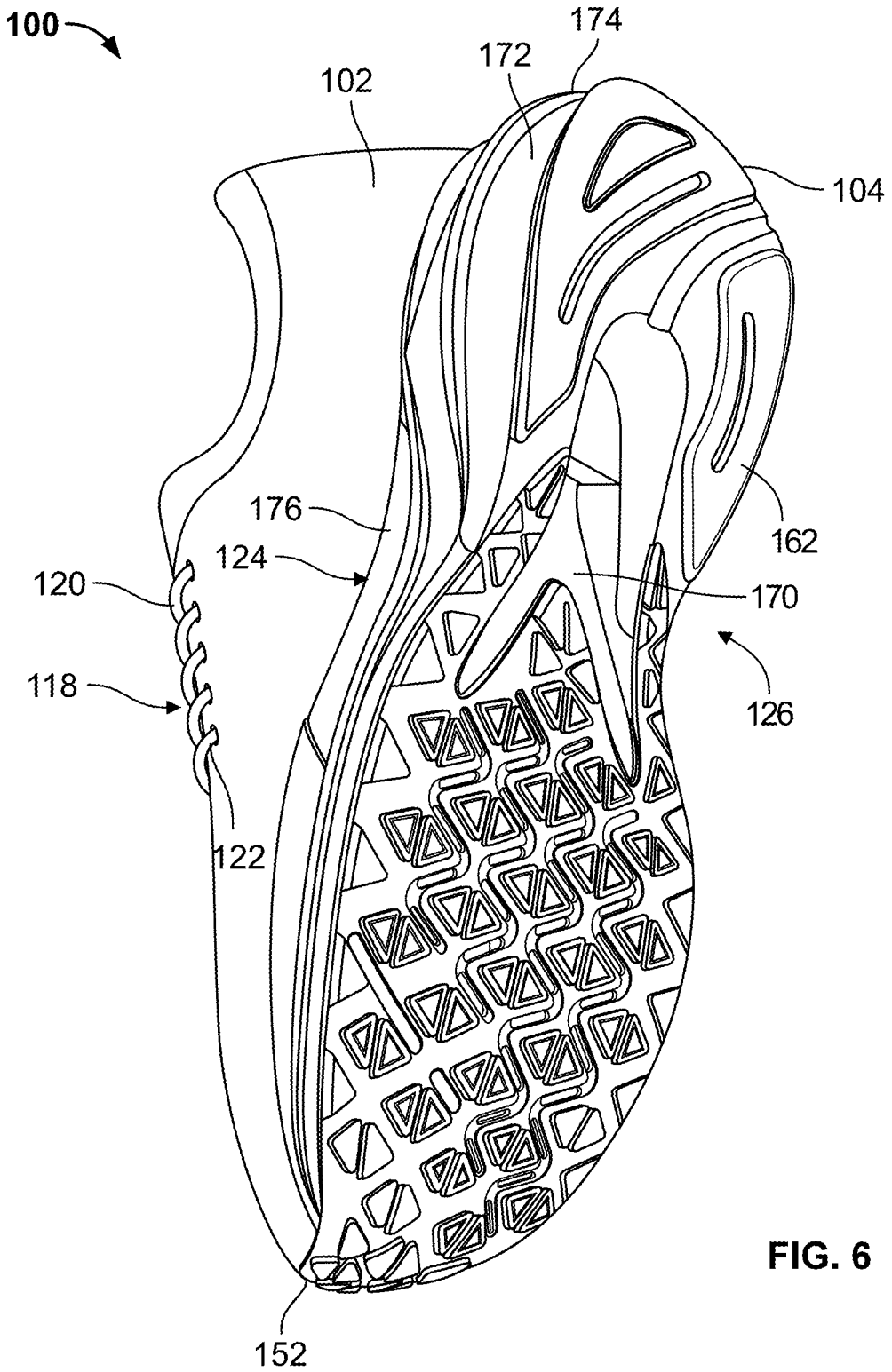
FIG. 6 is a bottom perspective view of the shoe of FIG. 1.
Figure 7:
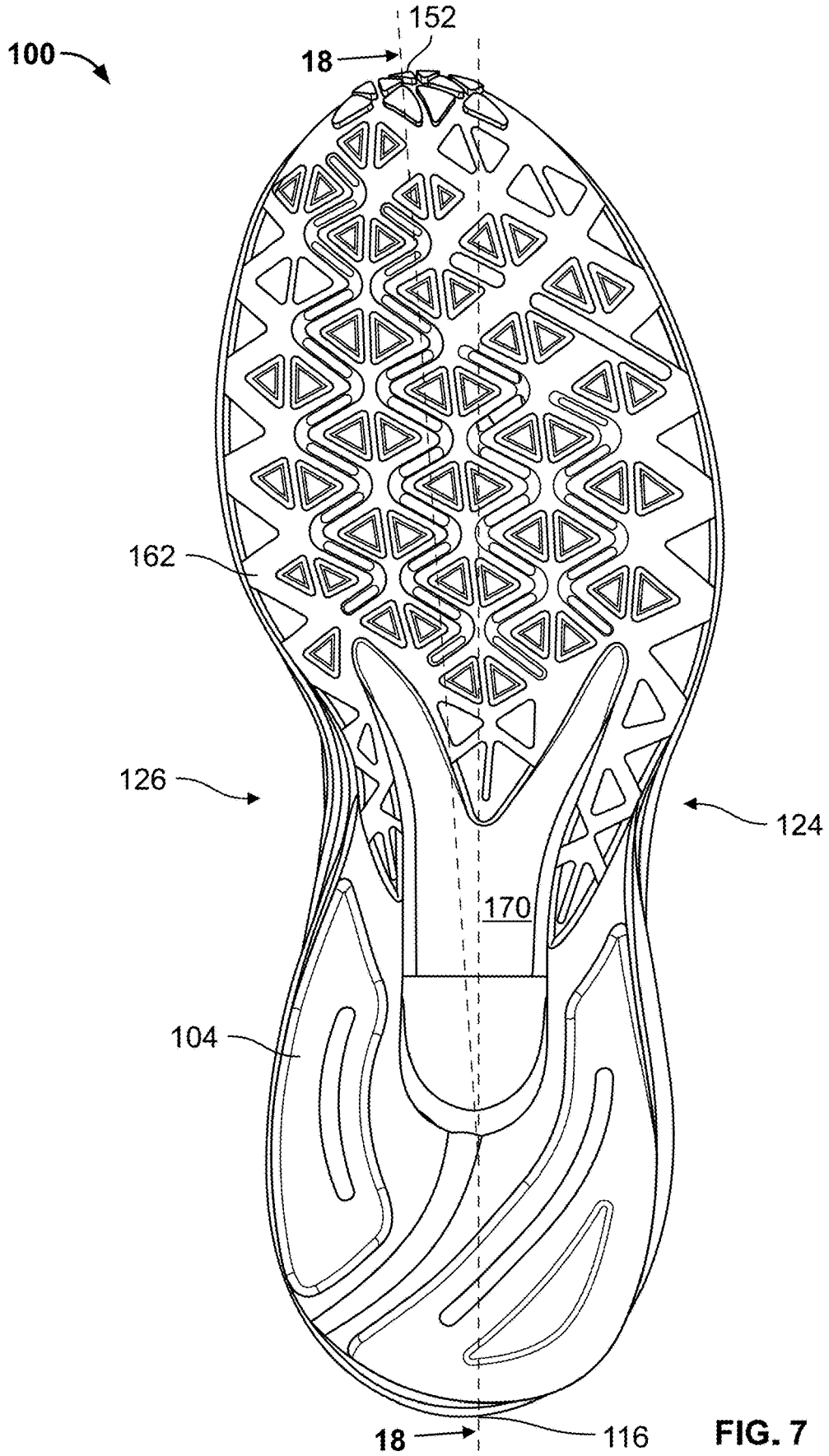
FIG. 7 is a bottom plan view of the shoe of FIG. 1.

Referring to FIGS. 4 and 5, the upper 102 extends along the lateral side 124 and the medial side 126, and across the forefoot region 108, the midfoot region 110, and the heel region 112 to house and enclose a foot of a user. When fully assembled, the upper 102 also includes an interior surface 128 and an exterior surface 130. The interior surface 126 faces inward and generally defines the interior cavity 106, and the exterior surface 130 of the upper 102 faces outward and generally defines an outer perimeter or boundary of the upper 102. The interior surface 128 and the exterior surface 130 may comprise portions of the upper layers disclosed above. The upper 102 also includes an opening 132 that is at least partially located in the heel region 112 of the article of footwear 100, that provides access to the interior cavity 106 (see, e.g., FIG. 4) and through which a foot may be inserted and removed. In some embodiments, the upper 102 may also include an instep area 134 that extends from the opening 132 in the heel region 112 over an area corresponding to an instep of a foot to an area adjacent the forefoot region 108. The instep area 132 may comprise an area similar to where a tongue 136 of the present embodiment is disposed. In some embodiments, the upper 102 does not include the tongue 136, i.e., the upper 102 is tongueless.

Referring in particular to FIG. 5, the medial side 126 and the lateral side 124 adjoin one another along a longitudinal central plane or axis 150 of the article of footwear 100. As will be further discussed herein, the longitudinal central plane or axis 150 may demarcate a central, intermediate axis between the medial side 126 and the lateral side 128 of the article of footwear 100. Put differently, the longitudinal plane or axis 150 may extend between the heel end 116 of the article of footwear 100 and a toe end 152 of the article of footwear 100 and may continuously define a middle of an insole, the sole structure 104, or the upper 102 of the article of footwear 100, i.e., the longitudinal plane or axis 150 may be a straight axis extending through the heel end 116 of the heel region 112 to the toe end 152 of the forefoot region 108.

The forefoot region 108, the midfoot region 110, the heel region 112, the medial side 126, and the lateral side 124 are intended to define boundaries or areas of the article of footwear 100. To that end, the forefoot region 108, the midfoot region 110, the heel region 112, the medial side 126, and the lateral side 124 generally characterize sections of the article of footwear 100. Certain aspects of the disclosure may refer to portions or elements that are coextensive with one or more of the forefoot region 108, the midfoot region 110, the heel region 112, the medial side 126, or the lateral side 124. Further, both the upper 102 and the sole structure 104 may be characterized as having portions within the forefoot region 108, the midfoot region 110, the heel region 112, or along the medial side 126 or the lateral side 124. Therefore, the upper 102 and the sole structure 104, or individual portions of the upper 102 and the sole structure 104, may include portions thereof that are disposed within the forefoot region 108, the midfoot region 110, the heel region 112, or along the medial side 126 or the lateral side 124.

Still referring to FIG. 5, the forefoot region 108, the midfoot region 110, the heel region 112, the medial side 126, and the lateral side 124 are shown in detail. The forefoot region 108 extends from the toe end 152 to a widest portion 154 of the article of footwear 100. The widest portion 154 is defined or measured along a first line 156 that is perpendicular with respect to the longitudinal axis 150 that extends from a distal portion of the toe end 152 to a distal portion of a heel end 116, which is opposite the toe end 152. The midfoot region 110 extends from the widest portion 154 to a thinnest portion 158 of the article of footwear 100. The thinnest portion 158 of the article of footwear 100 is defined as the thinnest portion of the article of footwear 100 measured along a second line 160 that is perpendicular with respect to the longitudinal axis 150. The heel region 112 extends from the thinnest portion 160 to the heel end 116 of the article of footwear 100.

It should be understood that numerous modifications may be apparent to those skilled in the art in view of the foregoing description, and individual components thereof, may be incorporated into numerous articles of footwear. Accordingly, aspects of the article of footwear 100 and components thereof, may be described with reference to general areas or portions of the article of footwear 100, with an understanding the boundaries of the forefoot region 108, the midfoot region 110, the heel region 112, the medial side 126, or the lateral side 124 as described herein may vary between articles of footwear. However, aspects of the article of footwear 100 and individual components thereof, may also be described with reference to exact areas or portions of the article of footwear 100 and the scope of the appended claims herein may incorporate the limitations associated with these boundaries of the forefoot region 108, the midfoot region 110, the heel region 112, the medial side 126, or the lateral side 124 discussed herein.

Still referring to FIG. 5, the medial side 126 begins at the distal toe end 152 and bows outward along the forefoot region 108 toward the midfoot region 110. At the first line 156, the medial side 126 bows inward, toward the central, longitudinal axis 150. The medial side 126 extends from the first line 156, i.e., the widest portion 154, toward the second line 160, i.e., the thinnest portion 158, entering into the midfoot region 110 upon crossing the first line 156. After reaching the second line 160, the medial side 126 bows outward, away from the longitudinal, central axis 150, at which point the medial side 126 extends into the heel region 112, i.e., upon crossing the second line 160. The medial side 126 then bows outward and then inward toward the heel end 116, and terminates at a point where the medial side 126 meets the longitudinal, center axis 150.

Still referring to FIG. 5, the lateral side 124 also begins at the distal toe end 152 and bows outward along the forefoot region 108 toward the midfoot region 110. The lateral side 124 reaches the first line 156, at which point the lateral side 124 bows inward, toward the longitudinal, central axis 150. The lateral side 124 extends from the first line 156, i.e., the widest portion 154, toward the second line 160, i.e., the thinnest portion 158, entering into the midfoot region 110 upon crossing the first line 156. After reaching the second line 160, the lateral side 124 bows outward, away from the longitudinal, central axis 150, at which point the lateral side 124 extends into the heel region 112, i.e., upon crossing the second line 160. The lateral side 124 then bows outward and then inward toward the heel end 116, and terminates at a point where the lateral side 124 meets the longitudinal, center axis 150.

Referring again to FIGS. 2 and 3, the sole structure 104 includes an outsole or outsole region 162, a midsole or midsole region 164, and an insole or insole region (not shown). In some embodiments, the sole structure 104 includes an insole, however, in the depicted embodiments, the insole is a separate element that is inserted into the foot cavity atop of the strobel board 114. The outsole 162, the midsole 164, and the insole, or any components thereof, may include portions within the forefoot region 108, the midfoot region 110, or the heel region 112. Further, the outsole 162, the midsole 164, and the insole, or any components thereof, may include portions on the lateral side 124 or the medial side 126. The outsole 162, the midsole 164, and any other portions of the sole structure 104 may be attached to one another via an adhesive (not shown). The upper 102 is further attached to the sole structure via adhesive or stitching.

In some instances, the outsole 162 may be defined as a portion of the sole structure 104 that at least partially contacts an exterior surface, e.g., the ground, when the article of footwear 100 is worn. The insole may be defined as a portion of the sole structure 104 that at least partially contacts a user's foot when the article of footwear is worn. Finally, the midsole 164 may be defined as at least a portion of the sole structure 104 that extends from the outsole toward the upper 102 or that otherwise extends between and connects the outsole 162 with the insole region.

Figure 8:
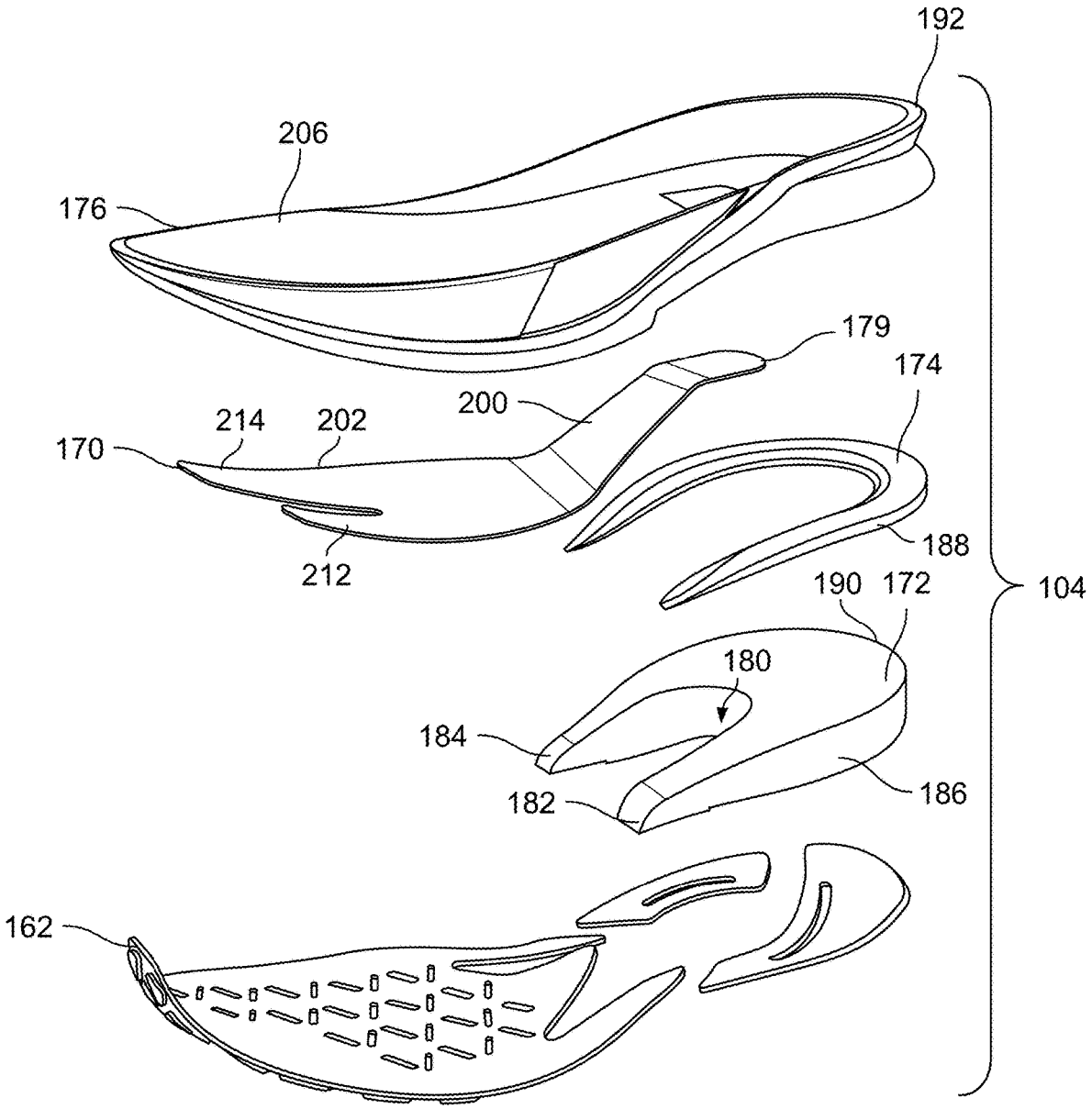
FIG. 8 is an exploded view of the sole structure of FIG. 1, wherein the sole structure includes an outsole, a midsole body, a plate, a heel support, and a heel support collar.

With particular reference to FIG. 8, which is an exploded view of the sole structure 104 of the article of footwear 100, the sole structure 104 may include the outsole 162, a plate 170, a heel cushioning member 172, a heel support collar 174, and a midsole cushioning member 176. In this embodiment, the midsole cushioning member 176 includes an aperture 178 (see FIGS. 14 and 15), through which a rear segment 179 of the plate 170 (see FIGS. 9-13) may be inserted, as will be further discussed herein. Although the outsole 162, the plate 170, the heel cushioning member 172, the heel collar 174, and the midsole cushioning member 176 are separate components in the present embodiment, these components or portions thereof may be integral with other components in alternative embodiments. For example, in some embodiments, the heel cushioning member 172 and the heel support collar 174 may be integral or a single piece.

Figure 18:
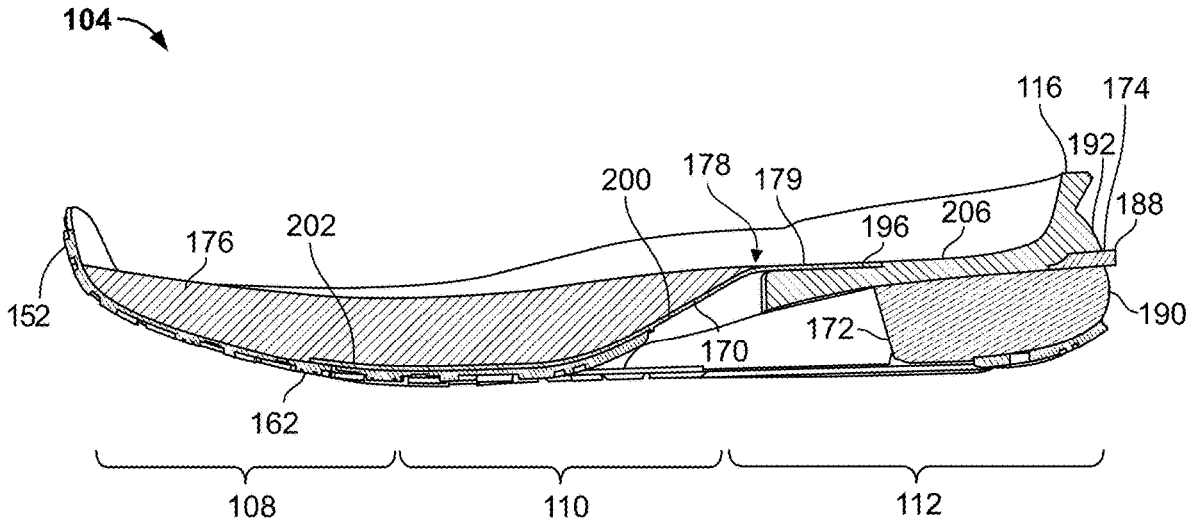
FIG. 18 is a cross-sectional view of the sole structure of FIG. 7 taken along line 18-18 thereof.

As shown in FIG. 8 and FIG. 18, which is a cross-sectional view of the sole structure 104, the outsole 162 may define a bottom end or surface of the sole structure 104 across the heel region 112, the midsole region 110, and the forefoot region 108. Further, as previously discussed herein, the outsole 162 may be a ground-engaging portion of the sole structure 104 and may be opposite from the insole thereof. The outsole 162 may be formed from one or more materials to impart durability, wear-resistance, abrasion resistance, or traction to the sole structure 104. In some embodiments, the outsole 162 may be formed from rubber, for example.

In this embodiment, the sole structure 104 may also include the heel cushioning member 172, which may be positioned adjacent to and on top of the outsole 162 in the heel region 112 and partially in the midfoot region 110. Put differently, the heel cushioning member 172 may be adjacent to the outsole 162, and may extend from the heel end 116 of the sole structure 104, through the heel region 112, and partially through the midfoot region 110. The heel cushioning member 172 may also include a cut-out portion 180 defined by a lateral prong 182 and a medial prong 184. The heel cushioning member 172 may be constructed from Ethylene-vinyl acetate (EVA), copolymers thereof, or a similar type of material. For example, in some embodiments, the heel cushioning member 172 may be an EVA-Solid-Sponge ("ESS") material, an EVA foam (e.g., PUMA® ProFoam Lite™, IGNITE Foam), polyurethane, polyether, an olefin block copolymer, a thermoplastic material (e.g., a thermoplastic polyurethane, a thermoplastic elastomer, a thermoplastic polyolefin, etc.), or a supercritical foam. The heel cushioning member 172 may be a single polymeric material or may be a blend of materials, such as an EVA copolymer, a thermoplastic polyurethane, a polyether block amide (PEBA) copolymer, and/or an olefin block copolymer.

In embodiments where the heel cushioning member 172 is formed from a supercritical foaming process, the supercritical foam may comprise micropore foams or particle foams, such as a TPU, EVA, PEBAX® (a type of polyether block amide copolymer), or mixtures thereof, manufactured using a process that is performed within an autoclave, an injection molding apparatus, or any sufficiently heated/pressurized container that can process the mixing of a supercritical fluid (e.g., $CO_2$, $N_2$, or mixtures thereof) with a material (e.g., TPU, EVA, polyolefin elastomer, or mixtures thereof) that is preferably molten. During an exemplary process, a solution of supercritical fluid and molten material is pumped into a pressurized container, after which the pressure within the container is released, such that the molecules of the supercritical fluid rapidly convert to gas to form small pockets within the material and cause the material to expand into a foam, which may be used as the heel cushioning member 172. In further embodiments, the heel cushioning member 172 may be formed using alternative methods known in the art, including the use of an expansion press, an injection machine, a pellet expansion process, a cold foaming process, a compression molding technique, die cutting, or any combination thereof. For example, the heel cushioning member 172 may be formed using a process that involves an initial foaming step in which supercritical gas is used to foam a material and then compression molded or die cut to a particular shape. In particular embodiments, however, the heel cushioning member 172 is provided to reduce stress or increase the strength of portions, e.g., the heel region 112, of the sole structure 104. As such, in these embodiments, the heel cushioning member 172 has a stiffness (e.g., tensile strength or flexural strength) greater than the midsole cushioning member 176.

The heel cushioning member 172 may include a density within the range between about 0.05 grams per cubic centimeter (g/cm$^3$) and about 0.30 g/cm$^3$, or between about 0.10 g/cm$^3$ and about 0.20 g/cm$^3$. In further embodiments, the heel cushioning member 172 may have a hardness between about ten (10) Shore A to about fifty (50) Shore A. In even further embodiments, the heel cushioning member 172 may be a bladder encasing a plurality of beads, such as a plurality of spherical or ellipsoidal beads or pellets formed from thermoplastic polyurethane, a thermoplastic elastomer, or a supercritical foam. For example, the heel cushioning member 172 may define an interior void (not shown) that receives a pressurized fluid or a plurality of ellipsoidal or spherical beads, such as the hollow space filled with a number of plastic bodies described in PCT Publication No. WO 2017/097315, filed on Dec. 7, 2015, which is hereby incorporated by reference in its entirety.

With continued reference to FIGS. 8 and 18, the heel support collar 174 may be adjacent to and positioned on top of the heel cushioning member 172, and adjacent to and positioned below the midsole cushioning member 176. In particular embodiments, the heel support collar 174 may have a shape that mimics an outer peripheral wall 186 of the heel cushioning member 172. For example, in this particular embodiment, the heel support collar 174 mimics the outer peripheral wall 186 of the heel cushioning member 172 and is generally U-shaped or horseshoe shaped. Further, as best shown in FIG. 18, an exterior edge 188 of the heel support collar 174 may extend rearward a distance beyond a rearward end 190 of the heel cushioning member 172 and a rearward end 192 of the midsole cushioning member 176. The heel support collar 174 may be formed from a thermoplastic material, such as a thermoplastic polyurethane, a thermoplastic elastomer, a thermoplastic olefin, or the like. Further, in particular embodiments, the heel support collar 174 may have a hardness between about ten (10) Shore A to about ninety (90) Shore A. In some embodiments, the heel support collar 174 may have a hardness or stiffness value greater than a hardness or stiffness value of the heel cushioning member 176.

The sole structure 104 also typically includes a midsole cushioning member 176, which may be adjacent to and on top of the outsole 162 in the forefoot region 108, and adjacent to and on top of the heel cushioning member 172 in the heel region 112 of the article of footwear 100. The sole structure 104 may also include recessed portions 194, 196 (see FIGS. 15 and 16) that communicate with, embed, or encapsulate at least a portion of the plate 170 and the heel cushioning member 172, as will be further discussed herein. Even further, as will be further discussed herein, the midsole cushioning member 176 may include an aperture 178 through which a portion of the plate 170 may extend, such that a portion of the plate 170, e.g., a rear segment 179 thereof, is vertically above the midsole cushioning member 176 in the heel region 112 (see FIG. 18) and a portion of the plate 170, e.g., an arched segment 200 and/or toe segment 202 thereof (see FIGS. 10 and 12), is vertically below the midsole cushioning member 176 in the midfoot region 110 and/or the forefoot region 108 of the article of footwear 100 (see FIG. 18). In this embodiment, the midsole cushioning member 176 may also include a recessed portion 196 (see FIG. 14) in the heel region 112 that cooperates with and defines the shape and size of the rear segment 179 of the plate 170. For example, in this particular embodiment, a top surface 206, which may be strobel board 114, may include the recessed portion 196.

Figure 14:
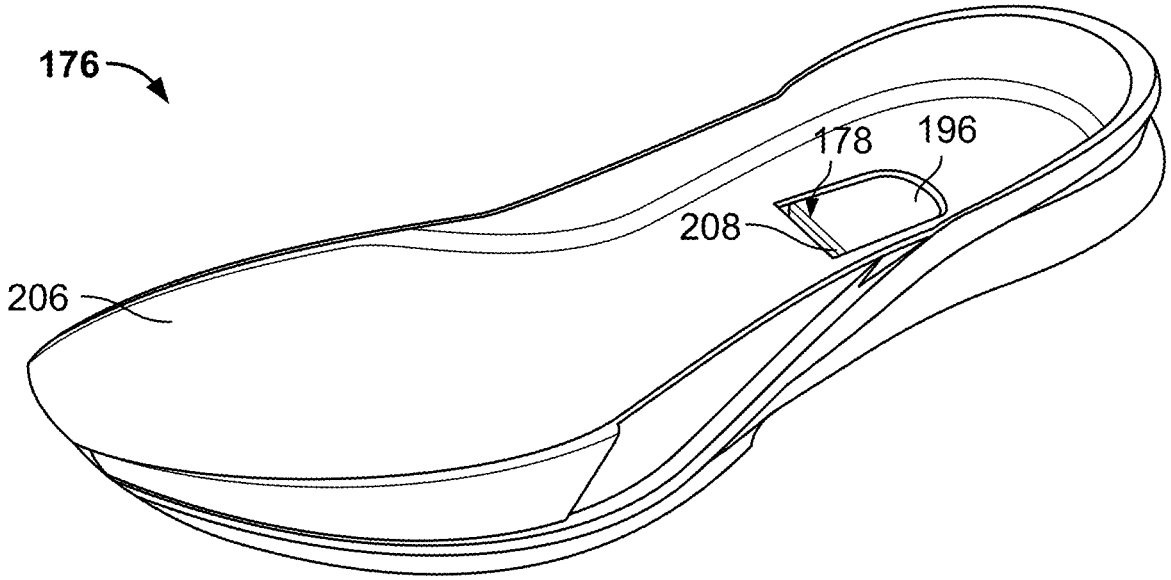
FIG. 14 is a perspective view of the midsole body of FIG. 8.
Figure 15:
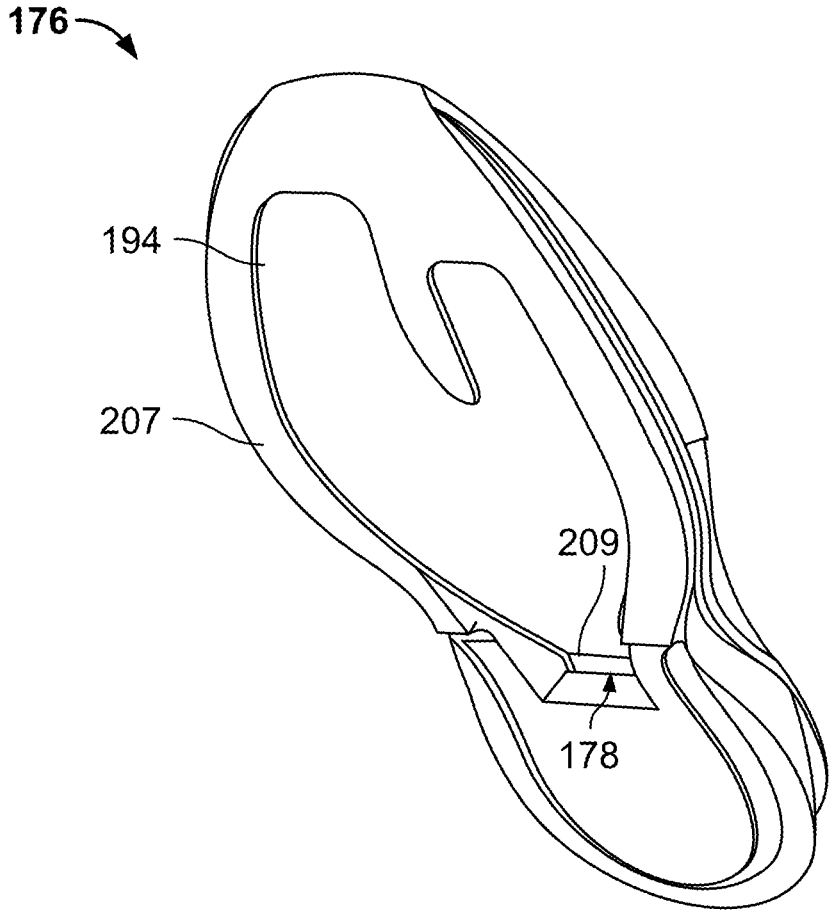
FIG. 15 is a bottom perspective view of the midsole body of FIG. 8.
Figure 16:
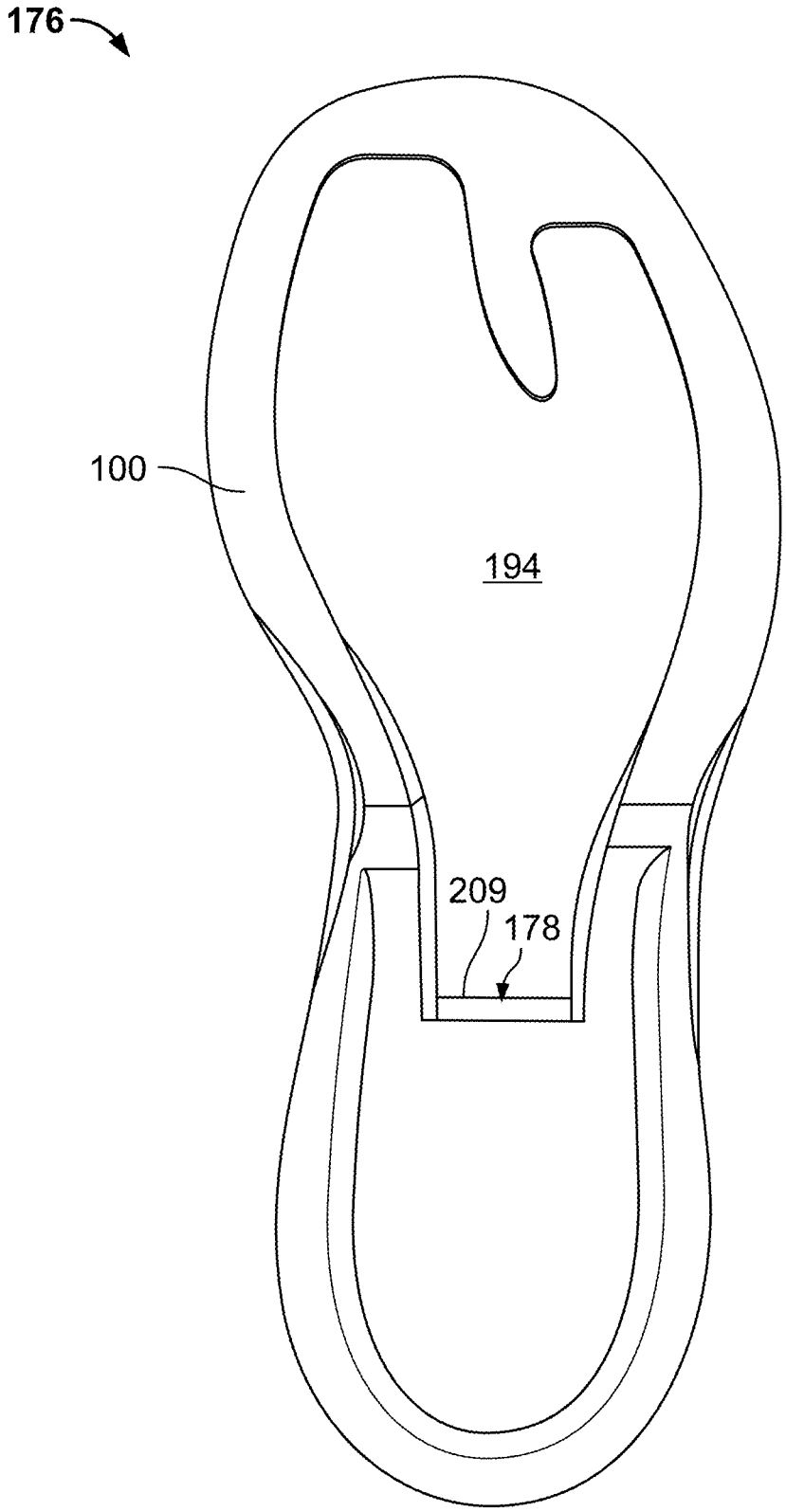
FIG. 16 is a bottom view of the midsole body of FIG. 8.
Figure 17:
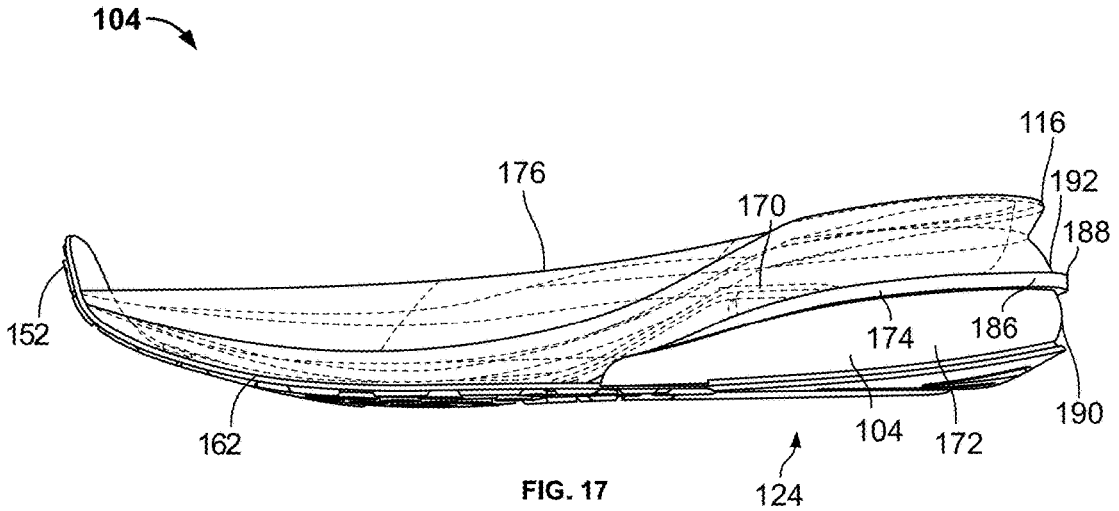
FIG. 17 is a lateral side view of the midsole body of FIG. 8, with internal structure thereof show in broken lines.

With reference to FIG. 14-16, the midsole cushioning member 176 may include a top surface 206, which may be the strobel board 114, with a recessed portion 196 within the heel region 112 that mimics the rear segment 179 of the plate 170. The midsole cushioning member 176 may further include a bottom surface 207 having the recessed portion 194 within the forefoot region 108 and the midfoot region 110 of the article of footwear 100 that mimics the toe segment 202 and the arched segment 200 of the plate 170. Further, an aperture 178 is proximate to a front end 208 of the recessed portion 196, i.e., an end of the recessed portion 196 closest to the toe end 152 of the article of footwear 100, and proximate to a rear end 209 of the recessed portion 194, i.e., an end of the recessed portion 194 closest to the heel end 116 of the article of footwear 100.

In some embodiments, a sidewall may partially surround a portion of a perimeter of the midsole cushioning member 176 to define a cavity that helps support and retain a foot. For example, in this particular embodiment, the midsole cushioning member 176 may include the sidewall that forms a rim around the heel region 112 and at least a portion of the midfoot region 110 of the article of footwear 100, which acts to cradle and support a foot during use of the article of footwear 100.

The midsole cushioning member 176 may be constructed from EVA, copolymers thereof, or a similar type of material. For example, in some embodiments, the midsole cushioning member 176 may be an ESS material, an EVA foam (e.g., PUMA® ProFoam Lite™, IGNITE Foam), polyurethane, polyether, an olefin block copolymer, a thermoplastic material (e.g., a thermoplastic polyurethane, a thermoplastic elastomer, a thermoplastic polyolefin, etc.), or a supercritical foam. Similar to the heel cushioning member 172, the midsole cushioning member 176 may be a single polymeric material or may be a blend of materials, such as an EVA copolymer, a thermoplastic polyurethane, a polyester block amide (PEBA) copolymer, and/or an olefin block copolymer. Further, the midsole cushioning member 176 may also be formed from a supercritical foaming process that uses a supercritical gas, e.g., $CO_2$, $N_2$, or mixtures thereof, to foam a material, e.g., EVA, TPU, TPE, or mixtures thereof. In such embodiments, the midsole cushioning member 176 may be manufactured using a process that is performed in an autoclave, an injection molding apparatus, or any sufficiently heated/pressurized container that can process the mixing of a supercritical fluid (e.g., $CO_2$, $N_2$, or mixtures thereof) with a material (e.g., TPU, EVA, polyolefin elastomer, or mixtures thereof) that is preferably molten. For example, in an exemplary process, a solution of supercritical fluid is mixed with a molten material. This mixture is pumped or injected into a pressurized container, after which the pressure within the container is released, such that the molecules of the supercritical fluid rapidly convert to gas to form small pockets within the material and cause the material to expand into a foam, which may be used as the midsole cushioning member 176. In further embodiments, the midsole cushioning member 176 may be formed using alternative methods known in the art, including the use of an expansion press, an injection machine, a pellet expansion process, a cold foaming process, a compression molding technique, die cutting, or any combination thereof. In particular embodiments, the midsole cushioning member 176 may be formed using a process that involves an initial foaming step, during which supercritical gas is used to foam a material, and a second step, during which the foamed material is compression molded or die cut to a particular shape. For example, the midsole cushioning member 176 may be formed using a process that involves an initial foaming process that uses a supercritical fluid to foam a material, and then a second step that compression molds the foamed material to form the recessed surfaces 194, 196 on a top surface 206 and a bottom surface 207, respectively, of the midsole cushioning member 176.

In particular embodiments, the midsole cushioning member 176 is provided to deliver ample cushioning to the sole structure 104. The midsole cushioning member 176 may have a density within the range between about 0.05 g/cm$^3$ and about 0.20 g/cm$^3$, or between about 0.10 g/cm$^3$ and about 0.20 g/cm$^3$. In further embodiments, the midsole cushioning member 176 may have a hardness between about ten (10) Shore A to about fifty (50) Shore A. In even further embodiments, the midsole cushioning member 176 may be a bladder encasing a plurality of beads, such as a plurality of spherical or ellipsoidal beads or pellets formed from thermoplastic polyurethane, a thermoplastic elastomer, or a supercritical foam. For example, the midsole cushioning member 176 may define an interior void (not shown) that receives a pressurized fluid or a plurality of ellipsoidal or spherical beads, such as the hollow space filled with a number of plastic bodies described in PCT Publication No. WO 2017/097315, filed on Dec. 7, 2015, which is hereby incorporated by reference in its entirety.

Referring back to FIGS. 8 and 18, the sole structure 104 may also include the plate 170, or a plurality of plates, positioned therein. In particular embodiments, the plate 170 may be adjacent to and positioned between the outsole 162 and the midsole cushioning member 176 in the forefoot region 108 of the article of footwear 100, such that the plate 170 is vertically below the midsole cushioning member 176 in the forefoot region 108 and/or vertically below the midsole cushioning member 176 in the midfoot region 110 of the article of footwear 100. Further, as previously noted, the midsole cushioning member 176 includes a recessed portion 194 into which the plate 170 may fit or be seated, such that the midsole cushioning member 176 at least partially encases the plate 170. The plate 170 also extends through the aperture 178 and, more particularly, the rear segment 179 of the plate 170 extends through the aperture 178. As such, in this embodiment, at least a portion of the rear segment 179 is positioned above the midsole cushioning member 176. Further, the recessed portion 196 of the midsole cushioning member 176 may partially encase the rear segment 179 of the plate 170. In this particular embodiment, the recessed portion 196 of the midsole cushioning member 176 completely surrounds and encases the rear segment 179, such that a top surface of the plate 170 is flush with the top surface 206 of the midsole cushioning member 176 (see FIG. 18).

Figure 9:
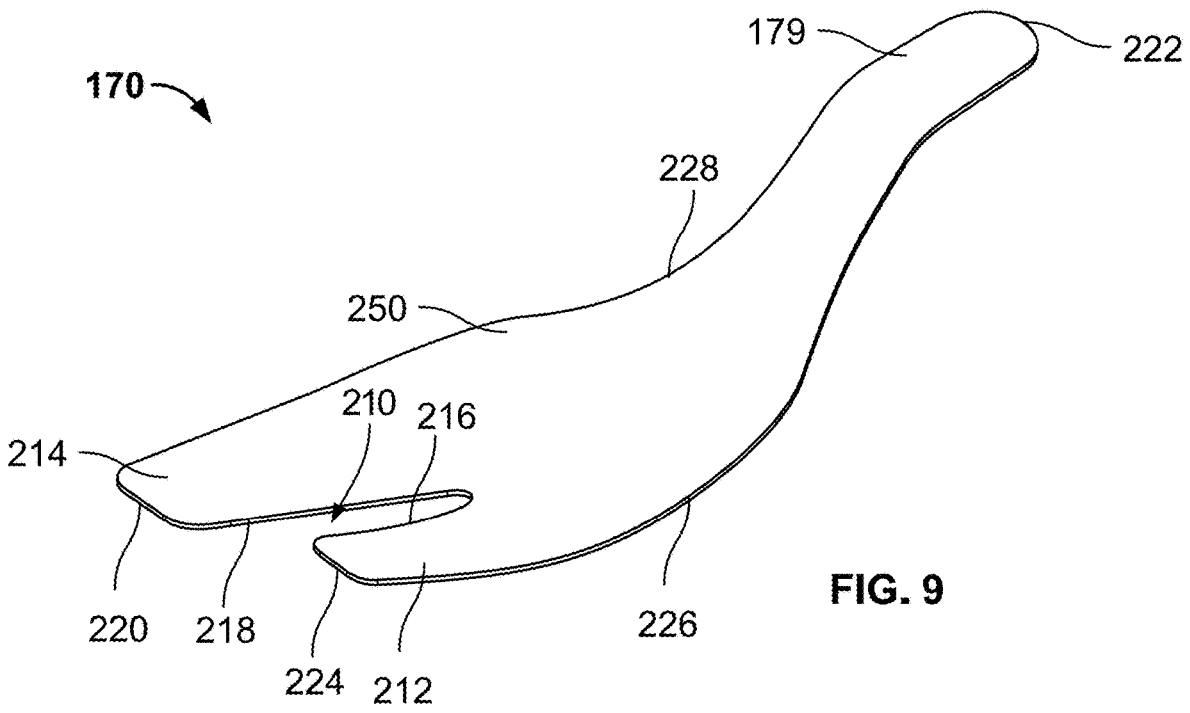
FIG. 9 is a perspective view of the plate of FIG. 8.
Figure 10:
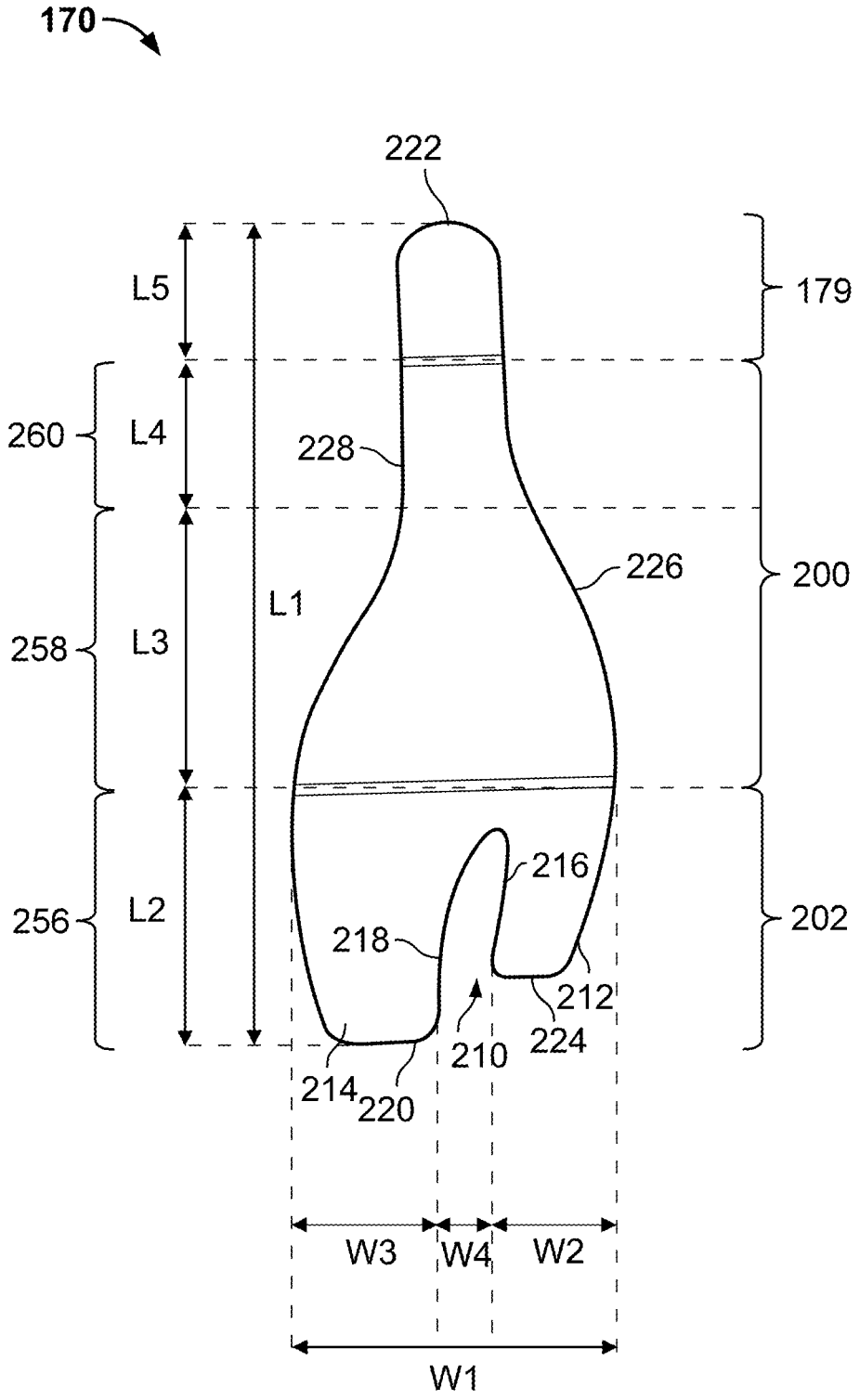
FIG. 10 is a top view of the plate of FIG. 8.
Figure 11:
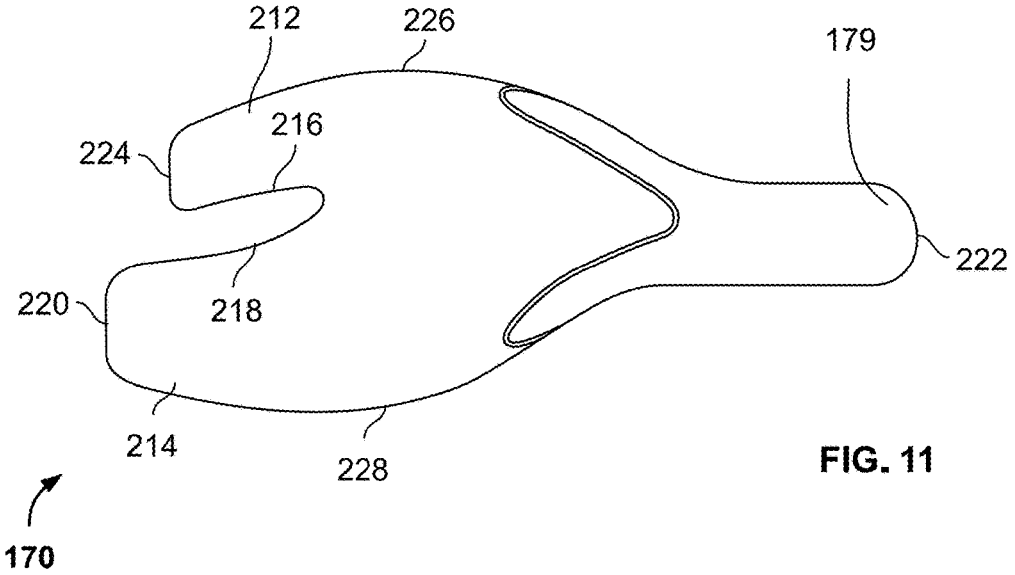
FIG. 11 is a bottom view of the plate of FIG. 8.
Figure 12:
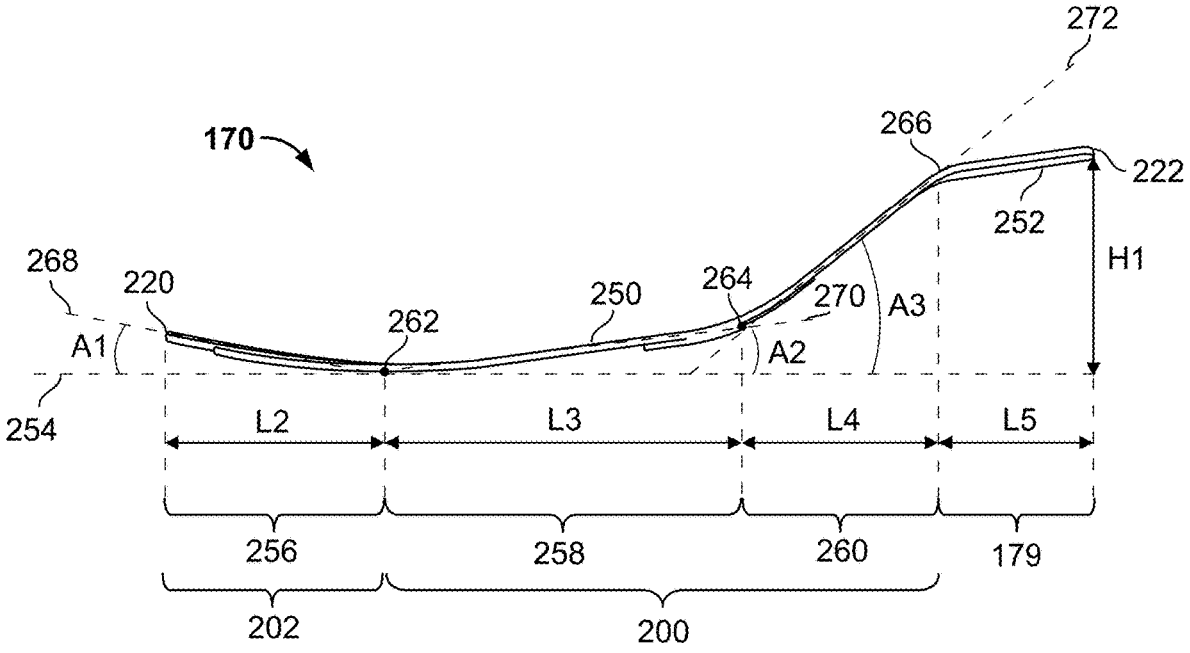
FIG. 12 is a lateral side view of the plate of FIG. 8.
Figure 13:
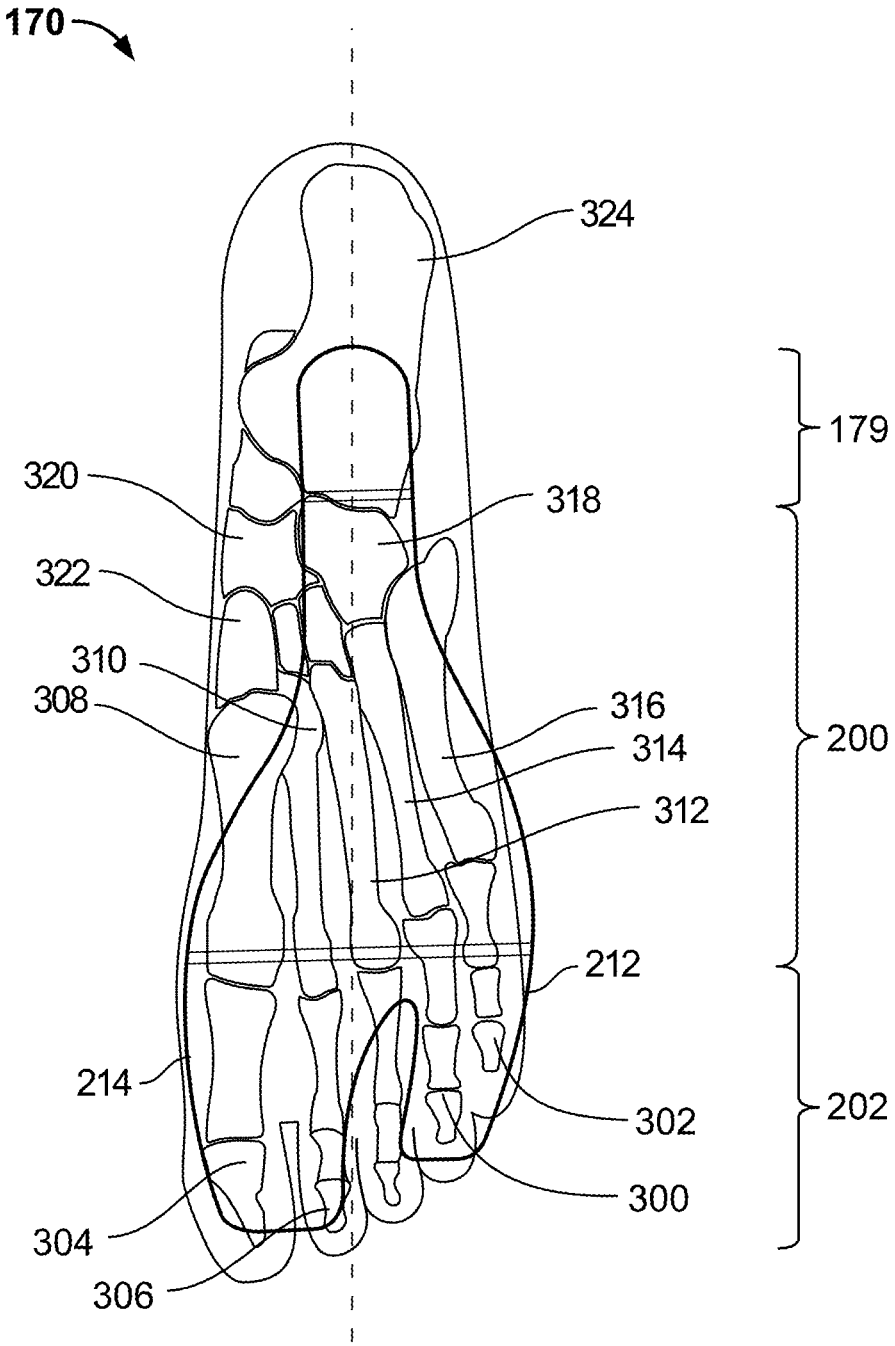
FIG. 13 is a top plan view of the plate of FIG. 8, with a user's skeletal foot structure overlaid thereon.

FIGS. 9-13 depict the footwear plate or plate 170 that may be incorporated in the article of footwear 100. FIG. 9 provides a top perspective view of the plate 170, FIG. 10 provides a top view of the plate 170, FIG. 11 provides a bottom view of the plate 170, FIG. 12 provides a side elevational view of the plate 170, and FIG. 13 provides another top view of the plate 170 with a skeletal structure of a left foot overlaid thereon.

The plate 170 may be defined by the rear segment 179, the arched segment 200, and the toe segment 202. With reference to FIGS. 10 and 18, the rear segment 179 may extend through at least the heel region 112 of the article of footwear 100 when incorporated therein and may correspond with portions of the plate 170 positioned near rear portions of a foot, including the heel or calcaneus bone, the ankle, or the Achilles tendon. The arched segment 200 of the plate 170 is proximate and adjoining the rear segment 179, and corresponds with portions of the plate 170 positioned near the midfoot region 110 of the article of footwear 100 that encase the arch of the foot, along with the bride of a foot. The toe segment 202 of the plate 170 is proximate and adjoining the arched segment 200, and corresponds with portions of the plate 170 positioned near the forefoot region 108 of the article of footwear 100, which encases portions of the foot that includes the toes, the ball of the foot, and joints connecting the metatarsals with the toes or phalanges (i.e., the metatarsophalangeal joints).

As shown in FIGS. 9-13, the toe segment 202 of the plate 170 may also include a split 210 that bifurcates the toe segment 202 into a first toe segment portion 212 on the lateral side of the plate 170 and a second toe segment portion 214 on the medial side of plate 170. In this embodiment, the split 210 may be defined by an interior wall 216 of the first toe segment portion 212 and an interior wall 218 of the second toe segment portion 214, and may be generally curved or parabolic. The first toe segment portion 212, as shown in FIG. 13, may support the fourth and fifth toes or phalanges and the second toe segment portion 214 may support the first and second toes or phalanges, as will be further discussed herein. In alternative embodiments, the sizes of the first toe segment portion 212, the second toe segment portion 214, and the split 210 may vary. As a result, the first toe segment portion 212 and/or the second toe segment portion 214 may individually support any one of the toes or phalanges, as will be later discussed herein.

As best shown in FIG. 10, the plate 170 may also be defined by a first end 220, which is a distal end of the second toe segment portion 214, and a second end 222, which is a distal end of the rear segment 179. In this embodiment, the plate 170 may also include a third end 224, which may be a distal end of the first toe segment portion 212. In these embodiments, a length L1 of the plate 170 may be defined by the distance between the first end 220 and the second end 222, and may be equal to or less than the length of the midsole cushioning member 176. The plate 170 may also include a lateral side 226 and a medial side 228 that extend between the first end 220 and the second end 222. The distance between the lateral side 226 and the medial side 228 may also define a width, e.g., a width W1, of the plate 170, which may vary between the first end 220 and the second end 222 of the plate 170.

Still referring to FIG. 10, the medial side 228 begins at the first end 220 and bows outward along the toe segment 202 toward the arched segment 200. Proximate to the arched segment 200, the medial side 228 bows inward towards the rear segment 179, at which point the medial side 228 extends linearly toward the second end 222. The lateral side 226 begins at the third end 224 and bows outward along the toe segment 202 toward the arched segment 200. Proximate to the arched segment 200, the lateral side 226 bows inward towards the rear segment 179, at which point the lateral side 226 extends linearly toward the second end 222.

With reference to FIG. 12, the plate 170 may also be defined by a curved portion 250 that extends through the forefoot region 108 and the midfoot region 110 of the article of footwear 100, and a flat region 252 that extends through the heel region 112 of the article of footwear 100 to the second end 222. The flat region 252 is substantially flat, such that the flat portion 252 is approximately within ten degrees or five degrees horizontal to a ground surface, or reference plane 254 (see FIG. 12), when the plate 170 is positioned within the article of footwear 100. The flat region 252 may also be at a height H1 relative to the reference plane 254. In some embodiments, the height H1 may range between about 1 millimeter and about 50 millimeters. In other embodiments, the height H1 may range between about 5 millimeters and about 35 millimeters, or between about 10 millimeters and about 20 millimeters.

With continued reference to FIG. 12, the curved portion 250 may include one or more radii of curvature. For example, in this embodiment, the curved portion 250 includes an anterior curved portion 256, a medial curved portion 258, and a posterior curved portion 260 each with a radius of curvature. The anterior curved portion 256 may extend between the first end 220 and a vertex 262, which in this embodiment is the position along the plate 170 where the plate 170 is tangent to the reference plane 254. The medial curved portion 258 may be adjacent to the anterior curved portion 256 and may extend between the vertex 262 and a transition point 264 defined as a location along the plate at which point the angle of the plate 170 relative to the reference plane 254 changes. For example, in this embodiment, the angle of the curved portion 250 relative to the reference plane 254 increases at the transition point 264. The posterior curved portion 260 is adjacent to the medial curved portion 258 and extends from the transition point 264 to the flat region 252 of the plate 170.

Still referencing FIG. 12, the anterior curved portion 256, the medial curved portion 258, and the posterior curved portion 260 may each be defined by a length L2, L3, L4 and an angle A1, A2, A3, respectively. The length L2 is measured along the reference plane 254 between the vertex 262 and the front end 220 of the plate 170, the length L3 is measured along the reference plane 254 between the vertex 262 and the transition point 264, and the length L4 is measured along the reference plane 254 between the transition point 264 and a front end 266 of the rear segment 179 of the plate 170. As further shown in FIG. 12, the rear segment 179 or flat portion 252 may have a length L5, which is measured from the front end 266 thereof to the second end 222. In some embodiments, the length L2 may be approximately 10 percent (10%), 20%, 30%, or 40% of the total length L1 of the plate 170; the length L3 may be approximately 10%, 20%, 30%, 40%, 50%, or 60% of the total length L1 of the plate 170; the length L4 may be approximately 10%, 20%, 30%, 40%, 50%, or 60% of the total length L1 of the plate 170; and the length L5 of the flat portion 252 may be approximately 10%, 20%, 30%, or 40% of the total length L1 of the plate 170. In alternative embodiments, the curved portion 250 may not include the transition point 264 such that the plate 170 only includes the anterior portion 256 extending from the vertex 262 to the front end 220 of the plate 170 and a posterior portion (not shown) extending from the vertex 262 to the front end 266 of the rear segment 179. In such embodiments, the length of the posterior portion may be approximately equal to the summation of the length L3 and the length L4.

As previously discussed above, the anterior curved portion 256, the medial curved portion 258, and the posterior curved portion 260 of the plate 170 may also be defined by the angles A1, A2, A3, respectively. The angle A1 of the anterior curved portion 256 may be defined as the angle at which the anterior portion 256 extends from the vertex 262 towards the front end 220. Or put differently, the angle A1 may be defined as the angle between the reference plane 254 and a linear plane 268 extending between the vertex 262 and the front end 220. The angle A1 may be a value between about 3-degrees and about 45-degrees, or between about 5-degrees and about 20-degrees, or between about 10-degrees and about 20-degrees.

Similarly, the angle A2 of the medial curved portion 258 may be defined as the angle at which the medial curved portion 258 extends from the vertex 262 and toward the rear segment 179 of the plate 170. Or put differently, the angle A2 may be defined as the angle between the reference plane 254 and a second linear plane 270 extending between the vertex 262 and the transition point 264. The angle A2 may be a value between about 3-degrees and about 45-degrees, or between about 5-degrees and about 20-degrees, or between about 10-degrees and about 20-degrees. In some embodiments, the angle A2 of the medial curved portion 258 and the angle A1 of the anterior curved portion 268 are substantially equal to one another.

The angle A3 of the posterior curved portion 260 may be defined as the angle at which the posterior curved portion 260 extends toward the rear segment 179 and may be defined as the angle between the reference plane 254 and a third linear plane 272 extending between the transition point 264 and a front end 266 of the rear segment 179 of the plate 170. The angle A3 may be a value between about 5-degrees and about 70-degrees, or between about 20-degrees and about 50-degrees, or between about 30-degrees and about 50-degrees. In some embodiments, the angle A3 of the posterior curved portion 260 is greater than the angles A1, A2 of the medial curved portion 258 and the anterior curved portion 256.

The plate 170 may be formed from a thermoplastic material, such as a thermoplastic polyurethane, a thermoplastic elastomer, a thermoplastic olefin, or the like. In particular embodiments, however, the plate 170 may be formed from a composite or one or more layers of fibers, such as carbon fibers, aramid fibers, boron fibers, glass fibers, natural fibers, and polymer fibers, or a combination thereof. In these embodiments, the fibers may be affixed or bonded to a substrate or a thermoplastic material, e.g., a thermoplastic polyurethane, a thermoplastic polyolefin, or a thermoplastic elastomer, by stitching or an adhesive. In other embodiments, the plate 170 may be formed from a unidirectional tape that includes carbon fibers, aramid fibers, boron fibers, glass fibers, polymer fibers, or the like. In other embodiments, the plate 170 may be formed from densified wood or densified wood panels formed from chemically treating natural wood to remove lignin or hemicellulose therefrom, or compressing natural wood.

In some embodiments, the one or more materials of the plate 170 may have a stiffness (e.g., a tensile strength) defined by a Young's modulus. For example, in particular embodiments, the one or more materials forming the plate 170 may have a Young's modulus of at least about 25 gigapascals (GPa), at least about 40 GPa, or at least about 70 GPa, or at least about 85 GPa, or at least about 200 GPa. In further embodiments, the one or more materials forming the plate 170 may have a Young's modulus between about 25 GPa and about 200 GPa, or between about 25 GPa and about 80 GPa, or between about 25 GPa and about 70 GPa, or between about 50 GPa and about 75 GPa. In some embodiments, the plate 170, and the stiffness thereof, may be selected and designed for a particular user. For example, a stiffness of the plate 170 may be selected based on the particular muscle strength, tendon flexibility, or joint flexibility of a user. In further embodiments, the stiffness of the plate 170 may vary, such that a portion of the plate 170 is stiffer compared to another portion of the plate 170. For example, in the instance the user pronates, the second toe segment portion 214 of the plate 170 on a medial side thereof may be stiffer than the first toe segment portion 212, the arched portion 200 (or, individually, the medial curved portion 258 and/or the posterior curved portion 260), and the rear segment 179 of the plate 170. In other embodiments, where additional support is desired in the arch or midfoot region 110 of the article of footwear 100, the arched segment 200 (or, individually, the medial curved portion 258 and/or the posterior curved portion 260) of the plate 170 may be stiffer than the toe segment 202 and the rear segment 179 of the plate 170. In essence, it is envisioned that the first toe segment portion 212, the second toe segment portion 214, the arched segment 200 (or, individually, the medial curved portion 258 and/or the posterior curved portion 260), and the rear segment 179 may each have an individual stiffness within the aforementioned ranges and an individual stiffness that is greater than or less than the stiffness of the other segments of the plate 170. In alternative embodiments, the stiffness of the plate 170 may be uniform and constant between the first toe segment portion 212, the second toe segment portion 214, the arched segment 200, and the rear segment 179.

The plate 170 may also include a uniform thickness or substantially uniform thickness between about 0.5 millimeters (mm) and about 3.0 mm, or between about 0.5 mm and about 2.0 mm, or between about 0.7 mm and about 1.0 mm. In other embodiments, the plate 170 may have a non-uniform thickness or a thickness that varies across the plate 170. For example, similar to a stiffness of the plate 170, a thickness of the first toe segment portion 212 may be a different thickness than a thickness of the second toe segment portion 214, the arched segment 200 (or, individually, the medial curved portion 258 and/or the posterior curved portion 260), and/or the rear segment 179; the second toe segment portion 214 may be a different thickness than a thickness of the first toe segment portion 214, the arched segment 200, and/or the rear segment 179; the arched segment 200 may be a different thickness than a thickness of the first toe segment portion 212, the second toe segment portion 214, and/or the rear segment 179; or the rear segment 179 may have a thickness different than a thickness of the first toe segment portion 212, the second toe segment portion 214, and/or the arched segment 200. In essence, the thickness of the first toe segment portion 212, the second toe segment portion 214, the arched segment 200, or the rear segment 179 may be individually selected when the plate 170 is formed. In particular embodiments, the thickness of the plate 170, and the regions thereof, may be selected for the particular user and their particular muscle strength, tendon flexibility, or joint flexibility. In these embodiments, the thickness of the plate 170, and the individual thicknesses of the segments 179, 200, 212, 214 thereof, may range between about 0.5 mm and about 3.0 mm, or between about 0.5 mm and about 2.0 mm, or between about 0.7 mm and about 1.0 mm.

With particular reference to FIG. 13, the first toe segment portion 212 may be positioned proximate to and support a fourth distal phalanx and/or a fourth proximal phalanx 300, and a fifth distal phalanx and/or fifth proximal phalanx 302. As such, the properties of the first toe segment portion 212 may be tuned to provide optimal or a desired amount of support, elasticity, or spring force to those particular areas of a user's foot. Further, the second toe segment portion 214 may be positioned proximate to and support a first distal phalanx and/or a first proximal phalanx 304, and a second distal phalanx and/or a second proximal phalanx 306. As such, the properties of the first toe segment portion 212 may be tuned to provide optimal or a desired amount of support, elasticity, or spring force to those particular areas of a user's foot. The arch segment 200 may be positioned proximate to and support a first metatarsal 308, a second metatarsal 310, a third metatarsal 312, a fourth metatarsal 314, and/or a fifth metatarsal 316, as well as the cuboid 318, a navicular 320, and/or cuneiforms 322, such as the lateral cuneiform, middle or intermediate cuneiform, and/or medial cuneiform, of a user's foot. As such, the properties of the arch segment 200 may be tuned to provide optimal or a desired amount of support, elasticity, or spring force to those particular areas of a user's foot. Last, the rear segment 179 may be proximate to and support the heel or calcaneus 324 of a user's foot and, as such, the properties of the rear segment 179 may be tuned to provide optimal or a desired amount of support, elasticity, or spring force to those particular areas of a user's foot. For example, if a runner has a forefoot strike, i.e., the runner places the weight of their impact on the toes and ball of the foot (e.g., the distal phalanges and/or proximal phalanges 300-306), the majority of a user's weight and force may be applied to the first toe segment portion 212 and the second toe segment portion 214 of the plate 170 when running. As such, the first toe segment portion 212 and the second toe segment portion 214 may be designed to provide the necessary rigidity to support a user's foot when running and thereby reduce energy dissipation. Further, in this embodiment, the arched segment 200 and the rear segment 179 of the plate 170 may be constructed from a lightweight material because minimal weight or force is applied to these regions and, as such, less support is needed for these particular regions for a runner with a forefoot strike. Alternatively, if a runner has a heel strike or a midfoot strike, the first toe segment portion 212, the second toe segment portion 214, the arched segment 200, and the rear segment 179 may be constructed from a rigid material to provide support to a user's foot throughout their stride and during contact with the ground.

In other embodiments, as will be further discussed herein, the size and shape of the plate 170 may be altered to provide the desired support and structure to the foot of a wearer. For example, in this particular embodiment, the first toe segment portion 212 may have a width W2 (see FIG. 10). The width W2 may be defined as the distance between the lateral side 226 of the plate 170 and the interior walls 216, 218 of the split 210 on the third distal end 224 of the plate 170. Further, the second toe segment portion 214 may have width W3 defined as the distance between the medial side 228 of the plate 170 and the interior wall 218 of the split 210. In addition, the split 210 may have a width W4 that is defined as the distance between the first toe segment portion 212 and the second toe segment portion 214. In some embodiments, the width W4 of the split 210 may be increased and the respective widths of the first toe segment portion 212 and the second toe segment portion 214 may be decreased, as will be further discussed herein (see FIGS. 19 and 20, for example).

In some embodiments, the widths W2, W3 individually may be between about 2.5 millimeters (mm) and about 100 mm, or between about 5 mm and about 50 mm, or between about 10 mm and about 30 mm, or between about 15 mm and about 30 mm, or between about 20 mm and about 30 mm, or about 25 mm. Further, the width W4 of the split 210 may be between about 2.5 mm and about 100 mm, or between about 5 mm and about 50 mm, or between about 10 mm and about 30 mm, or between about 15 mm and about 30, or between about 20 mm and about 30 mm, or between about 30 mm and about 70 mm, or between about 30 mm and about 50 mm, or between about 35 mm and about 45 mm.

Figure 19:
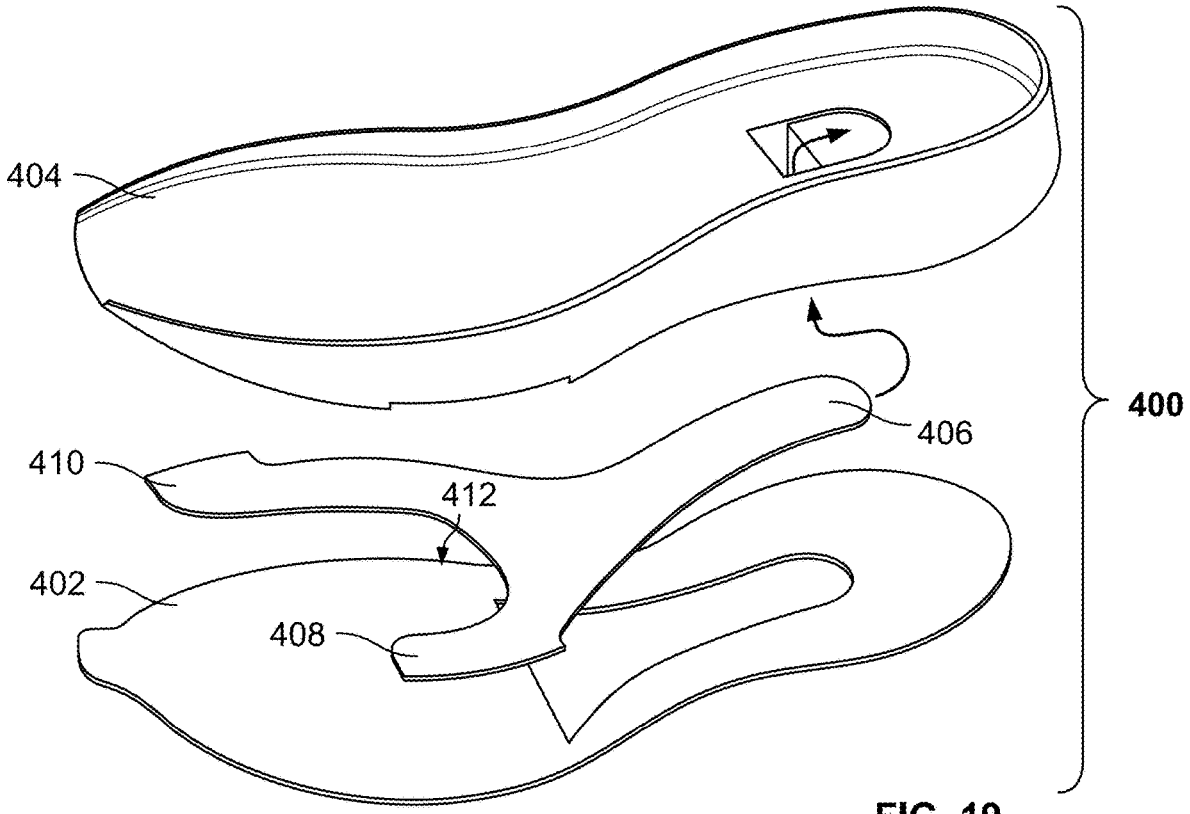
FIG. 19 is an exploded, top perspective view of another sole structure, according to a second embodiment of the present disclosure.
Figure 20:
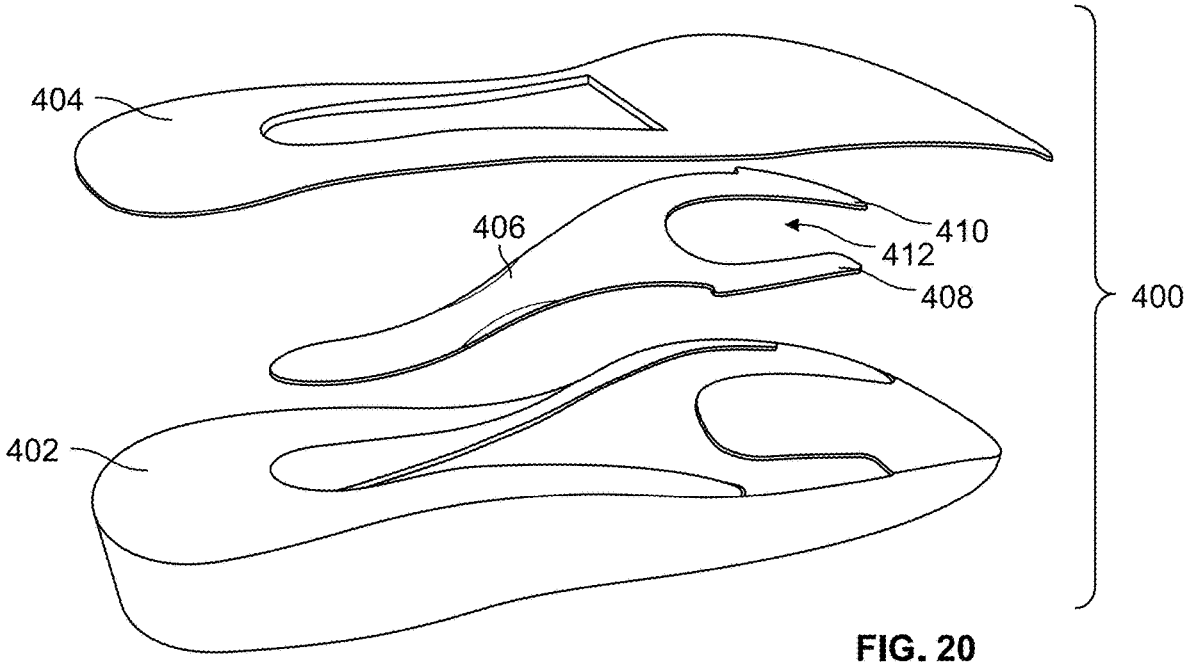
FIG. 20 is an exploded, bottom perspective view of the sole structure of FIG. 19.

FIGS. 19 and 20 provide a sole structure 400, according to a second embodiment of the present disclosure. In this embodiment, the sole structure 400 includes an outsole 402, a midsole cushioning member 404, and a plate 406. Further, although FIGS. 19 and 20 only depict a sole structure 400, it should be appreciated by those skilled in the art that the sole structure 400 may be connected to an upper, such as the upper 102, to form an article of footwear. Therefore, aspects of the upper 102 in combination with the sole structure 400 is anticipated and the upper 102 may be attached to the sole structure 400 and together with the sole structure 400 may define an interior cavity into which a foot may be inserted.

The configuration of the sole structure 400 is substantially similar to the sole structure 104 with the exception that the sole structure 400 does not include a heel cushioning member 172 and the heel support collar 174, but rather an outsole 402, a midsole cushioning member 404, and a plate 406 having a first toe segment portion 408 and a second toe segment portion 410.

As previously discussed herein, the width W2 of the first toe segment portion 212, the width W3 of the second toe segment portion 214, and the width W4 of the split 210 may vary and be dependent on the desired support needed for the sole structure 104. For example, if relatively minor support is needed on the lateral side 124 of the sole structure 104 and relatively minor support is needed on the medial side 126 of the sole structure 104, a width W2 of the first toe segment portion 212 and a width W3 of the second toe segment portion 214 may be decreased, while the width W4 of the split 210 may increase. For example, with particular reference to FIGS. 10 and 20, a width of the first toe segment portion 408 is smaller than the width W2 of the first toe segment portion 212, a width of the second toe segment portion 410 is smaller than the width W3 of the second toe segment portion 410, and a width of a split 412 is larger than the width W4 of the split 210.

Figure 21:
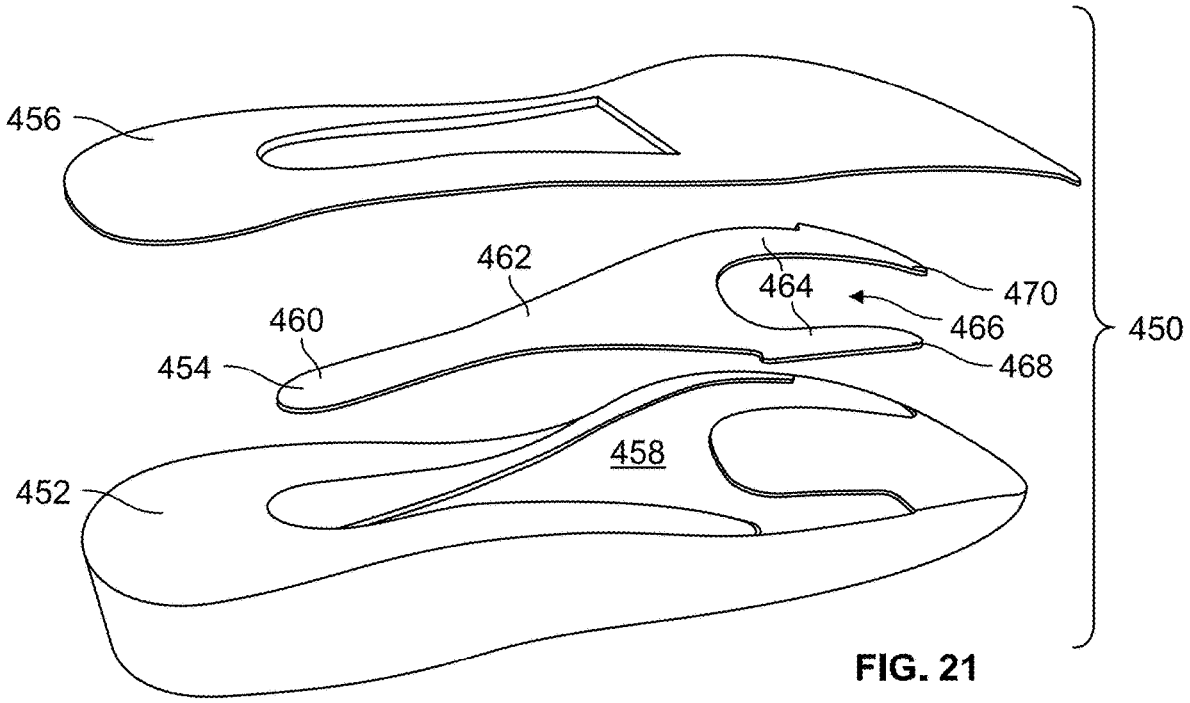
FIG. 21 is an exploded, bottom perspective view of yet another sole structure, according to a third embodiment of the present disclosure.

FIG. 21 provides a sole structure 450 that includes a midsole cushioning member 452, a plate 454, and an outsole 456, according to a third embodiment of the present disclosure. Although FIG. 21 only depicts the sole structure 450, it should be appreciated that the sole structure 450 may be connected to an upper, such as the upper 102, to form an article of footwear. Therefore, aspects of the upper 102 in combination with the sole structure 450 is anticipated and the upper 102 may be attached to the sole structure 450 and together with the sole structure 450 may define an interior cavity into which a foot of a user may be inserted.

In this embodiment, the midsole cushioning member 452 may be adjacent to and on top of the outsole 456 in the forefoot region, the midsole region, and the heel region. The midsole cushioning member 452 may also include a recessed portion 458 that communicates with the plate 454. In other words, the recessed portion 458 of the midsole cushioning member 452 may embed, encapsulate, or surround at least a portion of the plate 170. As such, the recessed portion 458 of the midsole cushioning member 452 may also define the shape and size of the plate 170.

As previously discussed, the sole structure 450 may also include the plate 454 positioned therein. In particular embodiments, the plate 454 may be adjacent to and positioned between the outsole 456 and the midsole cushioning member 452 in the forefoot region of the article of footwear, such that the plate 454 is vertically below the midsole cushioning member 452 in the forefoot region and/or vertically below the midsole cushioning member 452 in the midfoot region of the article of footwear. Put differently, the plate 454 may be positioned between the midsole cushioning member 452 and the outsole 456 in the forefoot region and/or the midfoot region. Further, in this particular embodiment, a depth of the recessed portion 458 in the forefoot region is smaller than a depth of the recessed portion 458 in the heel region of the sole structure 450. As a result, the plate 454 is positioned within, but extends from, the recessed portion 458 in the forefoot region of the sole structure 450 when assembled, such that the outsole 456 engages or contacts the plate 454 in the forefoot region. However, because a depth of the recessed portion 458 is greater than a thickness of the plate 454 in the heel region, in this embodiment, the midsole cushioning member 452 completely surrounds the plate 454 and a gap (not shown) is present between the plate 454 and the outsole 456 when assembled.

In this embodiment, the plate 454 may also be defined by a rear segment 460, an arched segment 462, and a toe segment 464. The rear segment 460 may extend through at least a portion of the heel region of the sole structure 450 when incorporated therein and may correspond with portions of the plate 454 positioned near rear portions of the foot, including the heel or calcaneus bone, the ankle, or the Achilles tendon. The arched portion 462 of the plate 454 is proximate to and adjoins the rear segment 460, and corresponds with portions of the plate 454 positioned near the midfoot region of the article of footwear that encase the arch of the foot, along with the bridge of a foot. The toe segment 464 of the plate is proximate to and adjoins the arched segment 462, and corresponds with portions of the foot that includes the toes, the ball of the foot, and joints connecting the metatarsals with the toes or phalanges (i.e., the metatarsophalangeal joints).

The toe segment 464 of the plate 454 may also include a split 466 that bifurcates the toe segment 464 into a first toe segment portion 468 on the lateral side of the plate and a second toe segment portion 470 on the medial side of the plate 454.

Still referencing FIG. 21, the arched portion 462 may also be curved or bowed, such that when the plate 454 is positioned in the sole structure 450, the toe segment 464 has a relative position below the arched portion 462 and/or the rear segment 460 of the plate 454. Put differently, when assembled, the toe segment 464 of the plate 454 is closer to the outsole 456 compared to the rear segment 460 of the plate 454, and the rear segment 460 of the plate 454 is closer to the insole or the top surface (not shown) of the midsole cushioning member 452 compared to the toe segment 464 of the plate 454. In these embodiments, the arched portion 462 bows upwardly toward the rear segment 460, which is relatively flat. In particular embodiments, the rear segment 460 is substantially flat, such that the rear segment 460 is approximately within ten degrees or five degrees horizontal to a ground surface, or a reference plane, when the plate 454 is positioned within the sole structure 450. Unlike the sole structures 104, 400, however, the midsole cushioning member 452 does not include an aperture through which a portion of the plate 454 extends and, as such, no portion of the plate 454 is above the midsole cushioning member 452. Rather, the entire length of the plate 454 is below the midsole cushioning member 452 and positioned between the midsole cushioning member 452 and the outsole 456, in this embodiment.

As discussed above in connection with FIGS. 1-21, the toe segments, e.g., the toe segments 202, 464 of the plates 170, 406, 454 may be modified to alter the support for the sole structures 104, 400, 450 and, by extension, the support provided to the forefoot region of a user's foot. Similarly, in alternative embodiments, the rear segments, e.g., the rear segments 179, 460, of the plates 170, 406, 454 may be modified to alter or optimize the support provided to the heel region of the sole structures 104, 400, 450. In other words, the rear segments of the plates 170, 406, 454 may be modified to increase or decrease the support to the heel region of a user's foot. For example, FIG. 22 and FIG. 23 depict additional embodiments of a sole structure 500 (see FIG. 22) and a sole structure 600 (see FIG. 23), wherein a rear segment of a plate is modified to provide optimized support to the heel region of an article of footwear.

Figure 22:
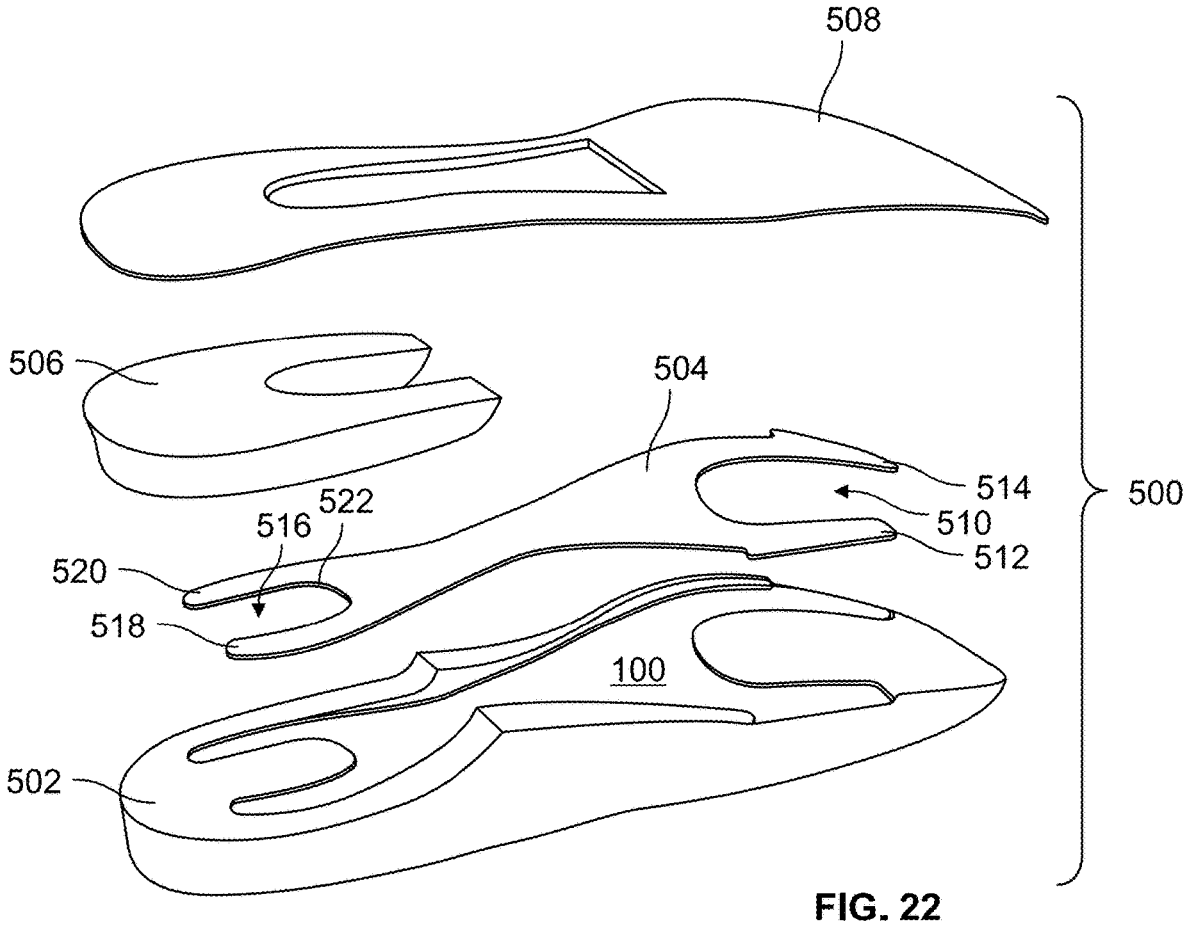
FIG. 22 is an exploded, bottom perspective view of still another sole structure, according to a fourth embodiment of the present disclosure.

With reference to FIG. 22, the sole structure 500 may include a midsole cushioning member 502, a plate 504, a heel cushioning member 506, and an outsole 508. With regard to FIG. 23, the sole structure 600 may include an upper midsole cushioning member 602, a plate 604, a lower midsole cushioning member 606, a heel support collar 608, and an outsole 609. In these embodiments, similar to the prior embodiments, although FIGS. 22 and 23 only depict the sole structures 500, 600 it should be appreciated that the sole structures 500, 600 may be connected to an upper, such as the upper 102, to form an article of footwear.

Figure 23:
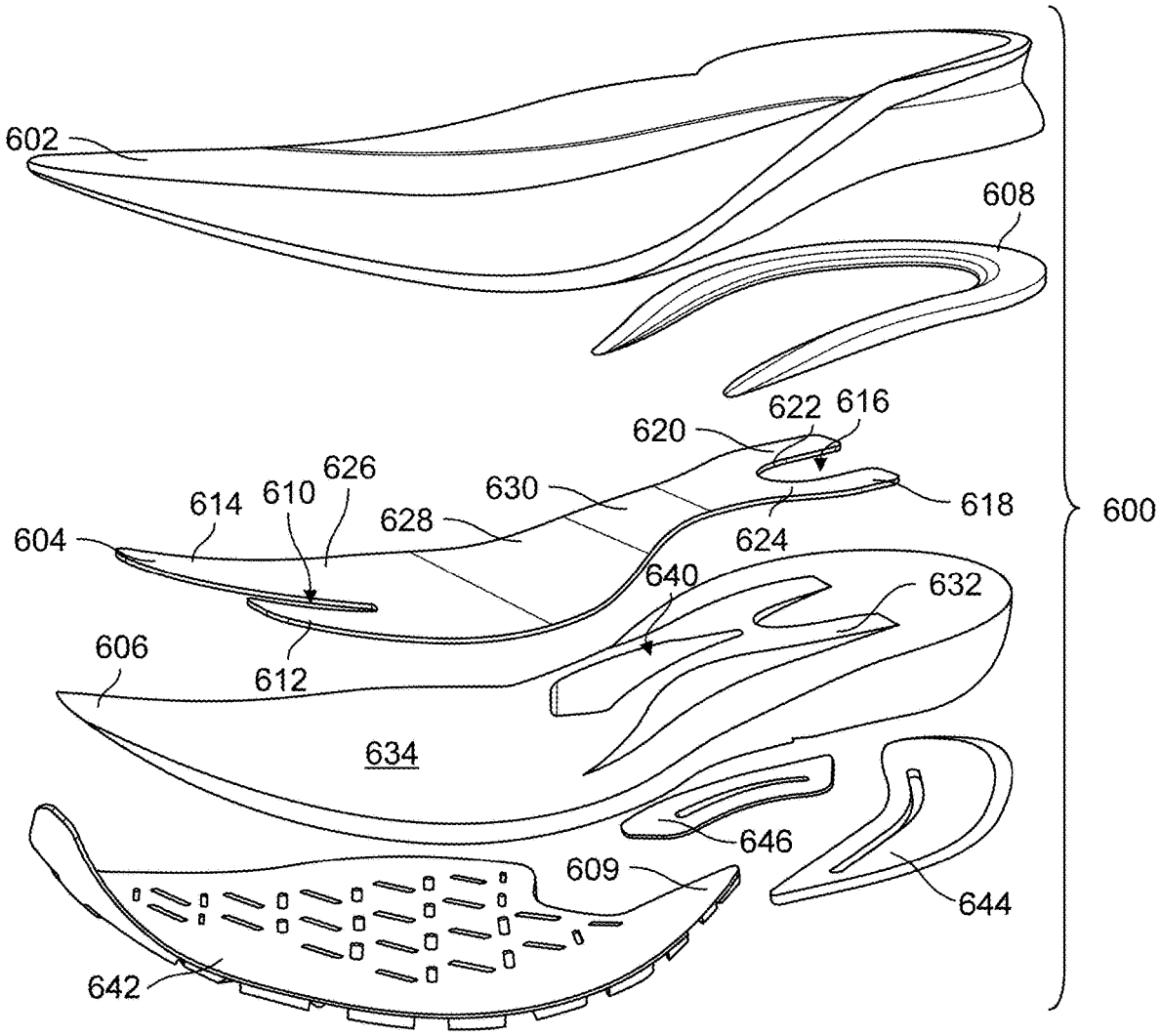
FIG. 23 is an exploded, top perspective view of another sole structure having an outsole, a lower midsole cushioning member, an upper midsole cushioning member, a heel support, and a plate, according to a fifth embodiment of the present disclosure.

With continued reference to FIGS. 22 and 23, the sole structures 500, 600 include plates 504, 604 having splits 510, 610 that bifurcate the toe segment into first toe segment portions 512, 612 on a lateral side of the plates 504, 604 and second toe segment portions 514, 614 on the medial side of the plates 504, 604, as well as a second split 516, 616 that bifurcates the rear segment into first rear segment portions 518, 618 on a lateral side of the plates 504, 604 and second rear segment portions 520, 620 on the medial side of the plates 504, 604. In these embodiments, the second split 516, 616 may be defined by an interior wall 522, 622, which may be generally curved or parabolic. In some embodiments, the sizes of the first rear segment portions 518, 618 and/or the second rear segment portions 520, 620 may support the heel region of the sole structures 500, 600.

Further, similar to the plate 170 of the sole structure 104, the plates 504, 604 may include a flat portion, and a curved portion having an anterior curved portion, a medial curved portion, and/or a posterior curved portion. For example, as shown in FIG. 23, the plate 604 may include a flat portion 624 and a curved portion having an anterior curved portion 626, a medial curved portion 628, and a posterior curved portion 630. The lower midsole cushioning member 606 may also include a supporting surface 632 that projects upwardly from a top surface 634 of the lower midsole cushioning member 606. In this embodiment, the supporting surface 632 contacts or engages the lower surfaces of the flat portion 624, the posterior curved portion 630 and the medial curved portion 628. As illustrated in FIG. 23, the lower midsole cushioning member 606 defines a cavity 640 therein. As illustrated in FIG. 23, the outsole 609 includes a first outsole portion 642 positioned within at least one of the forefoot region of the sole structure 600 and the midfoot region of the sole structure 600, a second outsole portion 644 positioned within the heel region of the sole structure 600, and a third outsole portion 646 positioned within the heel region of the sole structure 600. The first outsole portion 642, the second outsole portion 644, and the third outsole portion 646 are spaced apart from one another and positioned about the cavity 640.

Figure 24:
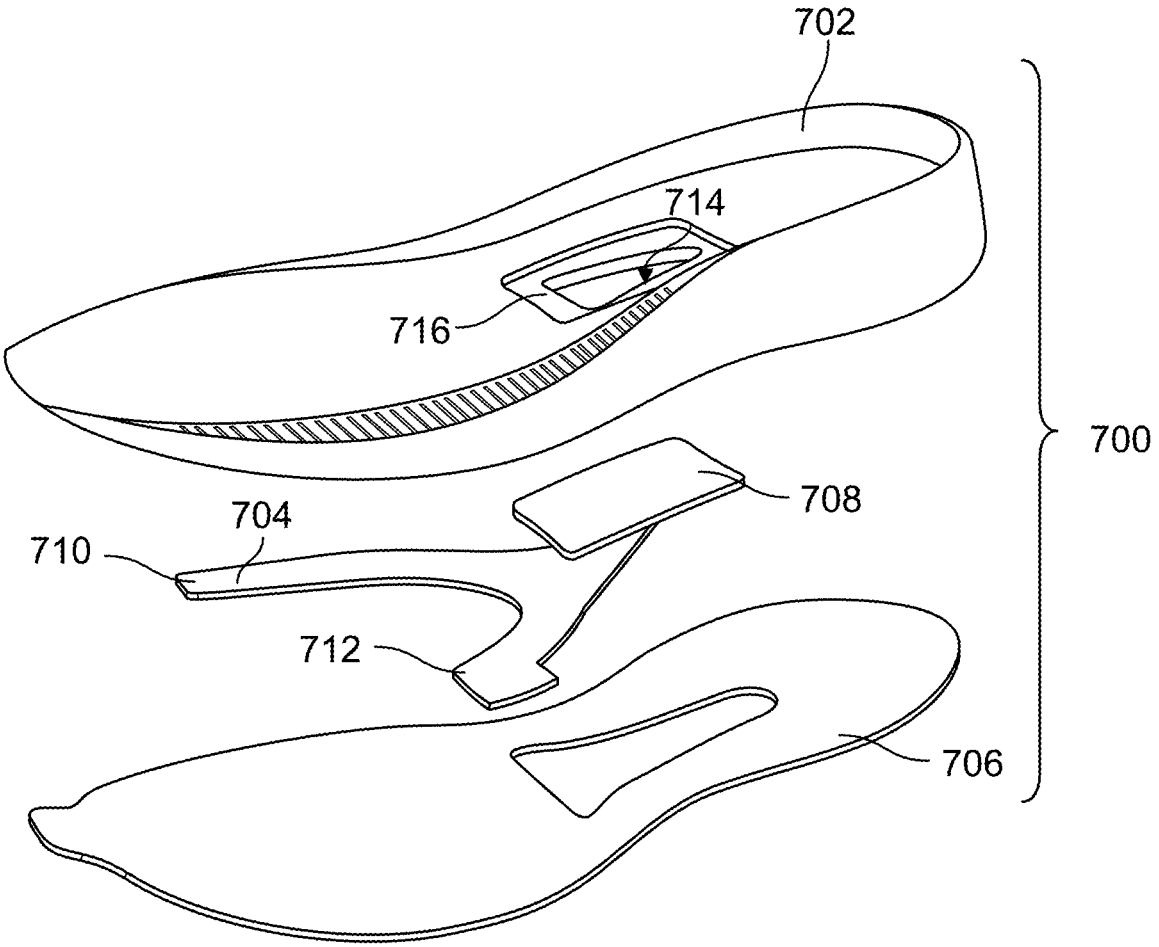
FIG. 24 is an exploded, top perspective view of yet another sole structure having an outsole, a midsole, and a plate, according to a sixth embodiment of the present disclosure.
Figure 25:
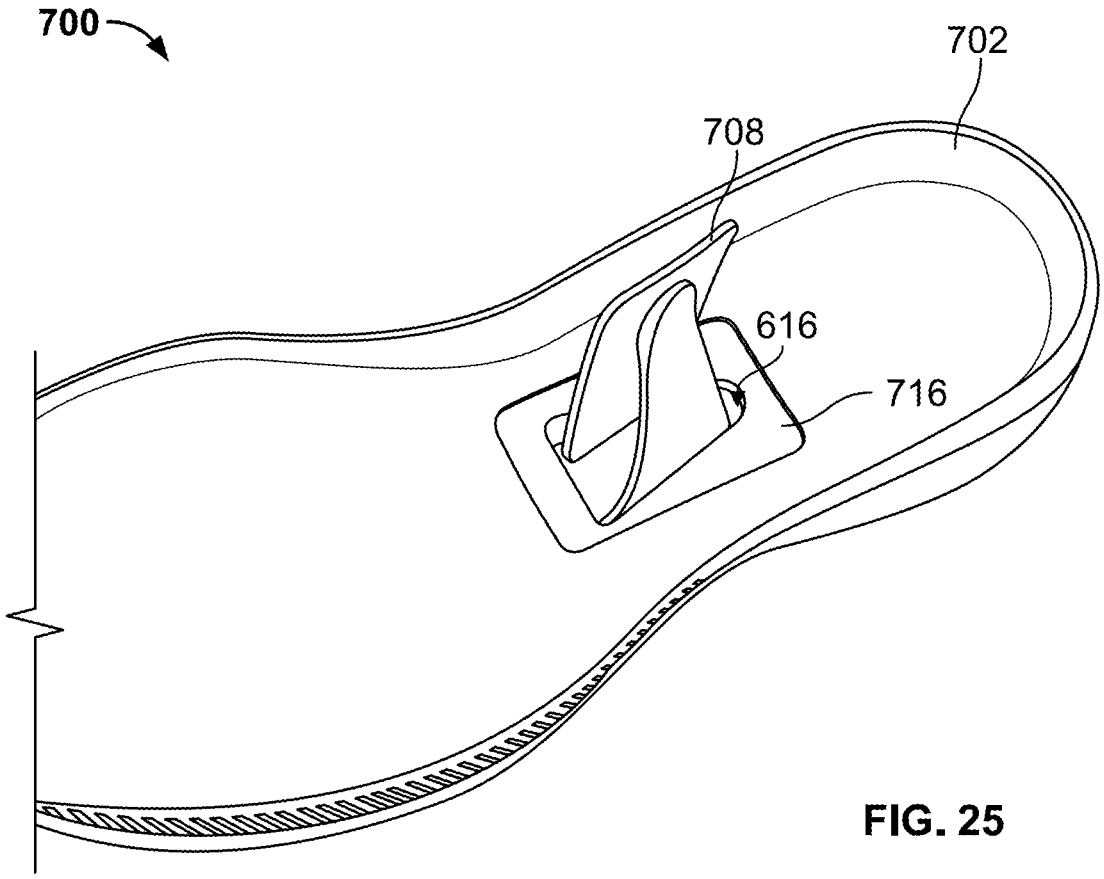
FIG. 25 is a partial view of the sole structure of FIG. 24, wherein the plate is in a first state relative to the midsole.
Figure 26:
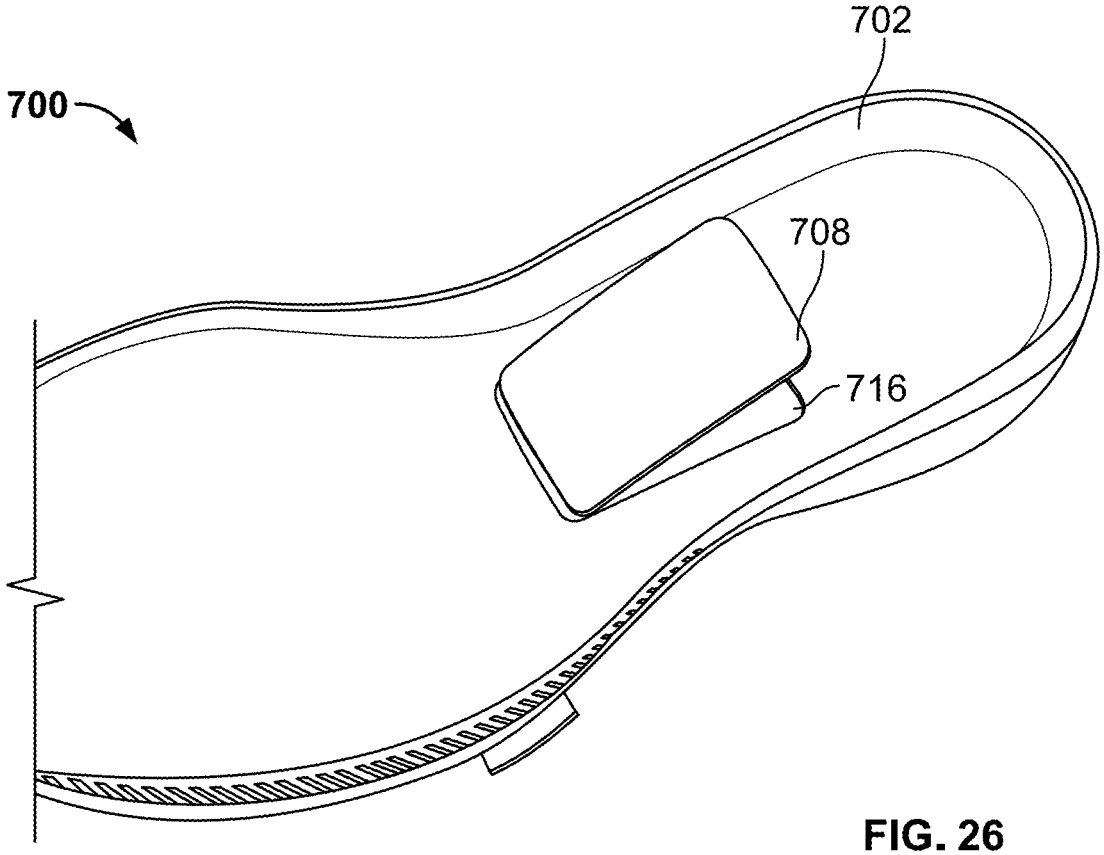
FIG. 26 is a partial view of the sole structure of FIG. 24, wherein the plate is in a second state relative to the midsole.

FIGS. 24-26 provide another sole structure 700 that includes a midsole cushioning member 702, a plate 704, and an outsole 706, according to another aspect of the present disclosure. In this particular embodiment, the plate 704 includes a base 708 and medial and lateral arms 710, 712. Further, the midsole cushioning member 702 may include an aperture 714 through which the base 708 may extend through. For example, as shown in FIGS. 25 and 26, the base 708 may be folded upon itself and inserted through the aperture 714. Once the base 708 is inserted through the aperture 714, the base 708 may be positioned within a recess 716.

Figure 27:
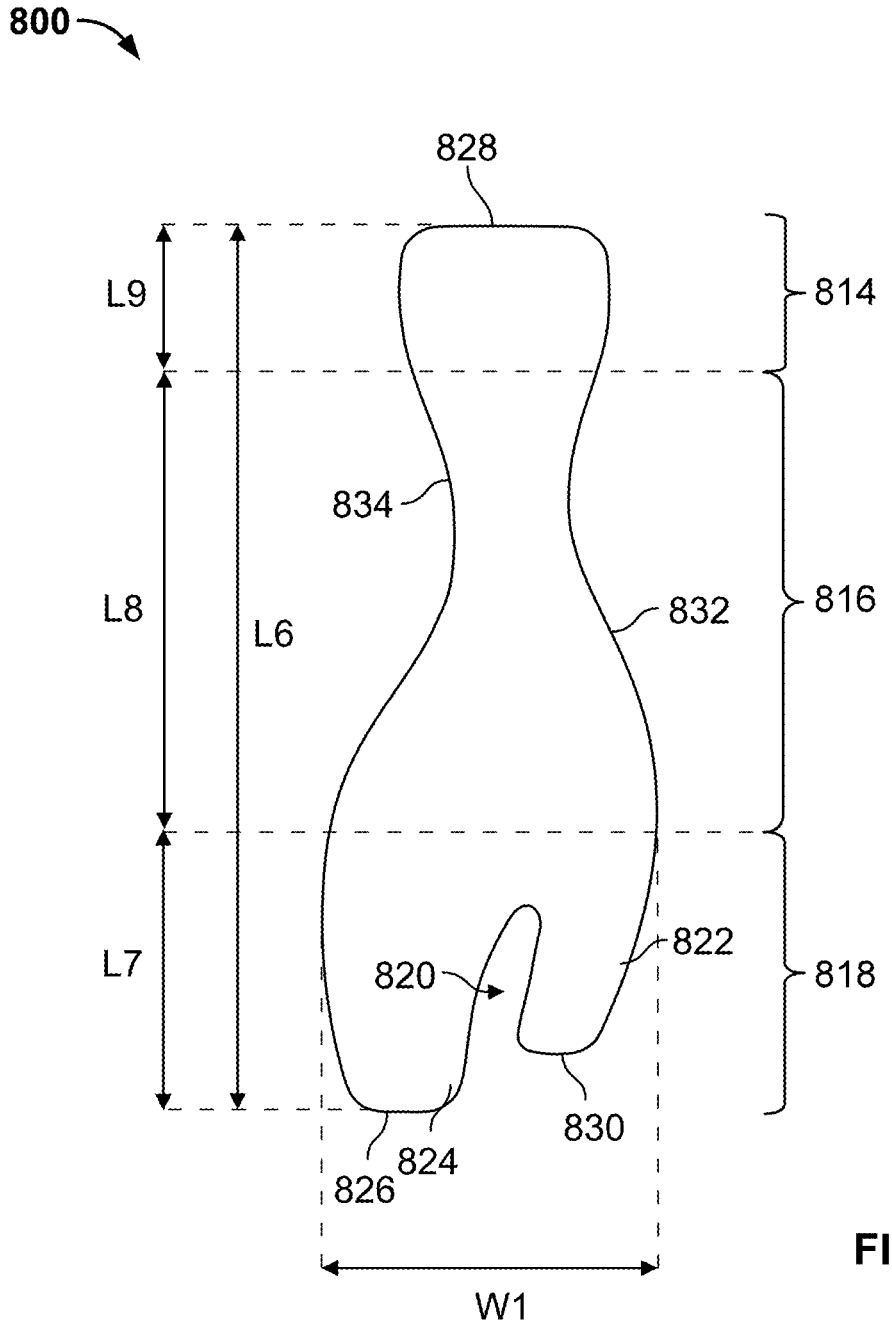
FIG. 27 is a top view of another embodiment of a plate for a sole structure.
Figure 28:
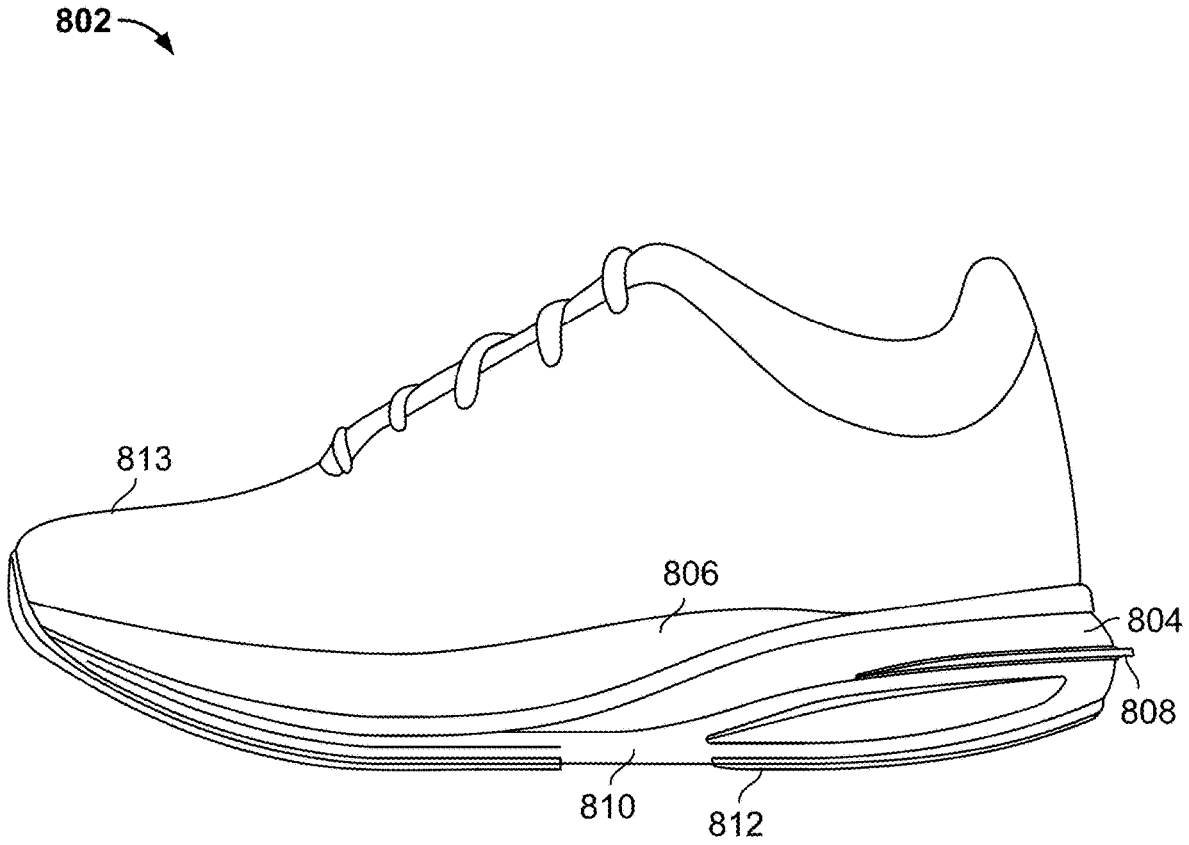
FIG. 28 is a lateral side view of an article of footwear having a sole structure with the plate of FIG. 27.
Figure 29:
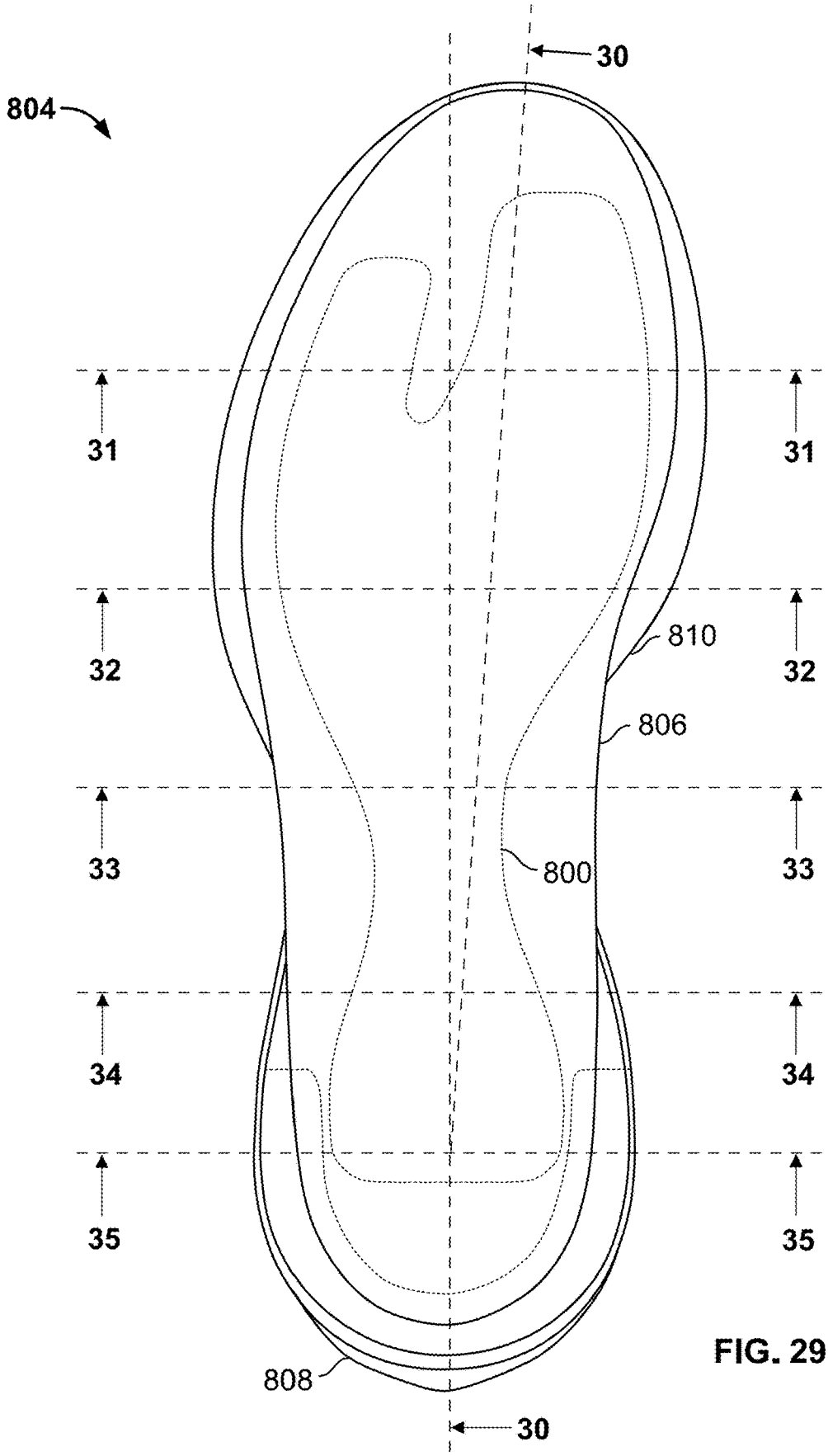
FIG. 29 is a top view of the sole of FIG. 28 with internal components thereof shown in broken lines.

FIG. 27 depicts a top view of a plate 800, according to another embodiment of the present disclosure, which may the characterized and defined in a similar manner to the plate 170 previously discussed herein. Further, FIGS. 28-35 depict an article of footwear 802, or a sole structure 804 thereof, that includes the plate 800. The article of footwear 802, or the sole structure 804 thereof, may also include an upper midsole cushioning member 806, a heel support collar 808, the plate 800, a lower midsole cushioning member 810, an outsole 812, and an upper 813 according to yet another aspect of the present disclosure. Similar to the embodiments previously discussed herein, the plate 800 may be defined by a rear segment 814 (see FIG. 30), an arch segment 816 (see FIG. 30), and a toe segment 818 (see FIG. 30). With continued reference to FIG. 30, the rear segment 814 may extend through at least the heel region of the article of footwear 802 when incorporated therein and may correspond with portions of the plate 800 positioned near rear portions of a foot, as previously discussed herein. The arched segment 816 of the plate 800 is proximate to and adjoins the rear segment 814, and corresponds with portions of the plate 800 positioned near the midfoot region of the article of footwear 802 that encase the arch of the foot, along with the bridge of the foot. The toe segment 818 of the plate 800 is proximate to and adjoins the arched segment 816, and corresponds with portions of the plate 800 positioned near the forefoot region of the article of footwear 802.

Similar to the plate 170, the toe segment 818 of the plate 800 may also include a split 820 that bifurcates the toe segment 818 into a first toe segment portion 822 on the lateral side of the plate 800 and a second toe segment portion 824 on the medial side of the plate 800. The first toe segment portion 822, the second toe segment portion 824, and the split 820 may have properties similar to the first toe segment portion 212, the second toe segment portion 214, and the split 210. For example, the first toe segment 822, the second toe segment 824, and the split 820 may have a width equal to the widths W2, W3, and W4, respectively, as previously discussed herein. As best shown in FIG. 27, the plate 800 may also be defined by a first end 826, which is a distal end of the second toe segment portion 824, a second end 828, which is a distal end of the rear segment 814, and a third end 830, which may be a distal end of the first toe segment portion 822. A length L6 of the plate 800 may be defined by the distance between the first end 826 and the second end 828, and may be equal to or less than the length of a midsole, such as the upper midsole cushioning body 806, of an article of footwear. The plate 800 may also include a lateral side 832 and a medial side 834 that extend between the first end 826 and the second end 828. The distance between the lateral side 832 and the medial side 834 may also define a width W5 of the plate 800, which may vary between the first end 826 and the second end 828 of the plate 800.

Still referring to FIG. 27, the medial side 834 begins at the first end 826 and bows outward along the toe segment 818 toward the arched segment 816. Proximate to the arched segment 816, the medial side 834 bows inward toward the rear segment 814, at which point the medial side 834 bows outwardly again. The lateral side 832 begins at the third end 830 and bows outward along the toe segment 818 toward the arched segment 816. Proximate to the arched segment 816, the lateral side 832 bows inward toward the rear segment 814, at which point the lateral side 832 bows outwardly again.

Figure 30:
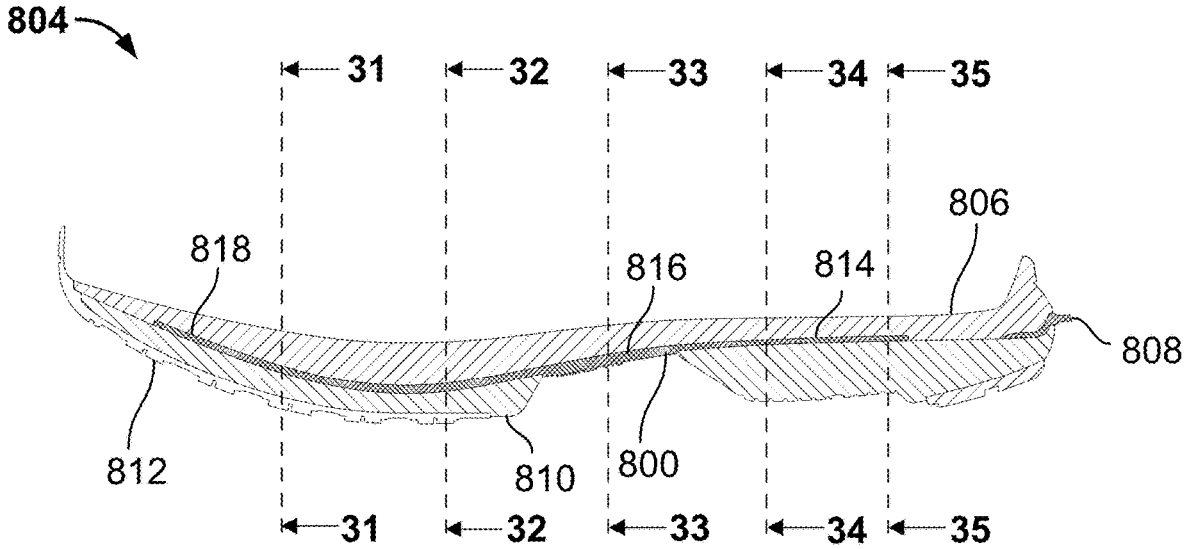
FIG. 30 is a cross-sectional view of the sole structure of FIG. 28 taken through line 30-30 of FIG. 29.
Figure 31:
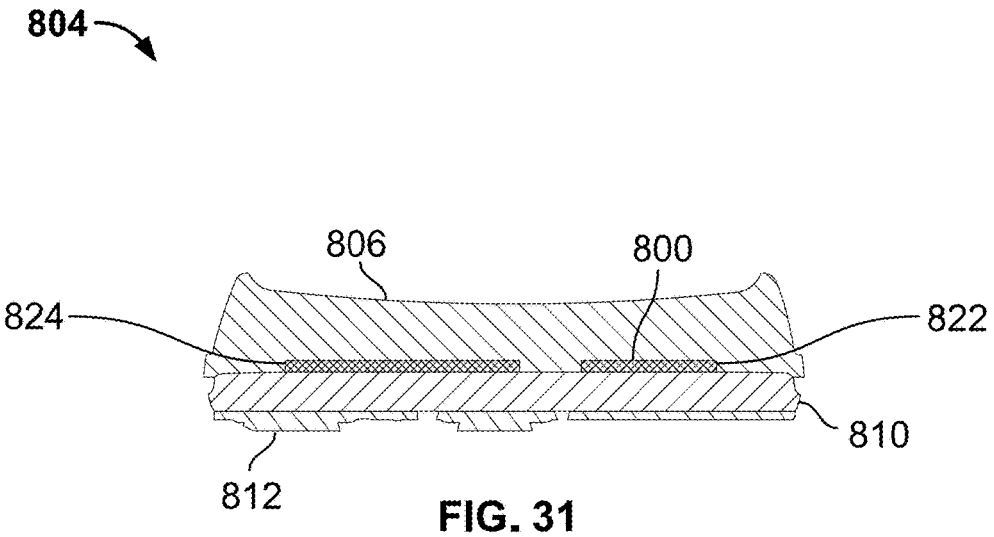
FIG. 31 is a cross-sectional view of the sole structure of FIG. 28 taken through line 31-31 of FIG. 29.
Figure 32:
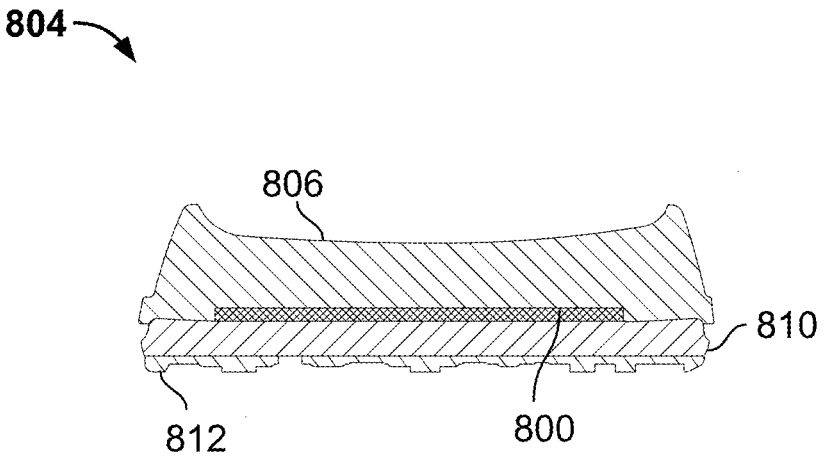
FIG. 32 is a cross-sectional view of the sole structure of FIG. 28 taken along line 32-32 of FIG. 29.
Figure 33:
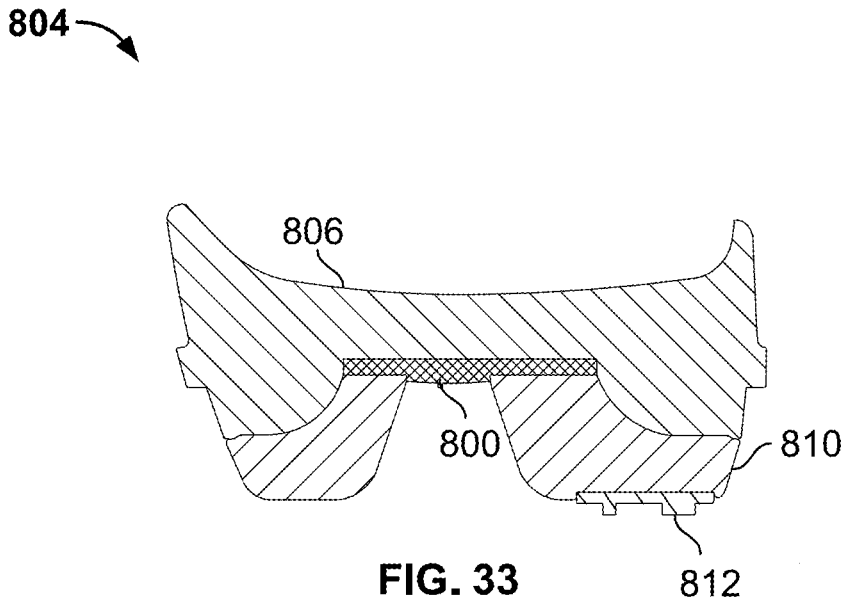
FIG. 33 is a cross-sectional view of the sole structure of FIG. 28 taken along line 33-33 of FIG. 29.
Figure 34:
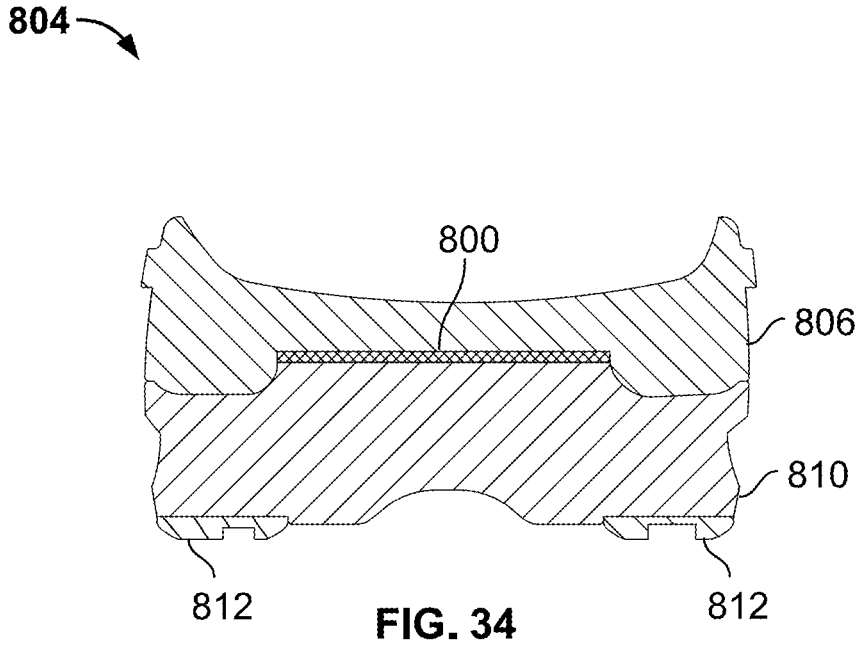
FIG. 34 is a cross sectional view of the sole structure of FIG. 28 taken along line 34-34 of FIG. 29.
Figure 35:
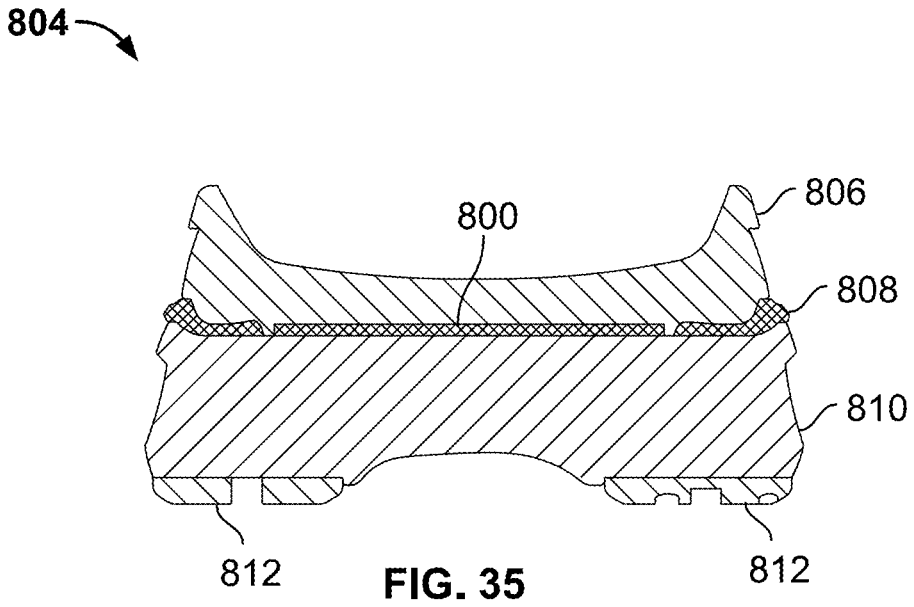
FIG. 35 is a cross-sectional view of the sole structure of FIG. 28 taken along line 35-35 of FIG. 29.

With reference to FIG. 30, the plate 800 may also include a curved portion 816 that extends through the forefoot region and the midfoot region of the article of footwear 802, and a flat region 814 that extends through the heel region of the article of footwear 802 to the second end 828. The flat region 814 is substantially flat, such that the flat region 814 is approximately within ten degrees or five degrees horizontal to a ground surface, when the plate 800 is positioned within the article of footwear 802.

Similar to the plate 170, the toe segment portion 818 and the curved portion 816 may include one or more radii of curvature. For example, in this embodiment, the curved portion 816 may be angled similar to the posterior curved portion 256 and the toe segment portion 818 may be angled similar to the medial curved portion 256 and/or the posterior curved portion 260. The toe segment portion 818 and the curved portion 816 may each be defined by a length, such as a length L7 or L8, respectively, and an angle, such as the angles A1, A2, and/or A3, as previously discussed herein. The rear segment 814 may also be defined by a length L9, similar to the length L5.

As previously discussed herein, the plate 800, or the plates 170, 406, 454, 504, 604, 704, may be formed from a thermoplastic material, such as a thermoplastic polyurethane, a thermoplastic elastomer, a thermoplastic olefin, or the like. In particular embodiments, however, the plate 800, or the plates 170, 406, 454, 504, 604, 704, may be formed from a composite or one or more layers of fibers, such as carbon fibers, aramid fibers, boron fibers, glass fibers, and polymer fibers, or a combination thereof. In these embodiments, the fibers may be affixed or bonded to a substrate or a thermoplastic material, e.g., a thermoplastic polyurethane, a thermoplastic polyolefin, or a thermoplastic elastomer, by stitching or an adhesive. In other embodiments, the plate 800, or the plates 170, 406, 454, 504, 604, 704, may be formed from a unidirectional tape that includes carbon fibers, aramid fibers, boron fibers, glass fibers, polymer fibers, or the like.

In some embodiments, the one or more materials of the plate 800, or the plates 170, 406, 454, 504, 604, 704, may have a stiffness (e.g., a tensile strength) defined by a Young's modulus. For example, in particular embodiments, the one or more materials forming the plate 800, or the plates 170, 406, 454, 504, 604, 704, may have a Young's modulus of at least about 25 gigapascals (GPa), at least about 40 GPa, or at least about 70 GPa, or at least about 85 GPa, or at least about 200 GPa. In further embodiments, the one or more materials forming the plate 800 may have a Young's modulus between about 25 GPa and about 200 GPa, or between about 25 GPa and about 80 GPa, or between about 25 GPa and about 70 GPa, or between about 50 GPa and about 75 GPa. In some embodiments, the plate 800, or the plates 170, 406, 454, 504, 604, 704, and the stiffness thereof, may be selected and designed for a particular user. For example, a stiffness of the plate 800, or the plates 170, 406, 454, 504, 604, 704, may be selected based on the particular muscle strength, tendon flexibility, or joint flexibility of a user. In further embodiments, the stiffness of the plate 800, or the plates 170, 406, 454, 504, 604, 704, may vary, such that a portion of the plate 800, or the plates 170, 406, 454, 504, 604, 704, is stiffer compared to another portion thereof, as previously discussed herein.

The plate 800, or the plates 170, 406, 454, 504, 604, 704, may also include a uniform thickness or substantially uniform thickness between about 0.5 millimeters (mm) and about 3.0 mm, or between about 0.5 mm and about 2.0 mm, or between about 0.7 mm and about 1.0 mm. In other embodiments, the plate 800, or the plates 170, 406, 454, 504, 604, 704, may have a non-uniform thickness or a thickness that varies across the plate 800, or across the plates 170, 406, 454, 504, 604, 704, as previously discussed herein.

Looking to FIGS. 30-35, the plate 800 may be adjacent to and positioned between the upper midsole cushioning member 806 and the lower midsole cushioning member 810. The upper midsole cushioning member 806 may include a recessed portion into which the plate 800 may fit or be seated, such that the upper midsole cushioning member 806 at least partially encases the plate 800. Portions of the lower cushioning member 810 may also extend into the recessed portion of the upper cushioning member 806 (see FIG. 34, for example).

The upper midsole cushioning member 806 and/or the lower midsole cushioning member 810 may be constructed from EVA, TPU, TPE, combinations thereof, or a similar type of material. For example, in some embodiments, the upper cushioning member 806 and/or the lower cushioning member 810 may be an ESS material, an EVA foam (e.g., PUMA® ProFoam Lite™, IGNITE Foam), polyurethane, polyether, an olefin block copolymer, a thermoplastic material (e.g., a thermoplastic polyurethane, a thermoplastic elastomer, a thermoplastic polyolefin, etc.), or a supercritical foam. The upper midsole cushioning member 806 and/or the lower midsole cushioning member 810 may be a single polymeric material or may be a blend of materials, such as an EVA copolymer, a thermoplastic polyurethane, a polyester block amide (PEBA) copolymer, and/or an olefin block copolymer. Further, the upper cushioning member 806 and/or the lower midsole cushioning member 810 may also be formed from a supercritical foaming process that uses a supercritical gas, e.g., $CO_2$, $N_2$, or mixtures thereof, to foam a material, e.g., EVA, TPU, TPE, or mixtures thereof. In such embodiments, the upper midsole cushioning member 806 and/or the lower midsole cushioning member 810 may be manufactured using a process that is performed in an autoclave, an injection molding apparatus, or any sufficiently heated/pressurized container that can process the mixing of a supercritical fluid (e.g., $CO_2$, $N_2$, or mixtures thereof) with a material (e.g., TPU, EVA, polyolefin elastomer, or mixtures thereof) that is preferably molten. For example, in an exemplary process, a solution of supercritical fluid is mixed with a molten material. This mixture is pumped or injected into a pressurized container, after which the pressure within the container is released, such that the molecules of the supercritical fluid rapidly convert to gas to form small pockets within the material and cause the material to expand into a foam, which may be used as the upper midsole cushioning member 806 and/or the lower midsole cushioning member 810. In further embodiments, the upper midsole cushioning member 806 and/or the lower midsole cushioning member 810 may be formed using alternative methods known in the art, including the use of an expansion press, an injection machine, a pellet expansion process, a cold foaming process, a compression molding technique, die cutting, or any combination thereof. In particular embodiments, the upper midsole cushioning member 806 and/or the lower midsole cushioning member 810 may be formed using a process that involves an initial foaming step, during which supercritical gas is used to foam a material, and a second step, during which the foamed material is compression molded or die cut to a particular shape. For example, the upper midsole cushioning member 806 and/or the lower midsole cushioning member 810 may be formed using a process that involves an initial foaming process that uses a supercritical fluid to foam a material, and then a second step that compression molds the foamed material to form the recessed surfaces of the upper midsole cushioning member 806.

In even further embodiments, the upper midsole cushioning member 806 and/or the lower midsole cushioning member 810 may be a bladder encasing a plurality of beads, such as a plurality of spherical or ellipsoidal beads or pellets formed from thermoplastic polyurethane, a thermoplastic elastomer, or a supercritical foam. For example, the upper midsole cushioning member 806 and/or the lower midsole cushioning member 810 may define an interior void (not shown) that receives a pressurized fluid or a plurality of ellipsoidal or spherical beads, such as the hollow space filled with a number of plastic bodies described in PCT Publication No. WO 2017/097315, filed on Dec. 7, 2015, which is hereby incorporated by reference in its entirety.

Similar to the heel support collar 174 of the sole structure 104, the sole structure 804 may also include a heel support collar 808. The heel support collar 808 may be formed from a thermoplastic material, such as a thermoplastic polyurethane, a thermoplastic elastomer, a thermoplastic olefin, or the like. Further, in particular embodiments, the heel support collar 808 may have a hardness between about ten (10) Shore A to about ninety (90) Shore A. In some embodiments, the heel support collar 808 may have a hardness or stiffness value greater than a hardness or stiffness value of the upper midsole cushioning member 806 and/or the lower midsole cushioning member 810.

Figure 36:
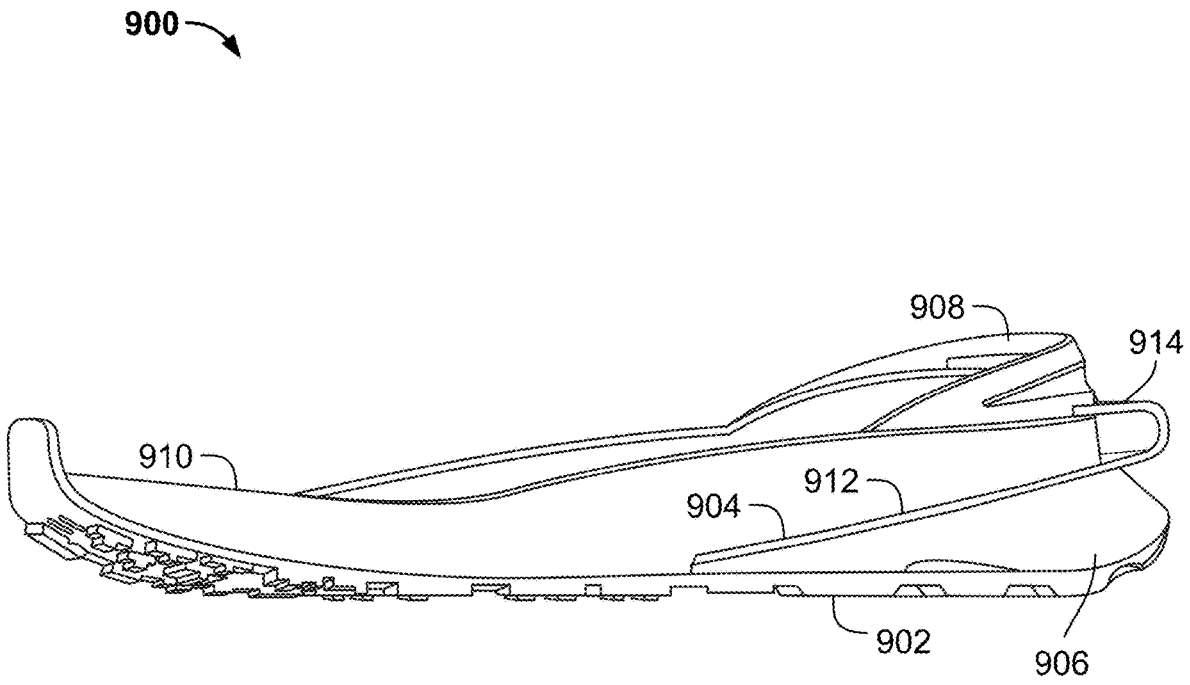
FIG. 36 is a perspective view of another sole structure for an article of footwear.
Figure 37:
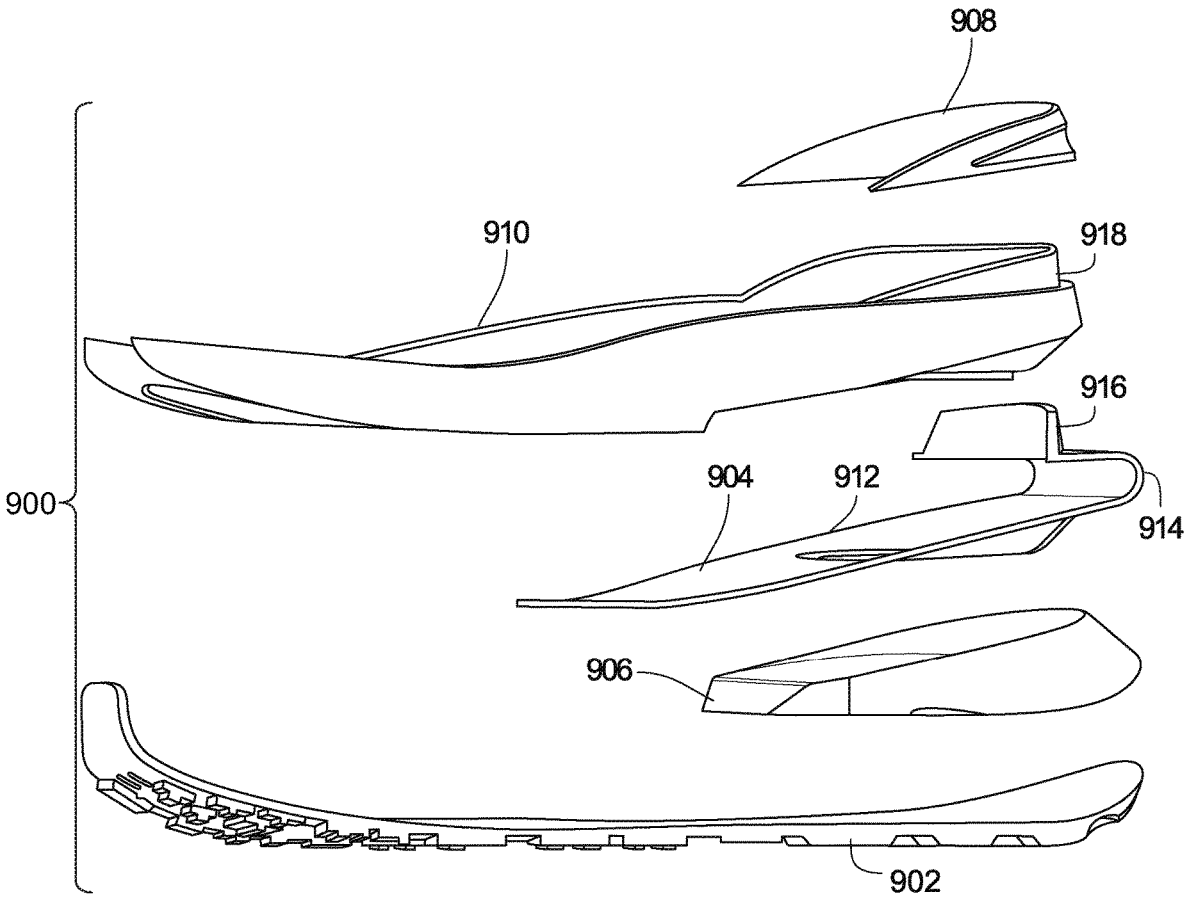
FIG. 37 is an exploded, perspective view of the sole structure of FIG. 36.
Figure 38:
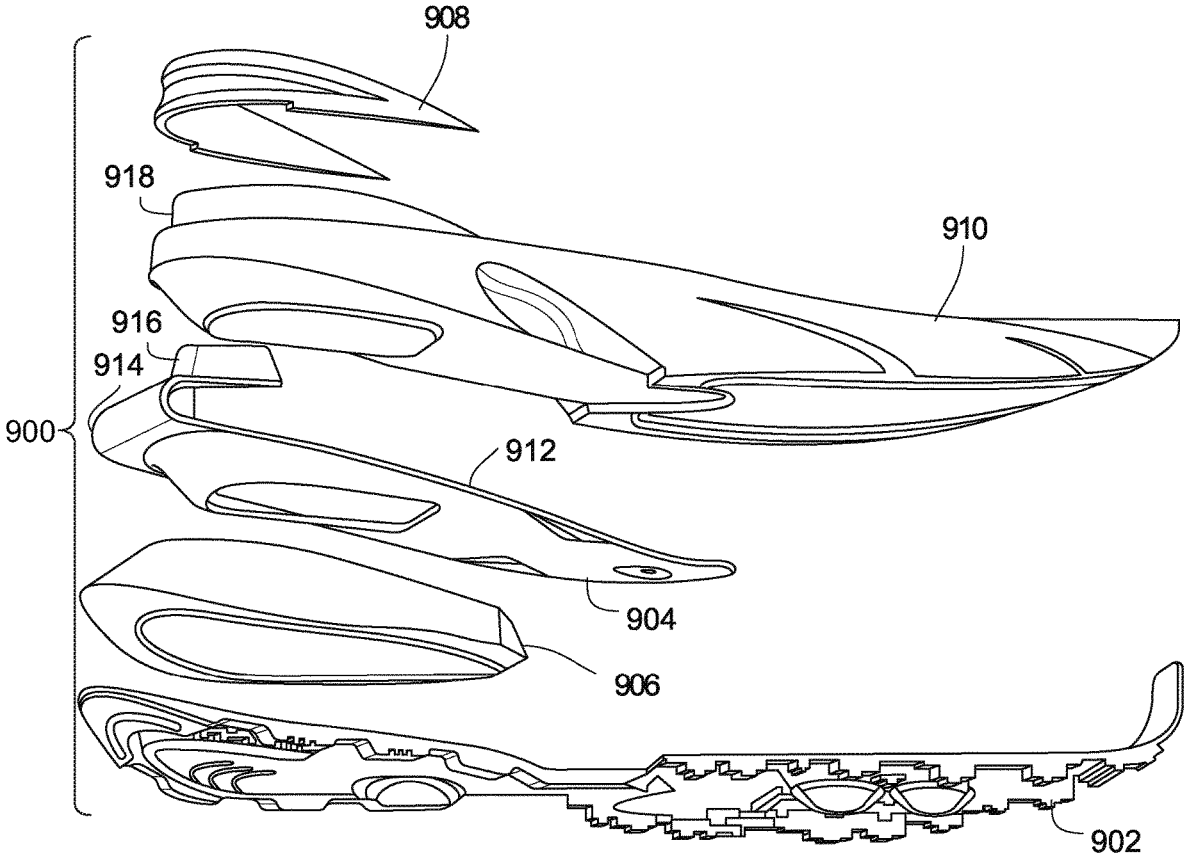
FIG. 38 is an exploded, bottom perspective view of the sole structure of FIG. 36.

FIGS. 36-38 depict another sole structure 900 for an article of footwear. In this embodiment, the sole structure 900 includes an outsole 902, a plate 904, a heel cushioning member 906, a heel support collar 908, and a midsole cushioning member 910.

In this embodiment, the plate 904 may include a lower base portion 912 with a slope having an angle between about 10 degrees and 45 degrees or between about 20 degrees and about 30 degrees. In other words, relative to a horizontal plane, the lower base portion 912 of the plate 904 slopes upwards as it extends toward a heel region of the sole structure 900. The plate may also include an arched, curved, or C-shaped rear portion 914 that connects the lower base portion 912 to an upwardly extending flange 916. The midsole cushioning member 910 may also include an upwardly extending sidewall 918 and the upwardly extending flange 916 may wrap around the sidewall 918 when the sole structure 900 is assembled, as shown in FIG. 36. Further, once the sole structure 900 is assembled, the heel support collar 908 may wrap around the flange 916 of the plate 904. Therefore, in these embodiments, a portion of the plate 904 may be positioned both above and below the midsole cushioning member 910 at a particular location along the sole structure 900. For example, near a heel region of the sole structure 900, the base portion 912 of the plate 904 is positioned below the midsole cushioning member 910 and the flange 916 of the plate 904 is positioned above the midsole cushioning member 910.

As previously discussed herein, the plate 904 may be formed from a thermoplastic material, such as a thermoplastic polyurethane, a thermoplastic elastomer, a thermoplastic olefin, or the like. In essence, the plate 904 may be constructed from similar materials and have similar properties as the plates 170, 406, 454, 504, 604, 704, 800 previously discussed herein.

The midsole cushioning member 910 may be constructed from similar materials to the midsole cushioning member 176. For example, the midsole cushioning member may be constructed or composed of EVA, TPU, TPE, combinations thereof, or a similar type of material. Further, as previously described herein, the midsole cushioning member 910 may also be formed from a supercritical foaming process that uses a supercritical gas, e.g., $CO_2$, $N_2$, or mixtures thereof, to foam a material, e.g., EVA, TPU, TPE, or mixtures thereof. In even further embodiments, the midsole cushioning member 910 may be a bladder encasing a plurality of beads, such as a plurality of spherical or ellipsoidal beads or pellets formed from thermoplastic polyurethane, a thermoplastic elastomer, or a supercritical foam. For example, the midsole cushioning member 910 may define an interior void (not shown) that receives a pressurized fluid or a plurality of ellipsoidal or spherical beads, such as the hollow space filled with a number of plastic bodies, as previously described herein.

In this embodiment, the sole structure 900 may also include the heel cushioning member 906, which may be positioned adjacent to and on top of the outsole 902 in the heel region and partially in the midfoot region. Put differently, the heel cushioning member 906 may be adjacent to the outsole 902, and may extend from the heel end of the sole structure 900, through the heel region, and partially through the midfoot region. The heel cushioning member 906 may be constructed from Ethylene-vinyl acetate (EVA), copolymers thereof, or a similar type of material. For example, in some embodiments, the heel cushioning member 906 may be an EVA-Solid-Sponge ("ESS") material, an EVA foam (e.g., PUMA® ProFoam Lite™, IGNITE Foam), polyurethane, polyether, an olefin block copolymer, a thermoplastic material (e.g., a thermoplastic polyurethane, a thermoplastic elastomer, a thermoplastic polyolefin, etc.), or a supercritical foam. The heel cushioning member 906 may be a single polymeric material or may be a blend of materials, such as an EVA copolymer, a thermoplastic polyurethane, a polyether block amide (PEBA) copolymer, and/or an olefin block copolymer. In even further embodiments, the heel cushioning member 906 may be a bladder encasing a plurality of beads, such as a plurality of spherical or ellipsoidal beads or pellets formed from thermoplastic polyurethane, a thermoplastic elastomer, or a supercritical foam. For example, the heel cushioning member 906 may define an interior void (not shown) that receives a pressurized fluid or a plurality of ellipsoidal or spherical beads, as previously described herein.

Similar to the heel support collar 174, the sole structure 900 may also include a heel support collar 908 positioned above the midsole cushioning member 900. The heel support collar 908 may be formed from a thermoplastic material, such as a thermoplastic polyurethane, a thermoplastic elastomer, a thermoplastic olefin, or the like.

Any of the embodiments described herein may be modified to include any of the structures or methodologies disclosed in connection with different embodiments. Similarly, materials or construction techniques other than those disclosed above may be substituted or added in some embodiments according to known approaches. Further, the present disclosure is not limited to articles of footwear of the type specifically shown. Still further, aspects of the articles of footwear of any of the embodiments disclosed herein may be modified to work with any type of footwear, apparel, or other athletic equipment.

As noted previously, it will be appreciated by those skilled in the art that while the disclosure has been described above in connection with particular embodiments and examples, the disclosure is not necessarily so limited, and that numerous other embodiments, examples, uses, modifications and departures from the embodiments, examples and uses are intended to be encompassed by the claims attached hereto.

We claim:

1. An article of footwear, comprising:

an upper; and a sole structure coupled with the upper, the sole structure defining a forefoot region, a midfoot region, and a heel region, the sole structure further defining a toe end and a heel end, the sole structure comprising:

a midsole cushioning member defining a top surface, a surface that projects upwardly from the top surface of the midsole cushioning member, and a cavity;

an outsole coupled to a bottom surface of the midsole cushioning member, the outsole including:

a forward outsole portion positioned within at least one of the forefoot region of the sole structure and the midfoot region of the sole structure;

a medial outsole portion positioned within the heel region of the sole structure; and a lateral outsole portion positioned within the heel region of the sole structure, wherein the forward outsole portion, the medial outsole portion, and the lateral outsole portion are positioned about the cavity; and a plate coupled to the top surface of the midsole cushioning member, the plate including a first surface and a second surface opposite the first surface, and a thickness between the first surface and the second surface of the plate is substantially uniform, wherein the plate includes:

a toe segment that extends through at least the forefoot region, the toe segment defining a first concave curved portion that extends downward from a distal end to a first inflection point disposed within the midfoot region; and a middle segment defining a second concave curved portion that extends upward from the first inflection point and toward the heel region before transitioning to a convex curved portion at a second inflection point disposed within the midfoot region or the heel region.

2. The article of footwear of claim 1, wherein the toe segment of the plate includes a first split that separates the toe segment of the plate into a first toe portion and a second toe portion.

3. The article of footwear of claim 2, wherein the first toe portion is disposed on a lateral side of the plate.

4. The article of footwear of claim 3, wherein the plate includes a rear segment having a second split that separates the rear segment of the plate into a first rear portion and a second rear portion.

5. The article of footwear of claim 4, wherein the first rear portion is disposed on the lateral side of the plate and the second rear portion is disposed on a medial side of the plate.

6. The article of footwear of claim 1, wherein the plate includes a rear segment that extends through the heel region of the sole structure from the convex curved portion defined by the middle segment of the plate.

7. The article of footwear of claim 6, wherein a minimum width of the toe segment of the plate is larger than a minimum width of the rear segment of the plate.

8. The article of footwear of claim 1, wherein the cavity of the midsole cushioning member is disposed within at least one of the midfoot region of the sole structure and the heel region of the sole structure.

9. The article of footwear of claim 1, wherein the toe segment of the plate is disposed at a first angle of between about 5-degrees and about 45-degrees relative to a reference plane that is parallel with respect to a resting surface when the article of footwear is disposed on the resting surface.

10. The article of footwear of claim 9, wherein the middle segment of the plate is disposed at a second angle of between about 3-degrees and about 45-degrees relative to the reference plane.

11. An article of footwear, comprising:

an upper; and a sole structure coupled with the upper, the sole structure defining a forefoot region, a midfoot region, and a heel region, the sole structure further defining a toe end and a heel end, the sole structure comprising:

a midsole cushioning member defining a top surface, a surface that projects upwardly from the top surface of the midsole cushioning member, and a cavity;

an outsole coupled to a bottom surface of the midsole cushioning member, the outsole including:

a forward outsole portion positioned within at least one of the forefoot region of the sole structure and the midfoot region of the sole structure;

a medial outsole portion positioned within the heel region of the sole structure; and a lateral outsole portion positioned within the heel region of the sole structure, wherein the forward outsole portion, the medial outsole portion, and the lateral outsole portion are positioned about the cavity; and a plate coupled to the top surface of the midsole cushioning member, the plate including a first surface and a second surface opposite the first surface, and a thickness between the first surface and the second surface of the plate is substantially uniform, wherein the plate includes:

a first split that separates a toe segment of the plate into a first toe portion and a second toe portion; and a second split that separates a rear segment of the plate into a first rear portion and a second rear portion, wherein a maximum width of the second split is greater than a maximum width of the first split.

12. The article of footwear of claim 11, wherein the toe segment of the plate defines a first concave curved portion that extends downward from a distal end to a first inflection point defined in the midfoot region of the sole structure.

13. The article of footwear of claim 12, wherein the plate includes a middle segment defining a second concave curved portion that extends upward through the midfoot region from the first inflection point.

14. The article of footwear of claim 11, wherein the surface that projects upwardly from the top surface of the midsole cushioning member engages the second surface of the plate.

15. The article of footwear of claim 11, wherein the maximum width of the first split is defined as a distance between a distal end of the first toe portion and a distal end of the second toe portion in a direction that is perpendicular with respect to a longitudinal axis that extends between the toe end and the heel end of the sole structure, and wherein the maximum width of the second split is defined as a distance between a distal end of the first rear portion and a distal end of the second rear portion in the direction that is perpendicular with respect to the longitudinal axis.

16. An article of footwear, comprising:

an upper; and a sole structure coupled with the upper, the sole structure defining a forefoot region, a midfoot region, and a heel region, the sole structure further defining a toe end and a heel end, the sole structure comprising:

a midsole cushioning member having a top surface, a surface that projects upwardly from the top surface of the midsole cushioning member, and a cavity;

an outsole coupled to the midsole cushioning member, the outsole including:

a forward outsole portion positioned within at least one of the forefoot region of the sole structure and the midfoot region of the sole structure;

a medial outsole portion positioned within the heel region of the sole structure; and a lateral outsole portion positioned within the heel region of the sole structure, wherein the forward outsole portion, the medial outsole portion, and the lateral outsole portion are positioned about the cavity; and a plate coupled to the top surface of the midsole cushioning member, the plate including a first surface and a second surface opposite the first surface, and a thickness between the first surface and the second surface of the plate is substantially uniform, wherein the plate includes a first split that separates a toe segment of the plate into a first toe portion on a lateral side of the plate and a second toe portion, wherein the first toe portion and the second toe portion concavely curve downward through the forefoot region from distal ends of the first toe portion and the second toe portion, respectively, and wherein the plate includes a middle segment defining a first convex curved portion that extends upward through the midfoot region toward the heel region.

17. The article of footwear of claim 16, wherein the plate includes a second split that separates a rear segment of the plate into a first rear portion on the lateral side of the plate and a second rear portion on a medial side of the plate.

18. The article of footwear of claim 17, wherein the first rear portion and the second rear portion define a curved interior wall of the plate.

19. The article of footwear of claim 18, wherein the curved interior wall concavely curves toward the forefoot region along the first rear portion to a forwardmost point of the second split before concavely curving away from the forefoot region along the second rear portion from the forwardmost point of the second split.

20. The article of footwear of claim 16, wherein the sole structure further comprises a heel support collar positioned within the heel region of the sole structure.

* * * * *